US006393230B1

(12) United States Patent
Haneda et al.

(10) Patent No.: US 6,393,230 B1
(45) Date of Patent: May 21, 2002

(54) FIXING DEVICE AND IMAGE FORMING APPARATUS THEREWITH

(75) Inventors: Satoshi Haneda; Hiroyuki Tokimatsu; Kunio Shigeta, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/825,822

(22) Filed: Apr. 4, 2001

Related U.S. Application Data

(62) Division of application No. 09/488,401, filed on Jan. 20, 2000.

(30) Foreign Application Priority Data

Jan. 26, 1999 (JP) ..... 11-016862
Mar. 17, 1999 (JP) ..... 11-071974
Mar. 17, 1999 (JP) ..... 11-071975

(51) Int. Cl.[7] ..... G03G 15/20

(52) U.S. Cl. ..... 399/69; 219/216; 399/328; 399/333

(58) Field of Search ..... 219/216; 399/67, 399/68, 69, 70, 45, 328, 333, 330, 336

(56) References Cited

U.S. PATENT DOCUMENTS 5,774,763 A * 6/1998 Muramatsu

* cited by examiner

*Primary Examiner*—Arthur T. Grimley
*Assistant Examiner*—Hoang Ngo
(74) *Attorney, Agent, or Firm*—Bierman, Muserlian and Lucas

(57) ABSTRACT

In a fixing apparatus for fixing a toner image on a transfer material by applying heat and pressure to the transfer material, the fixing apparatus includes: a roll-shaped rotary member for applying heat, including a ray radiating device for radiating a ray generated by a ray generating source provided inside the ray radiating device; a cylindrical ray-transmitting base member through which the ray generated by the ray generating source is transmitted, being arranged around the ray radiating device; a resilient layer; and a ray absorbing layer provided outside the resilient layer for absorbing the ray generated by the ray generating source. The following condition is satisfied, $K1>K2$ where K1 (J/cm·s·K) represents thermal conductivity of the ray-transmitting base member and K2 (J/cm·s·K) represents thermal conductivity of the resilient layer.

4 Claims, 26 Drawing Sheets

K
C
10
M
18
13
17
Y
17a
131
11a
171g
11
12
19a
F1
F
F
F

FIG. 26 ( a )
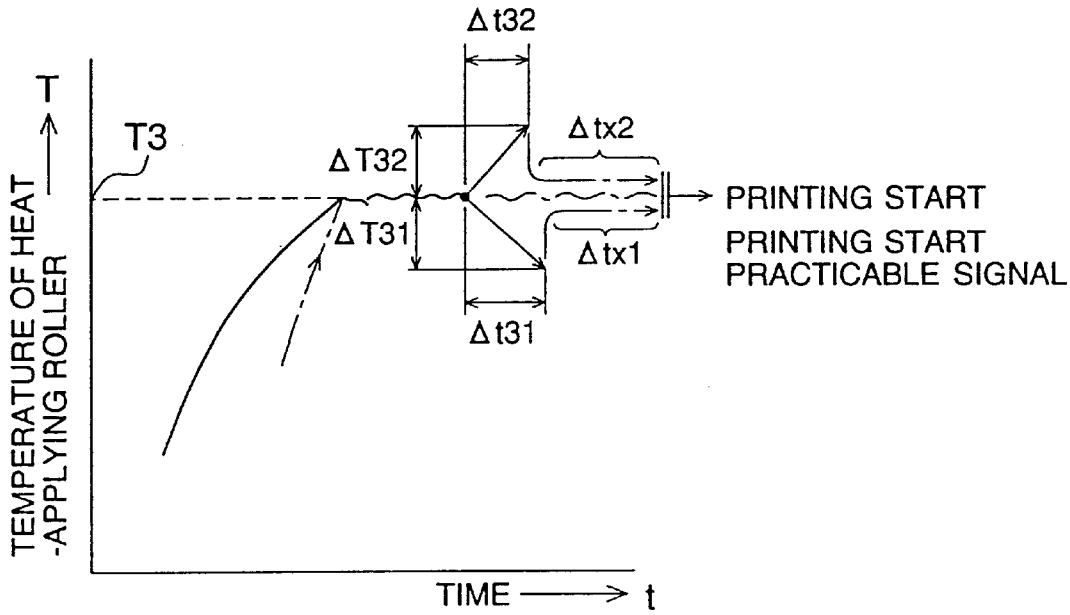
FIG. 26 ( b )
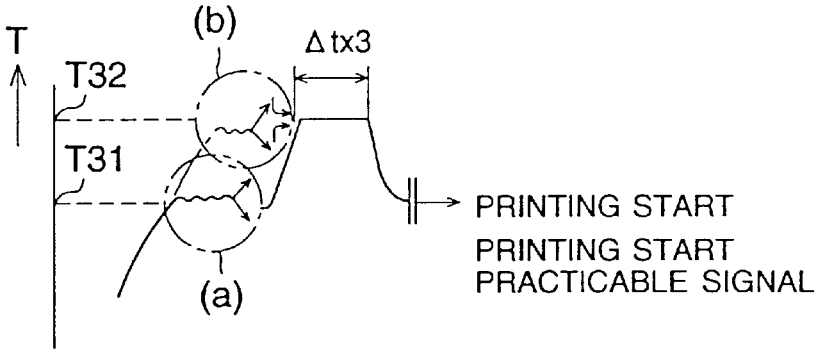
FIG. 26 ( c )
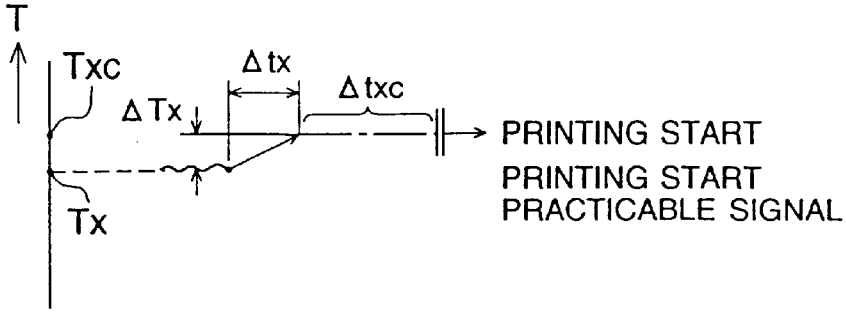

FIXING DEVICE AND IMAGE FORMING APPARATUS THEREWITH

This is a Division of Ser. No. 09/488,401, filed Jan. 20, 2000.

BACKGROUND OF THE INVENTION

The present invention relates to a fixing device for use in an image forming apparatus such as a copier, printer, facsimile device, etc., and particularly to a fixing device for instantaneous heating practicable quick start fixing, and an image forming apparatus therewith.

Conventionally, as a fixing device for use in an image forming apparatus such as a facsimile device, or the like, a heat roller fixing type device is widely adopted from a low speed apparatus to a high speed apparatus, and from a monochromatic apparatus to a full-color apparatus, as the fixing device which has the high technical complication degree and stability.

However, in the conventional heat roller fixing type fixing device, when transfer material or toner is heated, it is necessary that a fixing roller having a large thermal capacity is heated, therefore, the effect of energy conservation is not good, and it is disadvantageous to the phase of the energy conservation, and when printing, it takes a long period of time to warm up the fixing device, therefore the print time (warming up time) takes a long period of time, which is a problem.

In order to solve these problems, a film fixing type fixing device in which a film (heat fixing film) is used, and the thickness of the heat roller is decreased to that of heat fixing film which is the ultimate thickness and the thermal capacity of the heat roller is decreased, and heat conduction efficiency is greatly improved by directly pressure-contacting the temperature controlled-heater (ceramic heater) onto the heat fixing film, and the energy conservation and the quick start which requires almost no warming-up time are intended, and an image forming apparatus therewith are proposed and used recently.

Further, a fixing method in which, as a variation of the heat roller, a ray-transmitting base member is used as a heat-applying roller (a rotary member for applying heat), and a ray from a heat ray filament (a ray generating source) of a halogen lamp (a ray radiation device for radiating ray) provided therein is radiated onto toner and thereby heating and fixing is conducted, and the quick start which requires almost no warming-up time, is intended, is disclosed in Japanese Tokkaisho No. 52-106741, No. 57-82240, No. 57-102736, No. 57-102741, etc. Further, a fixing method, in which a ray absorbing layer is provided on outer peripheral surface of the ray-transmitting base member and thereby, the heat-applying roller (a rotary member for applying heat) is structured, and a ray from a heat ray filament (a ray generating source) of a halogen lamp (a ray radiation device for radiating ray) provided inside the cylindrical ray-transmitting base member is absorbed in the ray absorbing layer provided on the outer peripheral surface of the ray-transmitting base member, and the toner image is fixed by the heat of the ray-absorbing layer, is disclosed in Japanese Tokkaisho No. 59-65867.

However, in the method in which a ray from a heat ray filament (a ray generating source) of a halogen lamp (a ray radiation device for radiating ray) is radiated through the ray-transmitting base member onto toner and thereby heating and fixing is conducted, disclosed in Japanese Tokkaisho No. 52-106741, etc., and in the method in which a ray absorbing layer is provided on outer peripheral surface of the ray-transmitting base member and thereby, the heat-applying roller (a rotary member for applying heat) is structured, a ray from a heat ray filament (a ray generating source) of a halogen lamp (a ray radiation device for radiating ray) is radiated through the ray-transmitting base member onto the ray absorbing layer, and the toner is fixed by the heat of the ray-absorbing layer, the energy conservation and the quick start in which the warming-up time is reduced, are intended, however, the problem occurs that, by the diffusion of the heat to the ray-transmitting base member side in the axial direction (in the radial direction from the center axis of the rotary member for applying heat) of the rotary member for applying heat, instantaneous heating is not conducted. That is, by the flowing-away of the heat from the ray absorbing layer toward the inside, the problem occurs that quick temperature rise-up of the surface temperature of the ray absorbing layer is not carried out.

Further, a problem occurs that, when the transfer material is continuously passing through at the time of fixing, the heat in the lateral direction (in the direction perpendicular to the feeding direction of the transfer material) including the sheet passing section and the sheet non-passing section of the roll-like rotary member for applying heat becomes uneven, and the uniformity of the heat in the lateral direction of the rotary member for applying heat is not obtained. That is, the problem occurs that the uniformity of the heat can not be obtained by the temperature change.

Further, in the above fixing methods, only the ray absorbing layer does not have the heat accumulation action, therefore, the temperature lowering or unevenness of the heat occurs due to the flow-away of the heat from the rotary member for applying heat to the transfer material or to the rotary member for fixing (the fixing roller) provided on the lower side, opposed to the rotary member for applying heat. This occurs from the problem that the temperature of the ray-transmitting base member of the inside of the rotary member for applying heat is low, therefore, the heat is not supplied to the ray absorbing layer, and the temperature stabilization of the ray absorbing layer is not carried out.

Further, in the above fixing methods, a problem that the temperature rising-up speed of the ray absorbing layer of the surface is fast and only the surface is heated, however, the temperature inside the heat applying roller is low, therefore, when print start is conducted soon, the low temperature fixing offset is generated, occurs.

Further, in the above fixing methods, the temperature of the ray absorbing layer of the surface is raised fast, but the temperature inside the rotary member for applying heat hardly rises, and therefore, an appropriate temperature control is not conducted by only detection of the surface temperature of the rotary member for applying heat, and a problem occurs that the low temperature fixing offset is generated.

Further, in the conventional heat roller, the heat roller is heated from the inside of the metallic pipe having good thermal conductivity by a halogen heater, and structured by providing a rubber layer, which is easily deteriorated by heating and has poor thermal conductivity, on the outside (the outer peripheral surface) of the metallic pipe, and it has poor responsibility and the inside temperature is higher than the outside temperature, and has a limitation of the quick start (quick heating). In contrast to this, in the above fixing methods, although the temperature of the ray absorbing layer of the surface can be raised up faster, the inside of the rotary member for applying heat is cool and the temperature is low, therefore, the temperature rise-up technology for such type of a rotary member for applying heat is necessary.

Further, in the above fixing methods, not only the kind of the transfer materials but the inside temperature of the rotary member for applying heat or the temperature of the rotary member for fixing located on the lower side of the rotary member for applying heat influence on the fixing device, and the temperature of the ray absorbing layer of the surface of the rotary member for applying heat rises fast, but the inside temperature hardly rises, therefore, the temperature control for high responsibility is required for the rotary member for applying heat whose temperature lowering is fast.

Further, in an image forming apparatus using the above fixing methods, depending on the temperature of the inside of the rotary member for applying heat, or the temperature of the rotary member for applying heat and the rotary member for fixing provided opposed to the rotary member for applying heat, or the kind of the transfer material or the size thereof, the problem that the continuous printing capacity is different occurs.

An object of the present invention is to prevent the flow-away of the heat from the ray absorbing layer to the inside and to enable the surface temperature of the ray absorbing layer to quickly rise up, and further, to intend to make the heat uniform in the lateral direction including the sheet passing section of the roll-like rotary member for applying heat and the sheet no-passing section and to prevent the diffusion of the heat in the axial direction of the rotary member for applying heat and to prevent the temperature variation inside the rotary member for applying heat, and thereby, to provide a fixing device for instantaneous heating practicable quick start fixing.

Another object of the present invention is to provide the fixing device which can start quickly by preventing the temperature change of the rotary member for applying heat and intending to make the heat uniform and to stabilize the temperature of the ray absorbing layer.

Still another object of the present invention is to provide the fixing device which can quickly start the control to prevent the low temperature fixing offset at the print start.

Further object of the present invention is to provide the fixing device which can quickly start the control to prevent the low temperature fixing offset by forecasting the inside temperature.

Furthermore object of the present invention is provide the fixing device having the temperature-rise technology by which the quick start (quick heating) of the rotary member for applying heat which is a type of rotary member using ray radiation, and whose surface temperature is quickly raised to the appropriate fixing temperature but whose inside temperature is low, can be carried out.

Still furthermore object of the present invention is to provide the fixing device which can control the temperature for the rotary member for applying heat whose temperature is rapidly lowered, at high responsibility, and can quickly start the heating (quick heating).

Still another object of the present invention is to provide an image forming apparatus with the fixing device which can conduct quick start (quick heating), corresponding to the continuous printing capacity which differs depending on the temperature inside the rotary member for applying heat, the temperature of the rotary member for applying heat and the rotary member for fixing provided opposed to the rotary member for applying heat, a kind of transfer materials, and sizes thereof.

The above described objects can be attained by the following fixing device which is characterized in that: in a fixing device by which a toner image on the transfer material is fixed on the transfer material by applying heat and pressure, a ray radiating means for radiating ray, having a ray generating source to radiate the ray, inside thereof, a cylindrical ray-transmitting base member having the light transmission property for the ray, and a resilient layer, which are arranged around the ray radiating means for radiating ray, and a ray absorbing layer to absorb the ray, provided outside the resilient layer, are provided and formed into a roll-shaped rotary member for applying heat; and when the thermal conductivity of the ray-transmitting base member is K1 (J/cm·s·K), and the thermal conductivity of the resilient layer is K2 (J/cm·s·K), the thermal conductivity K1 of the ray-transmitting base member is K1>K2, as compared to the thermal conductivity K2 of the resilient layer.

Further, the above described objects can be attained by the following fixing device which is characterized in that: in a fixing device by which a toner image on the transfer material is fixed on the transfer material by applying heat and pressure, a ray radiating means for radiating ray, having a ray generating source to radiate the ray, inside thereof, a cylindrical ray-transmitting base member having the light transmission property for the ray, and a resilient layer, which are arranged around the ray radiating means for radiating ray, and a ray absorbing layer to absorb the ray provided outside the resilient layer, are provided and formed into a roll-shaped rotary member for applying heat; and when the thermal conductivity of the resilient layer is K2 (J/cm·s·K), and the thermal conductivity of the ray absorbing layer is K3 (J/cm·s·K), the thermal conductivity K2 of the resilient layer is K2≦K3, as compared to the thermal conductivity K3 of the ray absorbing layer.

Further, the above described objects can be attained by the following fixing device which is characterized in that: in a fixing device by which a toner image on the transfer material is fixed on the transfer material by applying heat and pressure, a ray radiating means for radiating ray, having a ray generating source to radiate the ray, inside thereof, a cylindrical ray-transmitting base member having the light transmission property for the ray, and a resilient layer, which are arranged around the ray radiating means for radiating ray, and a ray absorbing layer to absorb the ray, provided outside the resilient layer, are provided and formed into a roll-shaped rotary member for applying heat; and when the thermal conductivity of the ray-transmitting base member is K1 (J/cm·s·K), the thermal conductivity of the resilient layer is K2 (J/cm·s·K), and the thermal conductivity of the ray absorbing layer is K3 (J/cm·s·K), then, K2<K1, K3.

Further, the above described objects can be attained by the following fixing device which is characterized in that: in a fixing device by which a toner image on the transfer material is fixed on the transfer material by applying heat and pressure, a ray radiating means for radiating ray, having a ray generating source to radiate the ray, inside thereof, a cylindrical ray-transmitting base member having the light transmission property for the ray, and a resilient layer, which are arranged around the ray radiating means for radiating ray, and a ray absorbing layer to absorb the ray, provided outside the resilient layer, are provided and formed into a roll-shaped rotary member for applying heat; and when the thermal capacity of the ray-transmitting base member is Q1 (cal/deg), and the thermal capacity of the resilient layer is Q2 (cal/deg), the thermal capacity Q1 of the ray-transmitting base member is (1/3)×Q2<Q1, as compared to the thermal capacity Q2 of the resilient layer.

Further, the above described objects can be attained by the following fixing device which is characterized in that: in a fixing device by which a toner image on the transfer material is fixed on the transfer material by applying heat and pressure, a ray radiating means for radiating ray, having a ray generating source to radiate the ray, inside thereof, a cylindrical ray-transmitting base member having the light transmission property for the ray, and a resilient layer, which are arranged around the ray radiating means for radiating ray, and a ray absorbing layer to absorb the ray, provided outside the resilient layer, are provided and formed into a roll-shaped rotary member for applying heat; and when the thermal capacity of the resilient layer is Q2 (cal/deg), and the thermal capacity of the ray absorbing layer is Q3 (cal/deg), the thermal capacity Q2 of the resilient layer is Q2>Q3, as compared to the thermal capacity Q3 of the ray absorbing layer.

Further, the above described objects can be attained by the following fixing device which is characterized in that: in a fixing device by which a toner image on the transfer material is fixed on the transfer material by applying heat and pressure, a ray radiating means for radiating ray, having a ray generating source to radiate the ray, inside thereof, a cylindrical ray-transmitting base member having the light transmission property for the ray, and a resilient layer, which are arranged around the ray radiating means for radiating ray, and a ray absorbing layer to absorb the ray, provided outside the resilient layer, are provided and formed into a roll-shaped rotary member for applying heat; and when the thermal capacity of the ray-transmitting base member is Q1 (cal/deg), the thermal capacity of the resilient layer is Q2 (cal/deg), and the thermal capacity of the ray absorbing layer is Q3 (cal/deg), then, Q3<Q1+Q2.

The above described objects can be attained by the following fixing device which is characterized in that: in a fixing device by which a toner image on the transfer material is fixed on the transfer material by applying heat and pressure, a ray radiating means for radiating ray, a cylindrical ray-transmitting base member having the light transmission property for the ray, which is arranged around the ray radiating means for radiating ray, and a ray absorbing layer to absorb the ray, provided outside the ray-transmitting base member, are provided and formed into a roll-shaped rotary member for applying heat; and when the ray energy absorption rate of the ray-transmitting base member is a1 (%), and the ray energy absorption rate of the ray absorbing layer is a3 (%), then, a1>a3.

Further, the above described objects can be attained by the following fixing device which is characterized in that: in a fixing device by which a toner image on the transfer material is fixed on the transfer material by applying heat and pressure, a ray radiating means for radiating ray, a cylindrical ray-transmitting base member having the light transmission property for the ray, and a cylindrical ray-transmitting resilient layer or ray-transmitting heat insulating layer, which are arranged around the ray radiating means for radiating ray, and a ray absorbing layer to absorb the ray, provided outside the ray-transmitting resilient layer or ray-transmitting heat insulating layer, are provided and formed into a roll-shaped rotary member for applying heat; and when the ray energy absorption rate of the ray-transmitting base member is b1 (%), the ray energy absorption rate of the ray-transmitting resilient layer or ray-transmitting heat insulating layer is b2 (%), and the ray energy absorption rate of the ray absorbing layer is b3 (%), then, (b1+b2)>b3.

Further, the above described objects can be attained by the following fixing device which is characterized in that: in a fixing device by which a toner image on the transfer material is fixed on the transfer material by applying heat and pressure, a ray radiating means for radiating ray, a cylindrical ray-transmitting base member having the light transmission property for the ray, which is arranged around the ray radiating means for radiating ray, and a ray absorbing layer to absorb the ray, provided outside the ray-transmitting base member, are provided and formed into a roll-shaped rotary member for applying heat; and when the minimum temperature inside the layer of the ray-transmitting base member at the time of temperature rise is T1, and the minimum temperature inside the layer of the ray absorbing layer is T3, then, T3>T1.

Further, the above described objects can be attained by the following fixing device which is characterized in that: in a fixing device by which a toner image on the transfer material is fixed on the transfer material by applying heat and pressure, a ray radiating means for radiating ray, a cylindrical ray-transmitting base member having the light transmission property for the ray, which is arranged around the ray radiating means for radiating ray, and a cylindrical ray-transmitting resilient layer or ray-transmitting heat insulating layer, having the light transmission property for the ray, and a ray absorbing layer to absorb the ray, provided outside the ray-transmitting resilient layer or ray-transmitting heat insulating layer, are provided and formed into a roll-shaped rotary member for applying heat; and when the minimum temperature inside the layer of the ray-transmitting base member at the time of temperature rise is T11, the minimum temperature inside the layer of the ray-transmitting resilient layer or ray-transmitting heat insulating layer is T21, and the minimum temperature inside the layer of the ray absorbing layer is T31, then, T31>T11, T21.

The above described objects can be attained by the fixing device which is characterized in that: in a fixing device by which a toner image on the transfer material is fixed on the transfer material by applying heat and pressure, a ray radiating means for radiating ray, a cylindrical ray-transmitting base member having the light transmission property for the ray, which is arranged around the ray radiating means for radiating ray, and a ray absorbing layer to absorb the ray, provided outside the ray-transmitting base member, are provided and formed into a roll-shaped rotary member for applying heat; and after the surface temperature of the rotary member for applying heat reaches the fixing proper temperature, the control by which the fixing can be carried out after a predetermined time of heating at the fixing proper temperature, is conducted.

The above described objects can be attained by the fixing device which is characterized in that: in a fixing device by which a toner image on the transfer material is fixed on the transfer material by applying heat and pressure, a ray radiating means for radiating ray, a cylindrical ray-transmitting base member having the light transmission property for the ray, which is arranged around the ray radiating means for radiating ray, and a ray absorbing layer to absorb the ray, provided outside the ray-transmitting base member, are provided and formed into a roll-shaped rotary member for applying heat; and the control in which, after the surface temperature of the rotary member for applying heat exceeds the fixing proper temperature, and is raised up to the excess heating temperature, and is heated at the excess heating temperature, the surface temperature is lowered again to the fixing proper temperature and then, the fixing can be carried out, is conducted.

Further, the above described objects can be attained by the fixing device which is characterized in that: in a fixing device by which a toner image on the transfer material is fixed on the transfer material by applying heat and pressure, a ray radiating means for radiating ray, a cylindrical ray-transmitting base member having the light transmission property for the ray, which is arranged around the ray radiating means for radiating ray, and a ray absorbing layer to absorb the ray, provided outside the ray-transmitting base member, are provided and formed into a roll-shaped rotary member for applying heat; and the internal temperature of the rotary member for applying heat is forecasted by the surface temperature of the rotary member for applying heat and the temperature change, and the temperature control of the rotary member for applying heat is carried out.

Further, the above described objects can be attained by the fixing device which is characterized in that: in a fixing device by which a toner image on the transfer material is fixed on the transfer material by applying heat and pressure, a ray radiating means for radiating ray, a cylindrical ray-transmitting base member having the light transmission property for the ray, which is arranged around the ray radiating means for radiating ray, and a ray absorbing layer to absorb the ray, provided outside the ray-transmitting base member, are provided and formed into a roll-shaped rotary member for applying heat; and the temperature rise-up to the fixing proper temperature of the rotary member for applying heat is conducted by applying the maximum consuming electric power onto the ray radiating means for radiating ray, and after the temperature reaches the fixing proper temperature, the temperature control is conducted.

Further, the above described objects can be attained by the fixing device which is characterized in that: in a fixing device by which a toner image on the transfer material is fixed on the transfer material by applying heat and pressure, a ray radiating means for radiating ray, a cylindrical ray-transmitting base member having the light transmission property for the ray, which is arranged around the ray radiating means for radiating ray, and a ray absorbing layer to absorb the ray, provided outside the ray-transmitting base member, are provided and formed into a roll-shaped rotary member for applying heat; and temperature detecting means are provided at a front and rear of the nip portion of the rotary member for applying heat, and the setting temperature of the rotary member for applying heat is changed corresponding to the temperature difference between respective temperature detecting means.

Further, the above described objects can be attained by an image forming apparatus which is characterized in that: it has a fixing device by which a toner image on the transfer material is fixed on the transfer material by applying heat and pressure; a ray radiating means for radiating ray, a cylindrical ray-transmitting base member having the light transmission property for the ray, which is arranged around the ray radiating means for radiating ray, and a ray absorbing layer to absorb the ray, provided outside the ray-transmitting base member, are provided, and a roll-shaped rotary member for applying heat is provided; and the rotary member for fixing is provided opposed to the rotary member for applying heat, and thus the fixing device is formed; and the warming-up time of the rotary member for applying heat is changed corresponding to the output form of the image forming apparatus.

BRIEF DESCRIPTION OF THE DRAWINGS

FIGS. 26(*a*), 26(*b*) and 26(*c*) are views showing the forecasting temperature control of the rotary member for applying heat according to the present invention.

DETAILED DESCRIPTION OF THE PREFERRED EMBODIMENT

Embodiments of the present invention will be described below. In the following description, an image writing means is arranged inside an image forming body, however, the image writing means arranged outside the image forming body is included in the present invention.

Figure 1:
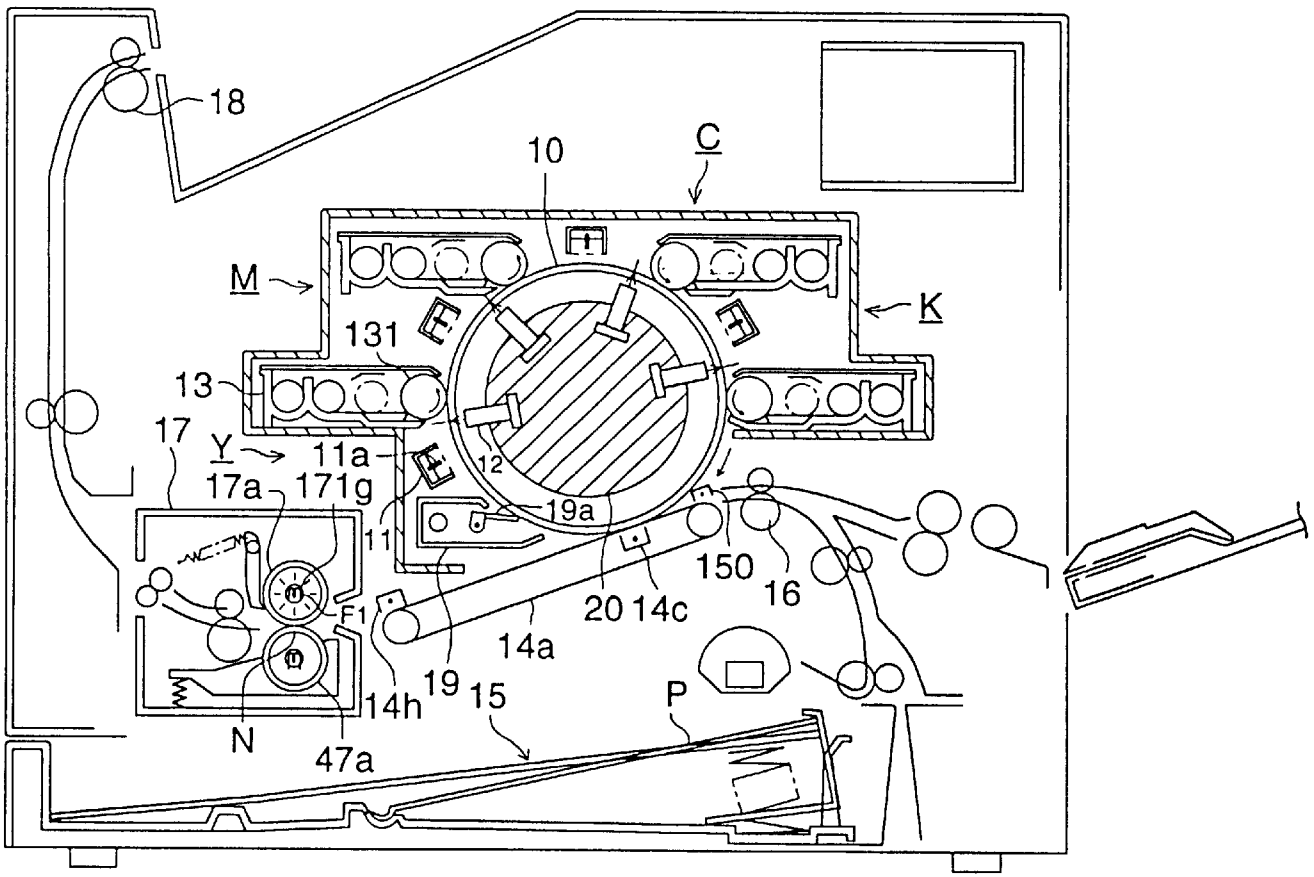
FIG. 1 is a sectional structural view showing a color image forming apparatus of an embodiment of an image forming apparatus in which a fixing device according to the present invention is used.
Figure 2:
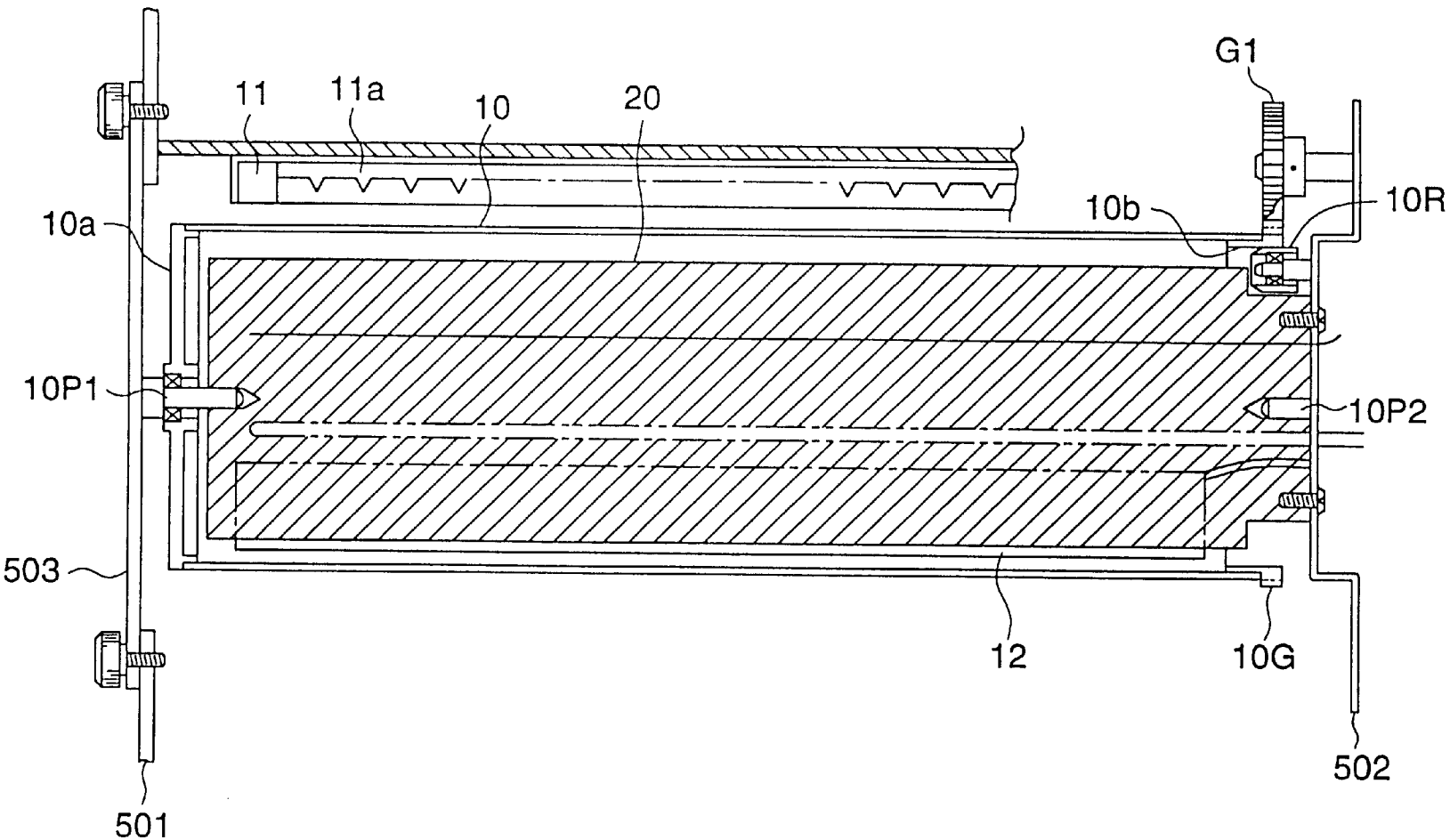
FIG. 2 is a side sectional view of the image forming body in FIG. 1.
Figure 3:
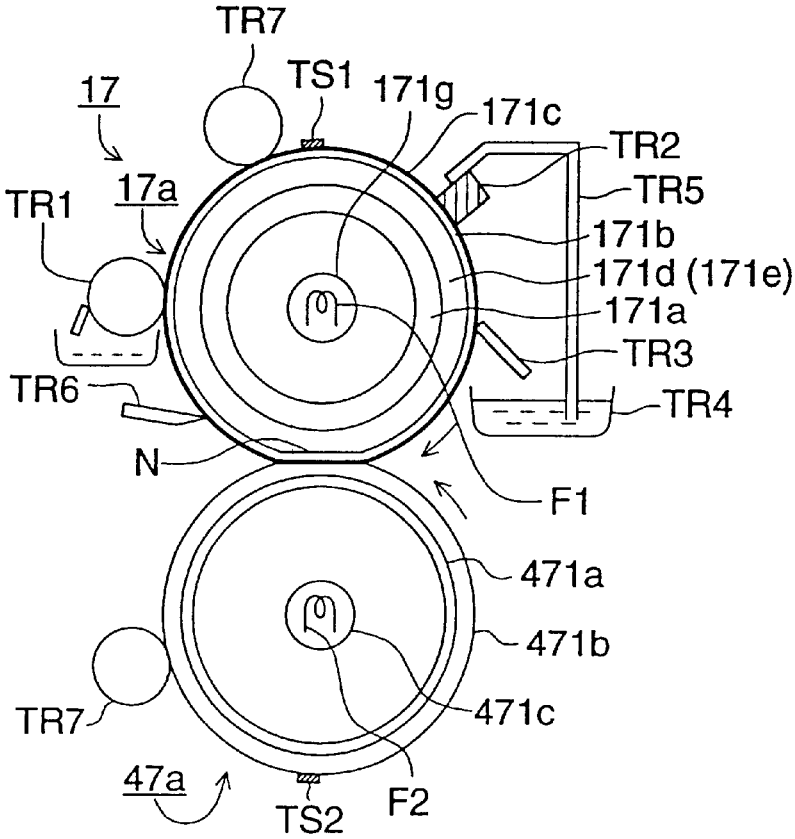
FIG. 3 is an illustrative view showing the structure of the fixing device according to the present invention.
Figure 4:
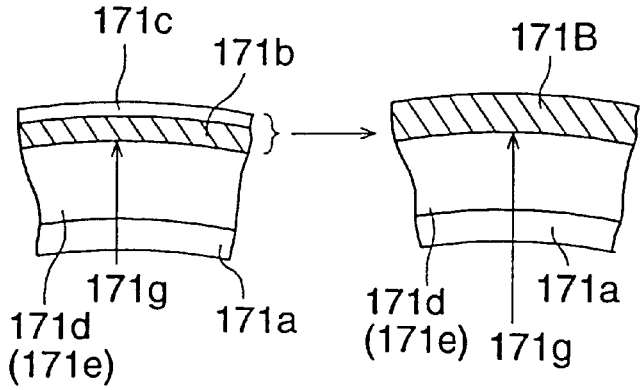
FIGS. 4(*a*) and 4(*b*) are enlarged sectional structural views of a roll-shaped rotary member for applying heat in FIG. 3.
Figure 5:
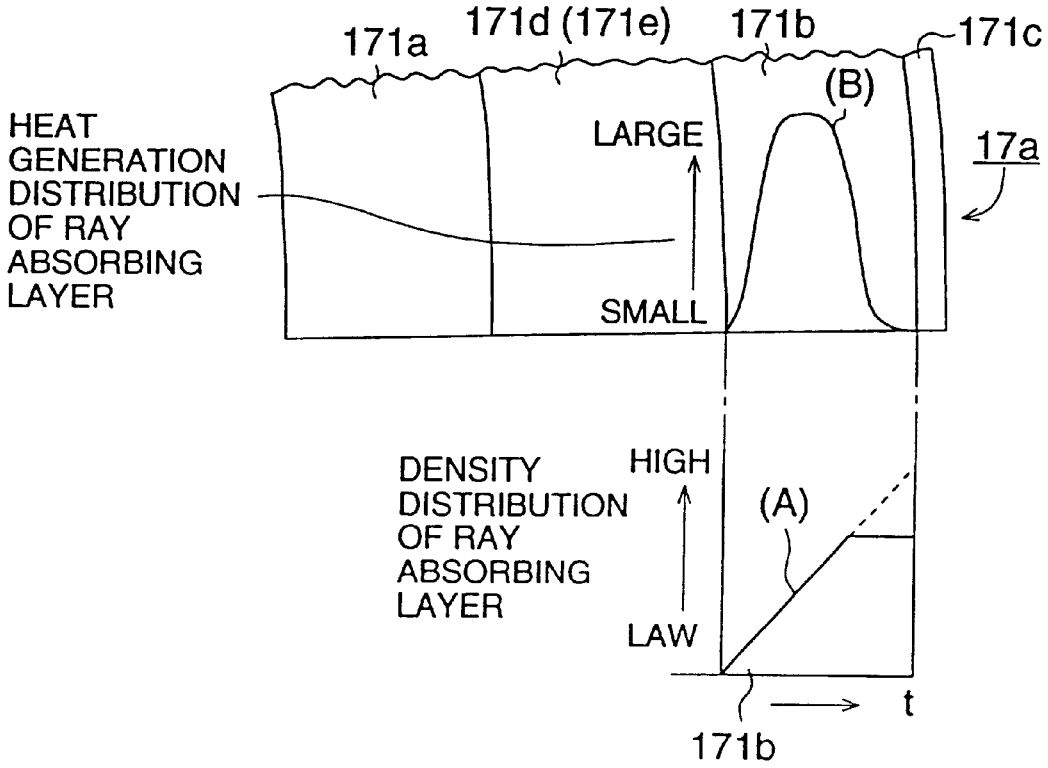
FIG. 5 is a view showing the density distribution of a ray absorbing layer of the roll-shaped rotary member for applying heat in FIG. 3.
Figure 6:
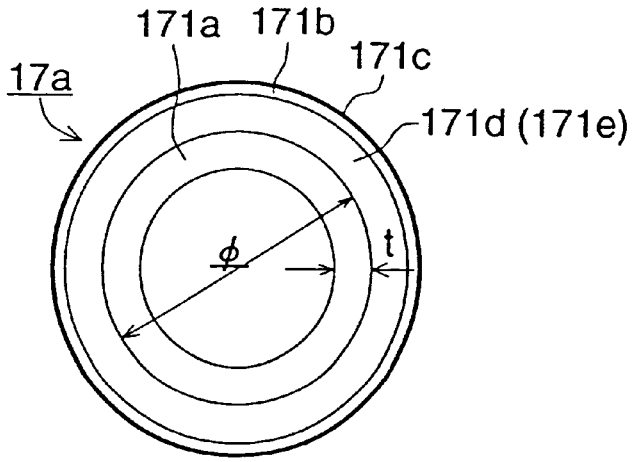
FIG. 6 is a view showing the outer diameter and the thickness of the ray-transmitting base member of the roll-shaped rotary member for applying heat in FIG. 3.

Referring to FIG. 1–FIG. 6, an image forming process and each mechanism of an embodiment of an image forming apparatus using a fixing device according to the present invention will be described below. FIG. 1 is a sectional structural view showing a color image forming apparatus of an embodiment of the image forming apparatus using the fixing device according to the present invention, FIG. 2 is a side sectional view of the image forming body of FIG. 1, FIG. 3 is an illustrative view showing the structure of the fixing device, and FIG. 4 is an enlarged sectional structural view of a roll-shaped rotary member for applying heat in FIG. 3. FIG. 5 is a view showing the density distribution of a ray absorbing layer of the roll-shaped rotary member for applying heat in FIG. 3, and FIG. 6 is a view showing the outer diameter and the thickness of a ray-transmitting base member of the roll-shaped rotary member for applying heat in FIG. 3.

According to FIG. 1 or FIG. 2, a photoreceptor drum 10 which is an image forming body, is formed in such a manner that, on the outer periphery of a cylindrical base body formed of a ray-transmitting member such as, for example, glass, acrylic resin, or the like, a light conductive material layer such as a ray-transmitting conductive layer or organic photoreceptor layer (OPC), is formed. The photoreceptor drum 10 is rotated clockwise as shown by an arrow in FIG. 1 by the driving power from the driving source, not shown, while the ray-transmitting conductive layer is electrically grounded.

The photoreceptor drum 10 is held by a front flange 10*a* and a rear flange 10*b*, and the front flange 10*a* is supported by a bearing by a guide pin 10P1 provided on a cover 503 attached onto a front side plate 501 of the apparatus main body, and the rear flange 10*b* is engaged externally with a plurality of guide rollers 10R attached onto a rear side plate 502 of the apparatus main body, and the photoreceptor drum 10 is held. A gear 10G provided on the outer periphery of the rear flange 10*b* is engaged with the driving gear G1, and by its driving power, the photoreceptor drum 10 is rotated clockwise as shown by an arrow in FIG. 1 while the transparent conductive layer is electrically grounded.

In the present invention, in the light conductive layer of the photoreceptor drum which is an image forming point of the exposure beam for the image exposure, the transparent base body may have only an amount of exposure of the wavelength, which can form an appropriate contrast on the light damping characteristics (light carrier generation) of a light conductive layer. Accordingly, it is not necessary that the light transparency factor of a transparent base body of the photoreceptor drum be 100%, but may have a characteristic in which some amount of light is absorbed at the time of transmission of the exposure beam, and the point is, it may be able to form an appropriate contrast on the light conductive layer. As light transmitting base body materials, acrylic resins, specifically, polymers incorporating a methyl methacrylate monomer, are excellent for the transparency, strength, accuracy, surface property, etc., and are preferably used. Further, any type of light transmissive resins such as acryl, fluorine, polyester, polycarbonate, polyethylene terephthalate, etc., which are used for general optical members, may be used. The material may even be colored if it still has light permeability with respect to the exposure light beams. As a light conductive layer, indium tin oxide (ITO), tin oxide, lead oxide, indium oxide, copper iodide, or a metallic film, in which light permeability is still maintained, and which is formed of Au, Ag, Ni, Al, etc., can be used. As film forming methods, a vacuum deposition method, an activated reaction deposition method, any type of spattering method, any type of CVD method, any dip coating method, any spray coating method, etc., can be used. As light conductive layers, any type of organic photoreceptor layer (OPC) can be used.

The organic photoreceptor layer as the light conductive photoreceptor layer is a two-layer structured photoreceptor layer, in which functions are separated into a charge generation layer (CGL) having a charge generating material (CGM) as a primary component, and into a charge transport layer (CTL) having a charge transporting material (CTM) as a primary component. The two-layer structured organic photoreceptor has a thick CTL, therefore, the durability as the organic photoreceptor is high, and thereby, it is appropriate for the present invention. Incidentally, the organic photoreceptor layer may be a single layer structure in which the charge generating material (CGM) and the charge transporting material (CTM) are included in one layer, and generally, binder resins are included in the single layer structured or the two-layer structured photoreceptor layer.

A scorotron charger 11 as a charging means, an exposure optical system 12 as an image writing means, and a developing unit 13 as a developing means, which will be described below, are respectively used in the image forming process of each color of yellow (Y), magenta (M), cyan (C) and black (K), and in the present embodiment, these are arranged in the order of Y, M, C and K in the direction of rotation of the photoreceptor drum 10 as shown by an arrow in FIG. 1.

The scorotron charger 11 as the charging means is mounted in the direction perpendicular to the movement direction of the photoreceptor drum 10 which is the image forming body, (in the vertical direction to the view in FIG. 1, opposed to the photoreceptor drum 10 and close to it, and a control grid (without numeral code) held at the predetermined potential to the organic photoreceptor layer of the photoreceptor drum 10, and as a corona discharging electrode 11*a,* for example, a saw-toothed electrode, are used, and a charging action (in the present embodiment, negative charging) is conducted by the corona discharge which is the same polarity as toner, and uniform electric potential is given to the photoreceptor drum 10. As the corona discharge electrode 11*a,* a wire electrode or a needle-like electrode may be used.

An exposure unit 12 is structured as a unit for the exposure, in which a linear exposure element (not shown) in which a plurality of LEDs (light emitting diodes) as a light emitting element for imagewise exposure lights are arrayed in parallel to the axis of the photoreceptor drum 10, and a Selfoc lens (not shown) as a life-sized image forming element, are attached onto a holder. The exposure optical system 12 for each color is attached onto a cylindrical holding member 20 which is fixed by being guided by a guide pin 10P2, provided on a rear side plate 502 of the apparatus main body, and another guide pin 10P1, provided on a cover 503 attached on a front side plate 501, and it is accommodated inside the base body of the photoreceptor drum 10. As the exposure elements, a linear exposure element in which a plurality of light emitting elements such as Fls (fluorescent material emission elements), Els (electroluminescence elements), PLs (plasma discharge elements), etc., are aligned array-like, is used other than the above-described elements.

The exposure optical system 12 as the image writing means for each color is arranged inside the photoreceptor drum 10 in the state that the exposure position on the photoreceptor drum 10 is positioned between the scorotron charger 11 and the developing unit 13, and on the upstream side in the rotational direction of the photoreceptor drum to the developing unit 13.

The exposure optical system 12 conducts image processing according to image data for each color which is sent from a computer (not shown) and stored in a memory, and after that, conducts the image exposure onto the uniformly charged photoreceptor drum 10, and forms a latent image on the photoreceptor drum 10. The light emitting wavelength of the light emitting element used in the present embodiment is good within the range of 80–900 nm in which normally the light transparency of Y, M, C toners is high, however, because the image exposure is conducted from the rear surface, the wavelength shorter than this one, in which the light transparency is not so high for the color toner, may be used.

The developing unit 13 as the developing means for each color accommodates the two-component developer (the one-component developer may be allowable) of yellow (Y), magenta (M), cyan (C), or black (K) therein, and is respectively provided with the developing sleeve 131 which is a developing carrier formed of, for example, 0.5 mm to 1 mm thick, and 15 to 25 mm outer diameter cylindrical, non-magnetic stainless steel or aluminum material.

In a developing area, the developing sleeve 131 is kept non-contact with the photoreceptor drum 10 with a predetermined gap of, for example, 100 $\mu$m to 1000 $\mu$m, by a roller (not shown), and is rotated in the same direction as that of the photoreceptor drum 10. Onto the developing sleeve 131, when DC voltage with the same polarity as toner (in the present embodiment, negative polarity) or voltage in which AC voltage AC is superimposed on the DC voltage, is applied, the non-contact reversal development is conducted to the exposure portion of the photoreceptor drum 10. It is necessary that an accuracy of the development interval at the time is not larger than 20 $\mu$m in order to prevent the image unevenness.

As described above, the developing unit 13 reversal-develops the electrostatic latent image on the photoreceptor drum 10, which is formed by the charge of the scorotron charger 11 and by the image exposure by the exposure optical system 12, in the state of non-contact, by the toner with the same polarity as the charged polarity of the photoreceptor drum 10 (in the present embodiment, the photoreceptor drum is charged negatively, and the toner has negative polarity).

When the image formation starts, by the start of. the photoreceptor driving motor (not shown), a gear 10G provided on the rear flange 10*b* of the photoreceptor drum 10 is rotated through a gear G1 for driving, and the photoreceptor drum 10 is rotated clockwise as shown by an arrow in FIG. 1, and simultaneously, by the charging action of the Y scorotron charger 11, the electric potential is started to be given onto the photoreceptor drum 10. After the electric potential is given to the photoreceptor drum 10, in the Y exposure optical system 12, the exposure by the electric signal corresponding to the first color signal, that is, Y image data is started, the electrostatic latent image corresponding to the yellow (Y) image of the original image is formed on the photoreceptor layer of the surface of the photoreceptor drum 10 by the rotational scanning of the drum. This latent image is reversal-developed by the Y developing unit 13 in the state of non-contact, and the yellow (Y) toner image is formed on the photoreceptor drum 10.

Next, on the photoreceptor drum 10, the electric potential is applied on the yellow (Y) toner image by the charging action of the M scorotron charger 11, and the exposure is conducted by the electric signal corresponding to the second color signal, that is, the magenta (M) image data of the M exposure optical system 12, and the magenta (M) toner image is formed by being superimposed on the yellow (Y) toner image by the con-contact reversal development by the M developing unit 13.

By the same process, the cyan (C) toner image corresponding to the third color signal is formed by the C scorotron charger 11, the C exposure optical system 12, and the C developing unit 13, and the black (K) toner image corresponding to the fourth color signal is formed by the K scorotron charger 11, the K exposure optical system 12 and the K developing unit 13, wherein these toner images are formed by being respectively superimposed in order, and the color toner image is formed on the peripheral surface of the photoreceptor drum 10 during its one rotation.

As described above, in the present embodiment, the exposure onto the organic photoreceptor layer of the photoreceptor drum 10 by the Y, M, C and K exposure optical system 12 is conducted from the inside of the photoreceptor drum 10 through the transparent base body. Accordingly, any of the exposure of the image corresponding to the second, third and fourth color signals is not light-shielded by the previously formed toner image, and can form the electrostatic latent image and is preferable, however, the exposure may be conducted from the outside of the photoreceptor drum 10.

On the one hand, a recording sheet P as the transfer material is fed out by a feeding roller (without numeral code) from the sheet feed cassette 15 as a transfer material accommodation means, and is sent by a sending roller (without numerical code) to a timing roller 16.

The recording sheet P is in timed relationship with the color toner image carried on the photoreceptor drum 10 by the drive of the timing roller 16, and is attracted to a conveyance belt 14*a* by the charge of a paper charger 150 as a paper charging means, and sent to a transfer area. Onto the recording sheet P closely contacted and conveyed by the conveyance belt 14*a,* color toner images on the peripheral surface of the photoreceptor drum 10 are collectively transferred by the transfer unit 14*c* as a transfer means onto which the voltage with the reverse polarity to toner (in the present embodiment, positive polarity) is applied, in the transfer area.

The recording sheet P onto which color toner images are transferred, is discharged by a paper separation AC discharger 14*h* as a transfer material separation means, and separated from the conveyance belt 14*a* and conveyed to a fixing device 17.

The fixing device 17 is structured by a heat-applying roller 17*a* as the upper side roll-shaped rotary member for applying heat to fix the color toner image, and a fixing roller 47*a* as the lower side roll-shaped rotary member for fixing, and inside the heat-applying roller 17*a,* a halogen lamp 171*g* as the ray radiating device for radiating ray having a ray filament F1 as the ray generating source mainly radiating the ray such as the infra-red ray or far infra-red ray, is provided.

The recording sheet P is held in the nip portion N formed between the heat-applying roller 17*a* and the fixing roller 47*a,* the color toner image on the recording sheet P is fixed by applying the heat and pressure, and the recording sheet P is sent to the sheet delivery roller 18 and delivered onto a tray on the upper portion of the apparatus.

The toner remaining on the peripheral surface of the photoreceptor drum after transfer is cleaned by a cleaning blade 19*a* provided on a cleaning device 19 as an image forming body cleaning means. The photoreceptor drum 10 from which the remaining toner is removed, is uniformly charged by the scorotron charger 11, and enters into the next image forming cycle.

As shown in FIG. 3, the fixing device 17 is structured by a heat-applying roller 17*a* as the upper side resilient roll-shaped rotary member for applying heat to fix the toner image on the transfer material, and a fixing roller 47*a* as the lower side roll-shaped rotary member for fixing, and the recording sheet P is held in the nip portion N with the width of about 5 to 20 mm, formed between the heat-applying roller 17*a* and the fixing roller 47*a,* and the toner image on the recording sheet P is fixed by applying the heat and pressure. On the heat-applying roller 17*a* as the roll-shaped rotary member for applying heat provided upside, in the rotational direction of the heat-applying roller 17*a* from the position of the nip portion N, a fixing separation claw TR6, a fixing oil cleaning roller TR1, a heat uniformizing roller TR7, an oil coating felt TR2, and an oil amount regulating blade TR3 are provided, and the oil supplied from the oil tank TR4 to the oil coating felt TR2 through a capillary pipe TR5, is coated onto the heat-applying roller 17*a* by the oil coating felt TR2. The oil on the peripheral surface on the heat-applying roller 17*a* is cleaned by the fixing oil cleaning blade TR1. Accordingly, the heat uniformizing roller TR7, and a temperature sensor TS1 which is a temperature detecting sensor to measure the temperature of the heat-applying roller 17*a,* and which will be described later, are provided on the cleaned peripheral surface of the heat-applying roller 17*a* between the fixing oil cleaning roller TR1 and the oil coating felt TR2. The transfer material after fixing is separated by the fixing separation claw TR6. By the heat uniformizing roller TR7 using the metallic roller member having good thermal conductivity such as aluminum material, stainless material, etc. or the heat pipe, the heat generation temperature distribution of the peripheral surface of the heat-applying roller 17*a* heated by the ray absorbing layer 171*b* is uniformized. By the heat uniformizing roller TR7, the longitudinal direction and lateral direction temperature unevenness of the heat-applying roller 17*a* accompanied by the papering of the transfer material is uniformized.

The heat-applying roller 17*a* as the rotary member for applying heat to fix the toner images on the transfer material is structured as a soft roller in which a cylindrical ray-transmitting base member 171*a,* the ray-transmitting resilient layer 171*d* (or ray-transmitting heat insulating layer 171*e,* which will be described later) on the outside (outer peripheral surface) of the ray-transmitting base member 171*a,* ray absorbing layer 171*b* and parting layer 171*c* are provided in this order. Inside the ray-transmitting base member 171*a,* a halogen lamp 171*g* as the ray radiating device for radiating ray having a ray filament F1 as the ray generating source mainly radiating the ray such as the infrared ray or far infra-red ray, is provided. The heat-applying roller 17*a* as the rotary member for applying heat is structured as a high resilient soft roller in the manner as will be described later. The ray radiated from the halogen lamp 171*g* is absorbed by the ray absorbing layer 171*b,* and the quick heating practicable roll-shaped rotary member for applying heat is formed (an example of the roll-shaped rotary member for applying heat for the quick heating).

Further, the fixing roller 47*a* as the lower side roll-shaped rotary member for fixing is structured as a soft roller which is formed of, for example, a cylindrical metallic pipe 472*a* using the aluminum material, and a rubber roller 472*b* formed of a 1 to 3 mm thick thin wall rubber layer using, for example, a silicon material on the outer peripheral surface of the metallic pipe 472*a.* As the lower side roll-shaped rotary member for fixing, a high heat insulating resilient rubber roller is used, and the diffusion of the heat from the upper side rotary member for applying heat to the lower side rotary member for fixing is prevented, and a wide nip width are assured. Further, a heat uniformizing roller TR7 using the metallic roller member having good thermal conductivity such as the aluminum material or stainless material, which comes into contact with the surface of the rubber roller 471*b* and is rotated, is provided, and by the heat uniformizing roller TR7, the heat generation temperature distribution of the peripheral surface of the fixing roller 47*a* is uniformized. As the heat uniformizing roller TR7, it is preferable that a heat pipe which has a heat accumulation and dissipation function, is used. Further, the halogen lamp 472*c* as the heat generating source may be provided inside the metallic pipe 472*a.* Of course, the same structure as the upper side heat-applying roller 17*a* which is the present invention, may also be used for the lower side rotary member for fixing.

A plane-like nip portion N is formed between the upper side soft roller and the lower side soft roller and toner image is fixed.

TS1 is a temperature sensor which is a temperature detecting means using, for example, a contact type thermistor to conduct the temperature control, attached to the heat-applying roller 17*a,* and TS2 is a temperature sensor using, for example, a contact type thermistor to conduct the temperature control, attached to the fixing roller 47*a*. As the temperature sensors TS1 and TS2, the non-contact type sensor may also be used other than the contact type sensor.

According to FIGS. 4(*a*) and 4(*b*), the structure of the heat-applying roller 17*a* is as follows, as shown in the sectional view in FIG. 4(*a*), as the cylindrical ray-transmitting base member 171*a,* the thickness is 1 to 40 mm, preferably, 2 to 5 mm thick, and ceramic materials which absorb the ray of the infrared ray or far infrared radiation from the halogen lamp 171*g* at the ray energy absorption rate, which will be described later, and the remained ray is transmitted, such as Pyrex glass, sapphire ($AL_2O_3$), CaF2, etc., (the thermal conductivity is $(5–20)\times10^{-3}$ J/cm·s·K, the specific heat is (0.5–2.0)×J/g·K, and the specific gravity is 1.5–3.0), or ray transmitting resins using polyimide, polyamide, etc., (whose thermal conductivity is $(2–4)\times10^{-3}$ J/cm·s·K, the specific heat is (1–2)×J/g·K, and the specific gravity is 0.8–1.2), etc., are used. For example, as the ray transmitting base member 171*a* of the heat-applying roller 17*a,* a thermal capacity Q1 per width of size A-3 (297 mm) of the ray transmitting base member 171*a* when Pyrex glass whose inner diameter is 32 mm, outer diameter is 40 mm and the layer thickness (thickness) is 4 mm, (specific heat is 0.78 J/g·K, the specific gravity is 2.32), is used, is about 60 cal/deg. Further, because the wavelength of the ray which transmits the ray transmitting base member 171*a* is 0.1 to 20 μm, preferably, 0.3 to 3 μm, conditioners for hardness or thermal conductivity are added as fillers, however, the ray-transmitting base member 171*a* may also be formed of the material in which fine particles of the following metallic oxide are dissipated in the resin binder, wherein fine particles of metallic oxide are those of the ray-transmitting (mainly infrared ray or far infrared radiation transmittable) ITO, titanium oxide, aluminum oxide, zinc oxide, silicon oxide, magnesium oxide, calcium carbonate, etc., whose particle size is not more than ½ of the wavelength of the ray, preferably, not more than ⅓, and whose average particle diameter including the primary and the secondary particles is not more than 1 μm, preferably, not more than 0.1 μm. In the layer, the fact that the average particle diameter including the primary and the secondary particles is not more than 1 μm, preferably, not more than 0.1 μm, is preferable to prevent the light from scattering so that the light reaches the ray absorbing layer 171*b*. As described above, the thermal conductivity of the ray-transmitting base member 171*a* is not so good.

The ray-transmitting resilient layer 171*d* is formed of ray-transmitting rubber layer (base layer) which absorbs the ray at the ray energy absorption rate, which will be described later, and transmits the remained ray (mainly infrared ray or far infrared radiation), in which 1 to 20 mm thick, preferably, 2–5 mm thick, for example; silicon rubber or fluorine rubber is used. As the ray-transmitting resilient layer 171*d,* for the high speed operation, a method by which the thermal conductivity is increased by mixing powders of metallic oxide such as silica, alumina, magnesium oxide, etc., in the base layer (silicon rubber), is adopted, and a rubber layer in which the thermal conductivity is $(1–3)\times10^{-3}$ J/cm·s·K, specific heat is (1–2)×J/g·K, and the specific gravity is 0.9 to 1.0, is used. For example, as the ray-transmitting resilient layer 171*d* of the heat-applying roller 17*a,* a thermal capacity Q2 per width of size A-3 (297 mm) of the ray-transmitting resilient layer 171*d* when silicon rubber whose outer diameter is 50 mm and the layer thickness (thickness) is 5 mm, (specific heat is 1.1 J/g·K, the specific gravity is 0.91), is used, is about 50 cal/deg. The thermal conductivity of the rubber layer is lower by one figure than that of the ray-transmitting base member using the glass member (the thermal conductivity is $(5–20)\times10^{-3}$ J/cm·s·K) and therefore, the rubber layer plays a role of a layer having the heat insulation property. When the thermal conductivity is increased, generally there is the tendency in which the hardness of the rubber is increased, and for example, normally the hardness 40 Hs of the rubber is increased to near 60 Hs (JIS, A rubber hardness). The preferable rubber hardness is 5 to 60 Hs. Almost portion of the ray-transmitting resilient layer 171*d* of the rotary member for applying heat is covered by this base layer, and the compressed amount at the pressing time is determined by the rubber hardness of the base layer. On the intermediate layer of the ray-transmitting resilient layer 171*d,* fluorine-contained rubber as the oil resistant layer to prevent oil swelling is coated with the thickness of 20 to 300 μm. As the silicon rubber of a top layer of the ray-transmitting resilient layer 171*d,* RTV (Room Temperature Volcanizing) or LTV (Low Temperature Volcanizing) whose parting property is better than HTV (High Temperature Volcanizing), is covered in the same thickness of the intermediate layer. Further, because the wavelength of the ray which passes through the ray-transmitting resilient layer 171*d* is 0.1–20 μm, preferably, 0.3 to 3 μm, as the conditioner for the hardness or thermal conductivity, the ray-transmitting resilient layer 171*d* may be formed of the material in which fine particles of the following metallic oxide are dissipated in the resin binder, wherein fine particles of metallic oxide are those of the ray transmitting (mainly infrared ray or far infrared radiation transmittable) titanium oxide, aluminum oxide, zinc oxide, silicon oxide, magnesium oxide, calcium carbonate, etc., whose particle size is not more than ½ of the wavelength of the ray, preferably, not more than ⅓, and whose average particle diameter including the primary and the secondary particles is not more than 1 μm. preferably, not more than 0.1 μm. In the layer, the fact that the average particle diameter including the primary and the secondary particles is not more than 1 μm, preferably, not more than 0.1 μm, is preferable to prevent the light from scattering so that the light reaches the ray absorbing layer 171*b*. By providing the ray-transmitting resilient layer 171*d,* the heat-applying roller 17*a* as the rotary member for applying heat is structured as a high resilient soft roller. Further, as the heat-applying roller 17*a* which is the rotary member for applying heat of the present invention, as will be detailed later, instead of the ray-transmitting resilient layer 171*d* having heat insulating property, a ray-transmitting heat insulating layer 171*e* which has an effect of only the heat insulating property as a non-resilient layer of ray-transmitting resins, or the like, can also be used.

As ray-absorbing layer 11*b,* in the remained portion of the ray, which is radiated by the ray filament F1 of the halogen lamp 171*g* and absorbed in the ray-transmitting base member 171*a* and ray-transmitting resilient layer 171*d* (or the ray-transmitting heat insulating layer 171*e*), in order to attain that the ray of 90 to 100%, preferably 95 to 100%, which is corresponding to almost 100% of the ray which transmits through the ray-transmitting base member 171*a* and ray-transmitting resilient layer 171*d* (or the ray-transmitting heat insulating layer 171*e*), is absorbed by the ray-absorbing layer 171*b,* and the instantaneous heating practicable rotary member for applying heat is formed, the ray absorbing member in which powders of carbon black, graphite, iron black ($Fe_3O_4$), or each kind of ferrite and its compound, copper oxide, cobalt oxide, red oxide ($Fe_2O_3$), etc., are mixed in the resin binder, is used, and 10 to 500 μm thick, preferably 20 to 100 μm thick ray absorbing member is formed on the outside (on the outer peripheral surface) of the ray-transmitting resilient layer 171*d* (or the ray-transmitting heat insulating layer 171*e*) by spraying or coating. The thermal conductivity of the ray absorbing layer 171*b* can be set to a slightly higher value of $(3–10)\times10^{-3}$ J/cm·s·K (specific heat is (up to 2.0)×J/g·K, specific gravity is (up to 0.9)) by the addition of absorbent such as carbon black, or the like, as compared to the rubber layer of the ray-transmitting resilient layer 171*d* (the thermal conductivity is $(1–3)\times10^{-3}$ J/cm·s·K, specific heat is (1–2)×J/g·K, specific gravity is 0.9 to 1.0). As the ray absorbing layer 171*b,* the metallic roller member such as nickel electroforming roller, or the like, may be provided with the same thickness. In this case, in order to absorb the ray, it is preferable that the inside (inner peripheral surface) is black oxide-processed. When the ray absorbing rate in the ray absorbing layer 171*b* is lower than about 90%, and when about 20 to 80%, the ray breaks through the layer, and by the ray which breaks through the layer, in the case where the heat-applying roller 17*a* as the rotary member for applying heat is used for the monochromatic image formation, when the black toner is adhered on the surface of the specific position of the heat-applying roller 17*a* by filming, or the like, the heat generation occurs from the adhered portion by the ray which breaks through the layer, and the heat generation by the ray absorption further occurs at that portion, and thereby, the ray absorbing layer 171*b* is broken. Further, when it is used for the color image formation, generally, the absorption rate of the color toner is low, and because there is a difference of absorption rate between color toners, the fixing failure or fixing unevenness occurs. Accordingly, in the remained portion of the ray, which is radiated by the ray filament F1 of the halogen lamp 171*g* and absorbed in the ray-transmitting base member 171*a* and ray-transmitting resilient layer 171*d* (or the ray-transmitting heat insulating layer 171*e*), the ray absorption rate of the ray absorbing layer 171*b* is made 90 to 100%, preferably 95 to 100%, which is corresponding to almost 100% of the ray, so that the ray which transmits through the ray-transmitting base member 171*a* and ray-transmitting resilient layer 171*d* (or the ray-transmitting heat insulating layer 171*e*), is perfectly absorbed in the ray absorbing layer 171*b.* Thereby, the fusion of the color toner which is difficult to fix by the ray because the spectral characteristics are different, can be fairly conducted, and particularly, in the color image formation in FIG. 1, the fusion of the superimposed color toner images on the transfer material, on which the toner layer is thick, and which is difficult to fix by the ray because the spectral characteristics are different, can be fairly conducted. Further, when the thickness of the ray absorbing layer 171*b* is not more than 10 μm and thin, the heating speed by the absorption of the ray in the ray absorbing layer 171*b* is high, however, it becomes a cause of breakage or a short of strength of the ray absorbing layer 171*b* by the local heating due to thin film, and when the thickness of the ray absorbing layer 171*b* exceeds 500 μm and too thick, the thermal conductivity becomes poor, or the thermal capacity becomes large and quick heating can hardly conducted. When the ray absorption rate of the ray absorbing layer 171*b* is made 90 to 100%, preferably 95 to 100%, which is corresponding to almost 100% of the ray, or when the thickness of the ray absorbing layer 171*b* is made 10 to 500 μm, preferably 20 to 100 μm, the local heat generation in the ray absorbing layer 171*b* is prevented, and heat generation can be uniformly conducted. Further, because the wavelength of the ray radiated onto the ray absorbing layer 171*b* is 0.1 to 20 μm, preferably 0.3 to 3 μm, the conditioner for the hardness or thermal conductivity is added as filler, however, the ray absorbing layer 171*b* may be formed of the material in which fine particles of the following metallic oxide are dissipated in the resin binder by 5 to 50 wt %, wherein fine particles of metallic oxide are those of the ray transmitting (mainly infrared ray or far infrared radiation transmittable) titanium oxide, aluminum oxide, zinc oxide, silicon oxide, magnesium oxide, calcium carbonate, etc., whose particle size is not more than ½ of the wavelength of the ray, preferably, not more than ⅕, and whose average particle diameter including the primary and the secondary particles is not more than 1 μm, preferably, not more than 0.1 μm. As described above, because the thermal capacity of the ray absorbing layer 171*b* is made small so that the temperature rises soon, the problem that the temperature lowering occurs in the heat-applying roller 17*a* as the rotary member for applying heat, and uneven fixing is generated, is prevented. As the ray absorbing layer 171*b,* the material in which powders of carbon black, graphite, iron black ($Fe_3O_4$), or each kind of ferrite and its compound, copper oxide, cobalt oxide, red oxide ($Fe_2O_3$), etc., are mixed in the resilient silicon rubber or fluorine rubber, may also be used. For example, as the ray absorbing layer 171*b* (or a combined use layer 171B, which will be described later) of the heat-applying roller 17*a,* a thermal capacity Q3 per width of size A-3 (297 mm) of the ray absorbing layer 171*b* (or the combined use layer 171B) when fluorine resin whose layer thickness (thickness) is 50 μm, (specific heat is 2.0 J/g·K, the specific gravity is 0.9), is used on the surface (outer peripheral surface) of the ray-transmitting resilient layer having the outer diameter of 50 mm, is about 1.0 cal/deg. As the ray absorbing layer 171*b,* the metallic film member such as nickel electroforming belt, may be used. In this case, in order to absorb the ray, it is preferable that the inside (inner peripheral surface) is black oxide-processed.

Further, PFA (fluorine resin) tube with the thickness of 30 to 100 μm is covered on the outside (outer peripheral surface) of the ray absorbing layer 171*b,* separating from the ray absorbing layer 171*b,* in order to make the parting property from the toner good, or the parting layer 171*c* (thermal conductivity is $(1–10)\times10^{-3}$ J/cm·s·K, specific heat is (up to 2.0)×J/g·K, and specific gravity is (up to 0.9)) on which fluorine resin (PFA or PTFE) paint is coated to 20 to 30 μm, is provided (separation type).

Further, as shown in the sectional view in FIG. 4(*b*), the ray absorbing member, in which powders of carbon black, graphite, iron black ($Fe_3O_4$), or each kind of ferrite and its compound, copper oxide, cobalt oxide, red oxide ($Fe_2O_3$), etc., are mixed, and the resilient roll-shaped rotary member for applying heat may also be formed in such a manner that fluorine resin (PFA or PTFE) paint which combinedly has the binder and parting agent, is mixed and blended, and in FIG. 4(*a*), the ray absorbing layer 171*b* and the parting layer 171*c* are integrated, and a combined use layer 171B having the parting property is formed outside (outer peripheral surface) of the ray-transmitting resilient layer 171*d* (or ray-transmitting heat insulating layer 171*e*) formed outside (outer peripheral surface) the ray-transmitting base member 171*a.* The thermal conductivity of the combined use layer 171B is almost the same as the thermal conductivity of the ray absorbing layer 171*b* and $(3–10)\times10^{-3}$ J/cm·s·K (specific heat is (up to 2.0)×J/g·K, specific gravity is (up to 0.9)). In the same manner as described above, in the remained portion of the ray, which is radiated by the ray filament F1 of the halogen lamp 171*g* and absorbed in the ray-transmitting base member 171*a* and ray-transmitting resilient layer 171*d*

(or the ray-transmitting heat insulating layer 171*e*), the ray absorption rate of the combined use layer 171B is made 90 to 100%, preferably 95 to 100%, which is corresponding to almost 100% of the ray, so that the ray which transmits through the ray-transmitting base member 171*a* and ray-transmitting resilient layer 171*d* (or the ray-transmitting heat insulating layer 171*e*), is perfectly absorbed. When the ray absorbing rate in the combined use layer 171B is lower than about 90%, and for example, when about 20 to 80%, the ray breaks through the layer, and by the ray which breaks through the layer, in the case where the rotary member for applying heat is used for the monochromatic image formation, when the black toner is adhered on the surface of the specific position of the rotary member for applying heat by filming, or the like, the heat generation occurs from the adhered portion by the ray which breaks through the layer, and furthermore, the heat generation by the ray absorption further occurs at that portion, and thereby, the combined use layer 171B is broken. Further, when it is used for the color image formation, generally, the absorption efficiency of the color toner is low, and because there is a difference of absorption efficiency between color toners, the fixing failure or fixing unevenness occurs. Accordingly, in the remained portion of the ray, which is radiated by the ray filament F1 of the halogen lamp 171*g* and absorbed in the ray-transmitting base member 171*a* and ray-transmitting resilient layer 171*d* (or the ray-transmitting heat insulating layer 171*e*), the ray absorption rate of the combined use layer 171B is made 90 to 100%, preferably 95–100%, which is corresponding to almost 100% of the ray, so that the ray which transmits through the ray-transmitting base member 171*a* and ray-transmitting resilient layer 171*d* (or the ray-transmitting heat insulating layer 171*e*), is perfectly absorbed in the rotary member for applying heat. Further, the local heat generation in the combined use layer 171B is also prevented, and heat generation can be uniformly conducted. Further, because the wavelength of the ray radiated onto the combined use layer 171B is 0.1–20 μm, preferably 0.3 to 3 μm, the conditioner for the hardness or thermal conductivity is added as filler, however, the combined use layer 171B may be formed of the material in which fine particles of the following metallic oxide are dissipated in the resin binder, wherein fine particles of metallic oxide are those of the ray transmitting (mainly infrared ray or far infrared radiation transmittable) titanium oxide, aluminum oxide, zinc oxide, silicon oxide, magnesium oxide, calcium carbonate, etc., whose particle size is not more than ½ of the wavelength of the ray, preferably, not more than ⅕, and whose average particle diameter including the primary and the secondary particles is not more than 1 μm, preferably, not more than 0.1 μm.

According to FIG. 5, when the density distribution of the ray absorbing member is uniformly provided on the ray absorbing layer 171*b* of the heat-applying roller 17*a* as the roll-shaped rotary member for applying heat, heat generation concentrates on the ray absorbing layer 171*b* which is in the boundary, and the heat flows out to the ray-transmitting resilient layer 171*d* (or the ray-transmitting heat insulating layer 171*e*) side, therefore, it is preferable from the viewpoint of the dispersion of the distribution of the heat generation that the low thermal conductive member is used rather than ray-transmitting base member 171*a*, or that the density distribution is provided and the heat is generated inside the ray absorbing layer 171*b*. The density distribution of the ray absorbing layer 171*b* is as shown in the graph (A), the interface of the inscribing ray-transmitting resilient layer 171*d* (or the ray-transmitting heat insulating layer 171*e*) side is in the low density, and the distribution is sloped so that it is successively heightened toward the outer peripheral surface, and the density is made such that the ray of 100% is absorbed just before the outer peripheral surface side (at the position of about ⅔–⅘ from the ray-transmitting resilient layer 171*d* (or the ray-transmitting heat insulating layer 171*e*) to the thickness t of the ray absorbing layer 171*b*), and is saturated. According to this, the distribution of the heat generation by the ray absorption in the ray absorbing layer 171*b* is, as shown in the graph (B), formed into the parabolic-shape, which has the maximum value in the vicinity of the central portion of the ray absorbing layer 171*b* and the minimum values on the interface of the ray absorbing layer 171*b* or in the vicinity of the outer peripheral surface. Or it is preferable that the ray-transmitting heat resistive resin (polyimide, fluorine containing resin, or silicon resin) with 10 to 500 μm thickness, preferably 20 to 100 μm is provided on the interface of the ray absorbing layer 171*b* or outer peripheral surface. Further, it is preferable that the low thermal conductive member is used rather than the ray-transmitting base member 171*a* and the flow out of the heat is suppressed. According to this, the heat generation due to the ray absorption on the interface is made small, and the breakage of the adhering layer on the interface or the breakage of the ray absorbing layer 171*b* is prevented. The density distribution from just before the outer peripheral surface side (at the position of about ⅔–⅘ from the ray-transmitting base member 171*a* side (or the ray-transmitting heat insulating layer 171*e*) to the thickness t of the ray absorbing layer 171*b*), to the outer peripheral surface is made saturated, and particularly, even when the combined use layer 171B is used, it is made to give no influence even if the outer peripheral surface layer is rubbed out. Incidentally, as shown by a dotted line, the saturation layer may also be formed. In summary, when the absorption is fully conducted inside, there is no influence of the density outside. The influence of rubbing out is not generated also. Further, the slope is provided in the density distribution, and by changing the angle of the slope, the distribution of the heat generation can be adjusted.

Further, as shown in FIG. 6, as the outer diameter ϕ of the cylindrical ray-transmitting base member 171*a* of the heat-applying roller 17*a* as the roll-shaped rotary member for applying heat, a 15 to 60 mm member is used, and as the thickness t, the thick member is better for its strength, and the thin member is better for its thermal capacity, but, from the relationship between the strength and thermal capacity, the relationship of the outer diameter ϕ and the thickness t of the cylindrical ray-transmitting base member is $$0.05 \leqq t/\phi \leqq 0.20,$$

and preferably, $$0.07 \leqq t/\phi \leqq 0.14.$$

When the outer diameter ϕ of the ray-transmitting base member 171*a* is 40 mm, the thickness t of the ray-transmitting base member 171*a* is 2 mm≦t≦8 mm, preferably, 2.8 mm≦t≦5.6 mm. When t/ϕ of the ray-transmitting base member 171*a* is not larger than 0.05, the strength is insufficient, and when t/ϕ exceeds 0.20, the thermal capacity is too large, the heating of the heat-applying roller 17*a* takes a long period of time. Further, in the ray-transmitting base member, there is a case in which the ray of about 1 to 20% is absorbed depending on the material, and the thinner one is preferable within the range in which the strength can be maintained.

When the fixing device 17 as described in FIG. 3 is used, the fixing device which is strong for deformation in the fixing portion (nip portion), and can conduct the quick start (quick heating), can be provided, and further, due to the pressure in the soft fixing portion (nip portion) by the elasticity of the rotary member for applying heat and heating by the ray-absorbing layer of the rotary member for applying heat, because the spectral characteristics are different, the fusing of the color toner which is difficult to be fixed by the ray is conducted fairly, and the quick start (quick heating) of the color toner can be conducted. Further, the energy saving effect can be obtained.

Figure 7:
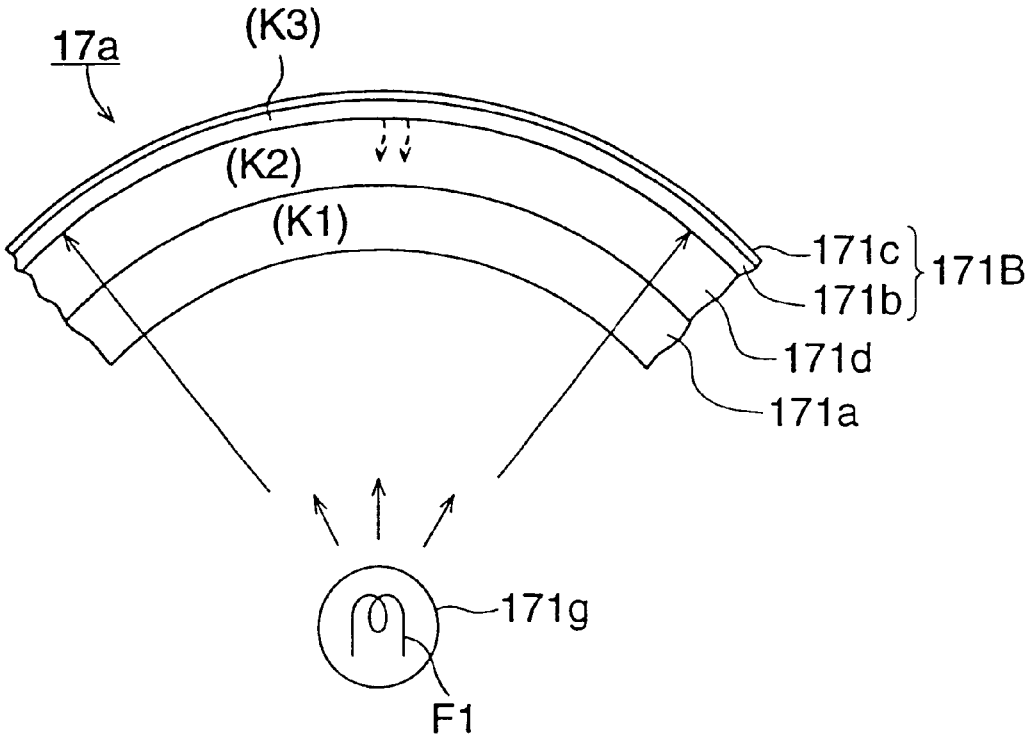
FIG. 7 is an illustrative view of the thermal conductivity of each layer of the rotary member for applying heat according to the present invention, and its relationships.
Figure 8:
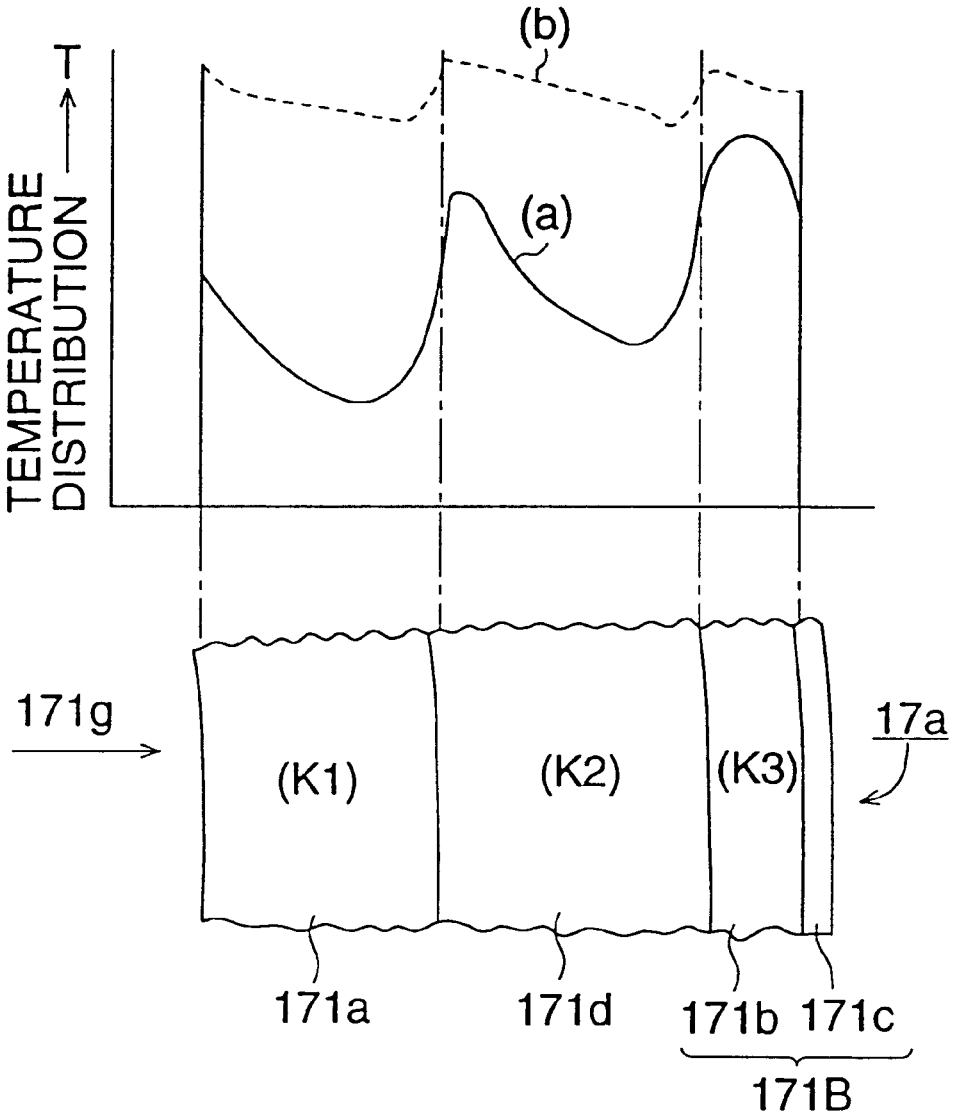
FIG. 8 is a view showing the thermal conductivity of each layer of the rotary member for applying heat according to the present invention, and its temperature distribution.

Referring to FIG. 7 or FIG. 8, the thermal conductivity of each layer of the rotary member for applying heat according to the present invention will be described below. FIG. 7 is an illustrative view of the thermal conductivity of each layer of the rotary member for applying heat and its relationships, and FIG. 8 is a view showing the thermal conductivity of each layer of the rotary member for applying heat and its temperature distribution.

According to FIG. 7, as described above, the heat-applying roller 17*a* as the rotary member for applying heat to fix the toner images on the transfer material is structured as a soft roller in which the cylindrical ray-transmitting base member 171*a* is provided, and the resilient layer 171*d*, the ray absorbing layer 171*b* and the parting layer 171*c* are provided in this order on the outside (outer peripheral surface) of the ray-transmitting base member 171*a*. Inside the ray-transmitting base member 171*a*, the halogen lamp 171*g* which is the ray radiating device for radiating ray having the ray filament F1 as the ray generating source to mainly radiate the ray such as the infrared ray or far infrared radiation, is provided.

In the structure of the rotary member for applying heat of the present invention, in the relationship between the ray-transmitting base member 171*a* and the resilient layer 171*d*, when the thermal conductivity of the ray-transmitting base member 171*a* is K1 (J/cm·s·K), the thermal conductivity of the resilient layer 171*d* is K2 (J/cm·s·K) and the thermal conductivity of the ray absorbing layer 171*b* is K3 (J/cm·s·K), it is preferable that the thermal conductivity K1 of the ray-transmitting base member 171*a* is, as compared to the thermal conductivity K2 of the resilient layer 171*d*, K1>K2. According to this, the temperature lowering is prevented by the ray-transmitting base member having the large thermal conductivity, and the uniformity of the heat in the lateral direction (in the direction perpendicular to the feeding direction of the transfer material) including the sheet passing section and the sheet non-passing section of the roll-like rotary member for applying heat is attained when the transfer material is continuously passing through at the time of fixing, and the resilient layer having the small thermal conductivity acts as the heat insulating layer, and the diffusion of the heat in the axial direction (in the radial direction from the central axis of the rotary member for applying heat) of the ray absorbing layer or the combined use layer of the rotary member for applying heat is prevented, and therefore, the temperature rising speed of the ray absorbing layer is quickened, thereby, the fixing device for quick start fixing in which instantaneous heating can be carried out, can be obtained. When K1≦K2, the heat in the lateral direction (in the direction perpendicular to the feeding direction of the transfer material) including the sheet passing section and the sheet non-passing section of the roll-like rotary member for applying heat becomes uneven when the transfer material is continuously passing through at the time of fixing, or the diffusion of the heat in the axial direction (in the radial direction from the central axis of the rotary member for applying heat) of the ray absorbing layer or the combined use layer of the rotary member for applying heat is not prevented, thereby, the temperature rising speed of the ray absorbing layer is slowed.

Further, it is preferable that K1=(3–15)×K2. When the ratio of the thermal conductivity K1 of the ray-transmitting base member 171*a* and the thermal conductivity K2 of the resilient layer 171*d* is in the relationship of not larger than 3 times, the uniformity of the heat in the lateral direction (in the direction perpendicular to the feeding direction of the transfer material) of the ray-transmitting base member 171*a* is hardly obtained, and when the thermal conductivity K2 of the resilient layer 171*d* is high, the heat generated in the ray absorbing layer 171*b* is not maintained and flown out to the ray-transmitting base member 171*a*, thereby, the temperature rising speed is slowed. On the one hand, when the ratio of the thermal conductivity K1 of the ray-transmitting base member 171*a* and the thermal conductivity K2 of the resilient layer 171*d* is in the relationship exceeding 15 times, the action of the resilient layer 171*d* as the heat insulating layer is too large, and although the temperature rising speed of the ray absorbing layer 171*b* is quickened, the uniformity of the temperature in the lateral direction (in the direction perpendicular to the feeding direction of the transfer material) is lost.

In the relationship between the resilient layer 171*d* and the ray absorbing layer 171*b* and, when the thermal conductivity of the ray-transmitting base member 171*a* is K1 (J/cm·s·K), the thermal conductivity of the resilient layer 171*d* is K2 (J/cm·s·K) and the thermal conductivity of the ray absorbing layer 171*b* is K3 (J/cm·s·K), it is preferable that the thermal conductivity K2 of the resilient layer 171*d* is, as compared to the thermal conductivity K3 of the ray absorbing layer 171*b*, K2≦K3. According to this, by the ray absorbing layer having the large thermal conductivity, the uniformity of the heat in the lateral direction (in the direction perpendicular to the feeding direction of the transfer material) including the sheet passing section and the sheet non-passing section of the roll-like rotary member for applying heat is attained when the transfer material is continuously passing through at the time of fixing, and the resilient layer having the small thermal conductivity acts as the heat insulating layer, and the diffusion of the heat in the axial direction (in the radial direction from the central axis of the rotary member for applying heat) of the ray absorbing layer of the rotary member for applying heat is prevented, and therefore, the temperature rising speed of the ray absorbing layer is quickened, thereby, the fixing device for quick start fixing in which instantaneous heating can be carried out, can be obtained. When K2>K3, the heat in the lateral direction (in the direction perpendicular to the feeding direction of the transfer material) including the sheet passing section and the sheet non-passing section of the roll-like rotary member for applying heat becomes uneven when the transfer material is continuously passing through at the time of fixing, or the diffusion of the heat in the axial direction (in the radial direction from the central axis of the rotary member for applying heat) of the ray absorbing layer or the combined use layer of the rotary member for applying heat is not prevented, thereby, the temperature rising speed of the ray absorbing layer is slowed.

Further, it is preferable that K3=(1–3)×K2. When the ratio of the thermal conductivity K3 of the ray absorbing layer 171*b* and the thermal conductivity K3 of the resilient layer 171*d* is in the relationship of not larger than 1 time, the uniformity of the heat in the lateral direction (in the direction perpendicular to the feeding direction of the transfer material) of the ray absorbing layer 171*b* is hardly obtained. Further, when the ratio of the thermal conductivity K3 of the ray absorbing layer 171*b* and the thermal conductivity K2 of the resilient layer 171*d* is in the relationship exceeding 5 times, there is an effect in which the uniformity of the heat in the lateral direction (in the direction perpendicular to the feeding direction of the transfer material) is obtained, however, although the temperature rising speed of the ray absorbing layer 171*b* is quickened, because the action of the resilient layer 171*d* as the heat insulating layer is too large, the function for the uniformization of the heat by the ray-transmitting base member 171*a* is lost.

In the relationships of each layer described above, further as the structure of rotary member for applying heat of the present invention, in more concrete, the following one is used.

When the thermal conductivity of the ray-transmitting base member 171*a* is K1 (J/cm·s·K), it is more preferable that the thermal conductivity K1 of the ray-transmitting base member 171*a* is not less than $10\times10^{-3}$ J/cm·s·K (K1$\geqq10\times10^{-3}$ J/cm·s·K). That is, as the cylindrical ray-transmitting base member 171*a,* ceramic materials whose thickness is 1 to 40 mm, preferably, 2 to 5 mm thick, and which transmit the ray of the infrared ray or far infrared radiation from the halogen lamp 171*g,* such as Pyrex glass, sapphire ($AL_2O_3$), CaF2, etc., (the thermal conductivity is $(5–20)\times10^{-3}$ J/cm·s·K, the specific heat is (0.5–2.0)×J/g·K, and the specific gravity is 1.5 to 3.0), or ray-transmitting resins using polyimide, polyamide, etc., (whose thermal conductivity is $(2–4)\times10^{-3}$ J/cm·s·K, the specific heat is (1–2)×J/g·K, and the specific gravity is 0.8 to 1.2), etc., are used.

Further, the thermal conductivity of the resilient layer 171*d* is K2 (J/cm·s·K), it is further preferable that the thermal conductivity K2 of the resilient layer 171*d* is not more than $5\times10^{-3}$ J/cm·s·K (K2$<5\times10^{-3}$ J/cm·s·K). That is, as the resilient layer 171*d,* for example, the silicon rubber whose thickness is 1 to 20 mm, preferably, 2 to 5 mm thick, is used, and the resilient layer 171*d* is formed of the ray-transmitting rubber layer (base layer) which transmits the ray (mainly, infrared ray or far infrared radiation). As the resilient layer 171*d,* for the high speed operation, a method by which the thermal conductivity is increased by mixing powders of metallic oxide such as silica, alumina, magnesium oxide, etc., in the base layer (silicon rubber) as the filler, is adopted, and a rubber layer whose thermal conductivity is $(1–3)\times10^{-3}$ J/cm·s·K, specific heat is (1–2)×J/g·K, and specific gravity is 0.9 to 1.0, is used.

Further, when the thermal conductivity of the ray absorbing layer 171*b* is K3 (J/cm·s·K), it is further preferable that the thermal conductivity K3 of the ray absorbing layer 171*b* is not more than $10\times10^{-3}$ J/cm·s·K (K3$<10\times10^{-3}$ J/cm·s·K ). That is, as the ray-absorbing layer 171*b,* in order to attain that the ray of 90 to 100%, preferably 95 to 100%, which is corresponding to almost 100% of the ray which is radiated from the halogen lamp 171*g* and transmits through the ray-transmitting base member 171*a* and ray-transmitting resilient layer 171*d,* is absorbed by the ray-absorbing layer 171*b,* and the instantaneous heating practicable rotary member for applying heat is formed, the ray absorbing member with the thickness of 10 to 500 μm, preferably, 20 to 100 μm thick, in which powders of carbon black, graphite, iron black ($Fe_3O_4$), or each kind of ferrite and its compound, copper oxide, cobalt oxide, red oxide ($Fe_2O_3$), etc., are mixed in the resin binder, (whose thermal conductivity is $(3–10)\times10^{-3}$ J/cm·s·K, which is slightly higher than that of the rubber layer of the resilient layer 171*d,* specific heat is (up to 2.0)×J/g·K, and specific gravity is (up to 0.9)), is used. As the ray-absorbing layer 171*b,* the material in which powders of carbon black, graphite, iron black ($Fe_3O_4$), or each kind of ferrite and its compound, copper oxide, cobalt oxide, red oxide ($Fe_2O_3$), etc., are mixed in the resilient silicon rubber or fluorine rubber, may be used.

Further, for example, PFA (fluorine resin) tube with the thickness of 30 to 100 μm is covered on the outside (outer peripheral surface) of the ray absorbing layer 171*b,* separating from the ray absorbing layer 171*b,* in order to make the parting property from the toner good, or the parting layer 171*c* (thermal conductivity is $(1–10)\times10^{-3}$ J/cm·s·K, specific heat is (up to 2.0)×J/g·K, and specific gravity is (up to 0.9)) on which fluorine resin (PFA or PTFE) paint is coated to 20 to 30 μm, is provided. As described above, the ray absorbing layer 171*b* and the parting layer 171*c* are integrated, and the combined use layer 171B whose thermal conductivity is almost the same as that of the ray absorbing layer, can also be used.

According to FIG. 8, as described above, the heat-applying roller 17*a* as the rotary member for applying heat to fix the toner images on the transfer material is structured as a soft roller in which the cylindrical ray-transmitting base member 171*a* is provided, and the resilient layer 171*d,* the ray absorbing layer 171*b* and the parting layer 171*c* are provided in this order on the outside (outer peripheral surface) of the ray-transmitting base member 171*a.* The ray from the halogen lamp 171*g* which is inside the ray-transmitting base member 171*a* and is the ray radiating device for radiating ray to mainly radiate the ray such as the infrared ray or far infrared radiation, is radiated onto the ray absorbing layer 171*b* through the ray-transmitting base member 171*a* and the resilient layer 171*d.*

In the structure of the rotary member for applying heat of the present invention, in the relationship of the ray-transmitting base member 171*a* or the ray absorbing layer 171*b* and the resilient layer 171*d,* when the thermal conductivity of the ray-transmitting base member 171*a* is K1 (J/cm·s·K), the thermal conductivity of the resilient layer 171*d* is K2 (J/cm·s·K) and the thermal conductivity of the ray absorbing layer 171*b* is K3 (J/cm·s·K), it is preferable that both of K1 and K3 are larger than K2, that is, K2<K1, K3.

The thermal conductivity K2 of the resilient layer 171*d* is made small and the heat insulating layer is formed, and on the other hand, each of thermal conductivity K1 and K2 of the ray-transmitting base member 171*a* or the ray absorbing layer 171*b* is made large, and the thermal conductivity is made good, and the uniformity of the heat in the lateral direction (in the direction perpendicular to the feeding direction of the transfer material) is intended. Further, the temperature distribution of the heat-applying roller 17*a* is as shown by the curve (a) in FIG. 8, because, in the initial stage of heating, the thermal conductivity of the ray-transmitting base member 171*a* or the resilient layer 171*d* is not ideally 100%, and the ray is absorbed by 5 to 50% in each layer and the heat is more largely generated on the ray generation side, and in the steady state, the distribution of each layer becomes almost constant as shown in the straight line (b) in FIG. 8. The heat insulating effect is provided to the resilient layer 171*d,* and the heating in the ray absorbing layer 171*b* is quickened. The temperature rising speed of the ray absorbing layer 171*b* is quickened by decreasing the thermal capacity. At the time of temperature rising, the heat generation is large inside the resilient layer 171*d* or the ray-transmitting base member 171*a,* however, in order to quicken temperature rising, the heat insulation is performed in the resilient layer 171*d.*

According to the above description, the resilient layer having the small thermal conductivity acts as the heat insulating layer, and the flow-out of the heat from the ray absorbing layer to the resilient layer is prevented, therefore, the temperature rising of the surface temperature of the ray absorbing layer can be quickened, thereby, the fixing device for quick start fixing in which instantaneous heating can be carried out, can be obtained. Further, by the ray absorbing layer or the ray-transmitting base member which have large thermal conductivity, the uniformity of the heat in the lateral direction (in the direction perpendicular to the feeding direction of the transfer material) of the rotary member for applying heat is obtained. When K2 is large in K2≧K1, K3, the heat flows out from the ray absorbing layer to the resilient layer, therefore, the quick temperature rising of the surface of the ray absorbing layer can not be conducted, or the heat in the lateral direction (in the direction perpendicular to the feeding direction of the transfer material) of the rotary member for applying heat becomes uneven.

Further, K1>K3 is preferable, and by the ray-transmitting base member 171*a* which has the large thermal capacity and large thermal conductivity, the uniformization of the heat in the lateral direction (in the direction perpendicular to the feeding direction of the transfer material) is stably conducted, and the quick temperature rise of the surface temperature of the ray absorbing layer can be conducted, thereby, the stable temperature can be maintained even when continuous printing is carried out.

In the relationships of the above-described each layer, further as the structure of the rotary member for applying heat of the present invention, more concretely, the following one is used.

When the thermal conductivity of the ray-transmitting base member 171*a* is K1 (J/cm·s·K), and the thermal conductivity of the ray absorbing layer 171*b* is K3 (J/cm·s·K), it is more preferable that each of thermal conductivity K1, K3 is not less than $2\times10^{-3}$ J/cm·s·K (K1, K3≧$2\times10^{-3}$ J/cm·s·K). That is, as the cylindrical ray-transmitting base member 171*a,* the thickness is 1 to 40 mm, preferably, 2 to 5 mm thick, and ceramic materials which transmit the ray of the infrared ray or far infrared radiation from the halogen lamp 171*g,* such as Pyrex glass, sapphire ($AL_2O_3$), CaF2, etc., (the thermal conductivity is $(5–20)\times10^{-3}$ J/cm·s·K, the specific heat is (0.5–2.0)×J/g·K, and the specific gravity is 1.5–3.0), or ray-transmitting resins using polyimide, polyamide, etc., (whose thermal conductivity is $(2–4)\times10^{-3}$ J/cm·s·K, the specific heat is (1–2)×J/g·K, and the specific gravity is 0.8–1.2), etc., are used. As the ray absorbing layer 171*b,* in order to attain that the ray of 90 to 100% , preferably 95 to 100%, which is corresponding to almost 100% of the ray which is radiated from the halogen lamp 171*g* and transmits through the ray-transmitting base member 171*a* and ray-transmitting resilient layer 171*d,* is absorbed by the ray-absorbing layer 171*b,* and the instantaneous heating practicable rotary member for applying heat is formed, the ray absorbing member with the thickness of 10 to 500 μm, preferably, 20 to 100 μm thick, in which powders of carbon black, graphite, iron black ($Fe_3O_4$), or each kind of ferrite and its compound, copper oxide, cobalt oxide, red oxide ($Fe_2O_3$), etc., are mixed in the resin binder, (whose thermal conductivity is $(3–10)\times10^{-3}$ J/cm·s·K, which is slightly higher than that of the rubber layer of the resilient layer 171*d,* specific heat is (up to 2.0)×J/g·K, and specific gravity is (up to 0.9)), is used. As the ray-absorbing layer 171*b,* the material in which powders of carbon black, graphite, iron black ($Fe_3O_4$), or each kind of ferrite and its compound, copper oxide, cobalt oxide, red oxide ($Fe_2O_3$), etc., are mixed in the resilient silicon rubber or fluorine rubber, may be used.

Further, the thermal conductivity of the resilient layer 171*d* is K2 (J/cm·s·K), it is further preferable that the thermal conductivity K2 of the resilient layer 171*d* is not more than $2\times10^{-3}$ J/cm·s·K (K2<$2\times10^{-3}$ J/cm·s·K). That is, as the resilient layer 171*d,* the silicon rubber whose thickness is 1 to 20 mm, preferably, 2 to 5 mm thick, is used, and the resilient layer 171*d* is formed of the ray-transmitting rubber layer (base layer) which transmits the ray (mainly, infrared ray or far infrared radiation). As the resilient layer 171*d,* for the high speed operation, a method by which the thermal conductivity is increased by mixing powders of metallic oxide such as silica, alumina, magnesium oxide, etc., in the base layer (silicon rubber) as the filler, is adopted, and a rubber layer whose thermal conductivity is $(1–3)\times10^{-3}$ J/cm·s·K, specific heat is (1–2)×J/g·K, and specific gravity is 0.9–1.0, is used.

Figure 9:
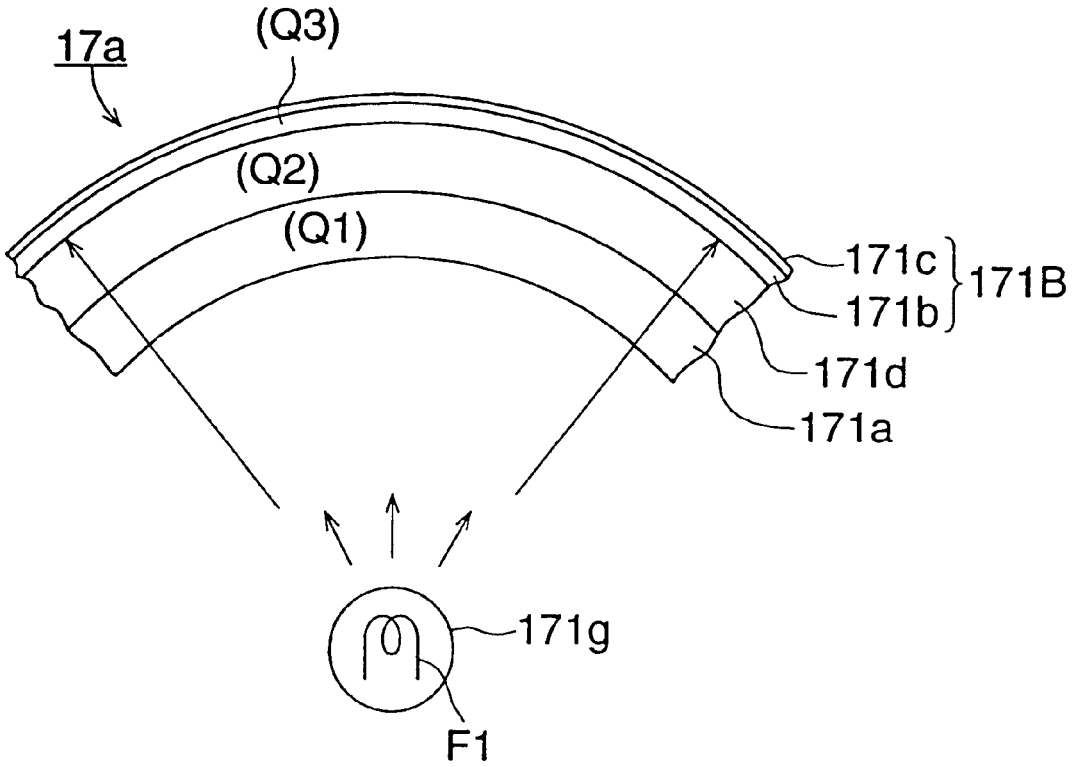
FIG. 9 is an illustrative view of the thermal capacity of each layer of the rotary member for applying heat according to the present invention, and its relationships.
Figure 10:
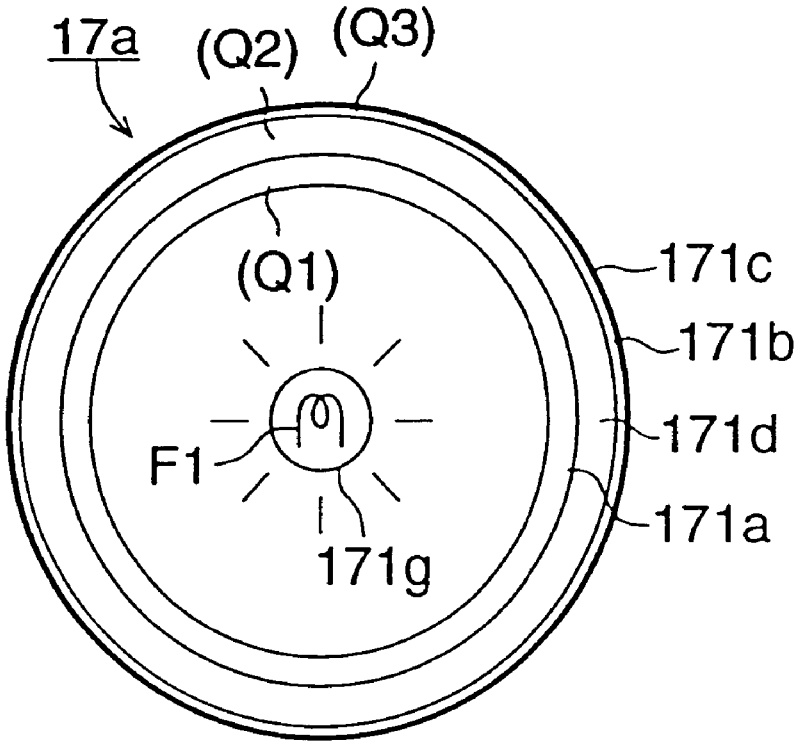
FIG. 10 is an illustrative view of the thermal capacity of each layer of the rotary member for applying heat according to the present invention, and its relationships.

Referring to FIG. 9 or FIG. 10, the thermal capacity of each layer of the rotary member for applying heat according to the present invention will be described below. FIG. 9 is an illustrative view of the thermal capacity of each layer of the rotary member for applying heat and its relationships, and FIG. 10 is an illustrative view showing the thermal capacity of each layer of the rotary member for applying heat and its relationships.

According to FIG. 9, as described above, the heat-applying roller 17*a* as the rotary member for applying heat to fix the toner images on the transfer material is structured as a soft roller in which the cylindrical ray-transmitting base member 171*a* is provided, and the resilient layer 171*d,* the ray absorbing layer 171*b* and the parting layer 171*c* are provided in this order on the outside (outer peripheral surface) of the ray-transmitting base member 171*a.* Inside the ray-transmitting base member 171*a,* the halogen lamp 171*g* which is the ray radiating device for radiating ray having the ray filament F1 as the ray generating source to mainly radiate the ray such as the infrared ray or far infrared radiation, is provided.

In the relationship between the ray-transmitting base member 171*a* and the resilient layer 171*d,* when the thermal capacity of the ray-transmitting base member 171*a* is Q1 (cal/deg), the thermal capacity of the resilient layer 171*d* is Q2 (cal/deg), and the thermal capacity of the ray absorbing layer 171*b* is Q3 (cal/deg), it is preferable that the thermal capacity Q1 of the ray-transmitting base member 171*a* is, as compared to the thermal capacity Q2 of the resilient layer 171*d,* (1/3)×Q2<Q1, and more preferably, Q2<Q1.

As the cylindrical ray-transmitting base member 171*a,* ceramic materials whose thickness is 1 to 40 mm, preferably, 2 to 5 mm thick, and which transmit the ray of the infrared ray or far infrared radiation from the halogen lamp 171*g,* such as Pyrex glass, sapphire ($AL_2O_3$), CaF2, etc., (the thermal conductivity is $(5–20)\times10^{-3}$ J/cm·s·K, the specific heat is (0.5–2.0)×J/g·K, and the specific gravity is 1.5–3.0), or ray-transmitting resins using polyimide, polyamide, etc., (whose thermal conductivity is $(2–4)\times10^{-3}$ J/cm·s·K, the specific heat is (1–2)×J/g·K, and the specific gravity is 0.8–1.2), etc., are used. For example, as the ray-transmitting base member 171*a* of the heat-applying roller 17*a,* when Pyrex glass whose inner diameter is 32 mm, outer diameter is 40 mm, and layer thickness (thickness) is 4 mm, (specific heat is 0.78 J/g·K, the specific gravity is 2.32), is used, a thermal capacity Q1 per width of size A-3 (297 mm) of the ray-transmitting base member 171*a,* is about 60 cal/deg.

Further, as the resilient layer 171*d,* for example, the silicon rubber whose thickness is 1 to 20 mm, preferably, 2 to 5 mm thick, is used, and the resilient layer 171*d* is formed of the ray-transmitting rubber layer(base layer) which transmits the ray (mainly, infrared ray or far infrared. radiation). As the resilient layer 171*d,* for the high speed operation, a method by which the thermal conductivity is increased by mixing powders of metallic oxide such as silica, alumina, magnesium oxide, etc., in the base rubber (silicon rubber) as the filler, is adopted, and a rubber layer whose thermal conductivity is $(1–3)\times10^{-3}$ J/cm·s·K, specific heat is (1–2)× J/g·K, and specific gravity is 0.9 to 1.0, is used. For example, as the resilient layer 171*d* of the heat-applying roller 17*a,* when silicon rubber whose outer diameter is 50 mm, and layer thickness (thickness) is 5 mm, (specific heat is 1.1 J/g·K, the specific gravity is 0.91), is used, a thermal capacity Q21 per width of size A-3 (297 mm) of the resilient layer 171*d,* is about 50 cal/deg.

As described above, when (⅓)×Q2<Q1, preferably, Q2<Q1, the ray-transmitting base member which has large thermal capacity, acts as a heat reservoir (heat pool), and by the accumulation of the heat, the temperature change as the rotary member for applying heat at the time of printing is prevented, thereby, the uniformization of the heat is obtained. On the other hand, the thermal capacity of the resilient layer is made small and easily warmed-up, and even when the temperature rising speed of the ray absorbing layer is quickened, the flow-out amount of the heat to the resilient layer is made to be decreased, thereby, the fixing device for quick start fixing which can be instantly heated, can be obtained.

Accordingly, when the thermal capacity Q1 of the ray-transmitting base member 171*a* is lower than ⅓ of the thermal capacity Q2 of the resilient layer 171*d* (Q1≦(Q2)/3), the ray-transmitting base member 171*a* does not act as the heat reservoir (heat pool), thereby, the temperature changes and the uniformity of the heat can not be obtained.

Further, it is preferable that Q1<5×Q2, and when the thermal capacity Q1 of the ray-transmitting base member 171*a* is larger than 5 times of the thermal capacity Q2 of the resilient layer 171*d* (Q1≧5×Q2), the large amount of heat flows out to the ray-transmitting base member 171*a,* thereby, the resilient layer 171*d* is hardly warmed up and the temperature rising speed of the ray absorbing layer becomes slow.

In the relationship between the resilient layer 171*d* and the ray absorbing layer 171*b,* when the thermal capacity of the ray-transmitting base member 171*a* is Q1 (cal/deg), the thermal capacity of the resilient layer 171*d* is Q2 (cal/deg), and the thermal capacity of the ray absorbing layer 171*b* is Q3 (cal/deg), it is preferable that the capacity Q2 of the resilient layer 171*d* is, as compared to the thermal capacity Q3 of the ray absorbing layer 171*b,* Q2>Q3.

As the resilient layer 171*d,* for example, the silicon rubber whose thickness is 1 to 20 mm, preferably, 2 to 5 mm thick, is used, and the resilient layer 171*d* is formed of the ray-transmitting rubber layer (base layer) which transmits the ray (mainly, infrared ray or far infrared radiation). As the resilient layer 171*d,* for the high speed operation, a method by which the thermal conductivity is increased by mixing powders of metallic oxide such as silica, alumina, magnesium oxide, etc., in the base rubber (silicon rubber) as the filler, is adopted, and a rubber layer whose thermal conductivity is $(1–3)\times10^{-3}$ J/cm·s·K, specific heat is (1–2)×J/g·K, and specific gravity is 0.9 to 1.0, is used. For example, as the resilient layer 171*d* of the heat-applying roller 17*a,* when silicon rubber whose outer diameter is 50 mm, and layer thickness (thickness) is 5 mm, (specific heat is 1.1 J/g·K, the specific gravity is 0.91), is used, a thermal capacity Q21 per width of size A-3 (297 mm) of the resilient layer 171*d,* is about 50 cal/deg.

As the ray-absorbing layer 171*b,* in order to attain that the ray of 90 to 100% , preferably 95 to 100%, which is corresponding to almost 100% of the ray which is radiated from the halogen lamp 171*g* and transmits through the ray-transmitting base member 171*a* and the resilient layer 171*d,* is absorbed by the ray-absorbing layer 171*b,* and the instantaneous heating practicable rotary member for applying heat is formed, for example, the ray absorbing member with the thickness of 10 to 500 μm, preferably, 20 to 100 μm thick, in which powders of carbon black, graphite, iron black ($Fe_3O_4$), or each kind of ferrite and its compound, copper oxide, cobalt oxide, red oxide ($Fe_2O_3$), etc., are mixed in the resin binder, (whose thermal conductivity is (3 to 10)$\times10^{-3}$ J/cm·s·K, which is slightly higher than that of the rubber layer of the resilient layer 171*d,* specific heat is (up to 2.0)×J/g·K, and specific gravity is (up to 0.9)), is used.

Further, for example, PFA (fluorine resin) tube with the thickness of 30 to 100 μm is covered on the outside (outer peripheral surface) of the ray absorbing layer 171*b,* separating from the ray absorbing layer 171*b,* in order to make the patting property from the toner good, or the parting layer 171*c* (thermal conductivity is $(1–10)\times10^{-3}$ J/cm·s·K, specific heat is (up to 2.0)×J/g·K, and specific gravity is (up to 0.9)) on which fluorine resin (PFA or PTFE) paint is coated to 20 to 30 μm, is provided. As the ray-absorbing layer 171*b,* the material in which powders of carbon black, graphite, iron black ($Fe_3O_4$), or each kind of ferrite and its compound, copper oxide, cobalt oxide, red oxide ($Fe_2O_3$), etc., are mixed in the resilient silicon rubber or fluorine rubber, may be used. The ray absorbing layer 171*b* and the parting layer 171*c* are integrated, and the combined use layer 171B whose thermal conductivity is almost the same as that of the ray absorbing layer 171*b,* can also be used. For example, as the ray absorbing layer 171*b* (or the combined use layer 171B) of the heat-applying roller 17*a,* when PFA (fluorine resin, specific heat is 2.0 J/g·K, the specific gravity is 0.9), whose layer thickness (thickness) is 50 μm, is used on the surface (outer peripheral surface) of the resilient layer 171*d* whose outer diameter is 50 mm, a thermal capacity Q31 per width of size A-3 (297 mm) of the ray absorbing layer 171*b* (or the combined use layer 171B), is about 1.0 cal/deg.

As described above, when Q2>Q3, the resilient layer which has large thermal capacity, acts as a heat reservoir (heat pool), and by the accumulation of the heat, the temperature change is prevented, thereby, the uniformization of the heat is obtained, and by the ray absorbing layer which has the small thermal capacity, the temperature rising speed of the ray absorbing layer is quickened, thereby, the fixing device for quick start fixing which can be instantly heated, can be obtained.

Accordingly, when the thermal capacity Q2 of the resilient layer 171*d* is lower than the thermal capacity Q3 of the ray absorbing layer 171*b* (Q2≦Q3), the ray-transmitting base member 171*a* does not act as the heat reservoir (heat pool), thereby, the temperature changes and the uniformity of the heat can not be obtained.

Further, when Q2=(20–1000)×Q3, the resilient layer 171*d* assuredly acts as a heat reservoir (heat pool), and by the accumulation of the heat, the temperature change is prevented, thereby, the uniformization of the heat is obtained, and by the ray absorbing layer 171*b* which has the smaller thermal capacity, the temperature rising speed of the ray absorbing layer 171*b* is quickened.

According to FIG. 10, as described above, the heat-applying roller 17*a* as the rotary member for applying heat to fix the toner images on the transfer material is structured as a soft roller, in which the cylindrical ray-transmitting base member 171*a* is provided, and on the outside (outer peripheral surface) of the ray-transmitting base member 171*a,* the resilient layer 171*d,* the ray absorbing layer 171*b* and the parting layer 171*c* are provided in this order. Inside the ray-transmitting base member 171*a,* the halogen lamp 171*g,* which is the ray radiating device for radiating ray having the ray filament F1 as the ray generating source to mainly radiate the ray such as the infrared ray or far infrared radiation, is provided.

In the relationship among the ray-transmitting base member 171*a,* the resilient layer 171*d* and the ray absorbing layer 171*b,* when the thermal capacity of the ray-transmitting base member 171*a* is Q1 (cal/deg), the thermal capacity of the resilient layer 171*d* is Q2 (cal/deg), and the thermal capacity of the ray absorbing layer 171*b* is Q3 (cal/deg), it is preferable that Q3<Q1+Q2.

As the cylindrical ray-transmitting base member 171*a,* ceramic materials whose thickness is 1–40 mm, preferably, 2 to 5 mm thick, and which transmit the ray of the infrared ray or far infrared radiation from the halogen lamp 171*g,* such as Pyrex glass, sapphire ($AL_2O_3$), CaF2, etc., (the thermal conductivity is $(5–20)\times10^{-3}$ J/cm·s·K, the specific heat is (0.5–2.0)×J/g·K, and the specific gravity is 1.5–3.0), or ray-transmitting resins using polyimide, polyamide, etc., (whose thermal conductivity is $(2–4)\times10^{-3}$ J/cm·s·K, the specific heat is (1–2)×J/g·K, and the specific gravity is 0.8–1.2), etc., are used. For example, as the ray-transmitting base member 171*a* of the heat-applying roller 17*a,* when Pyrex glass whose inner diameter is 32 mm, outer diameter is 40 mm, and layer thickness (thickness) is 4 mm, (specific heat is 0.78 J/g·K, the specific gravity is 2.32), is used, a thermal capacity Q11 per width of size A-3 (297 mm) of the ray-transmitting base member 171*a,* is about 60 cal/deg.

Further, as the resilient layer 171*d,* for example, the silicon rubber whose thickness is 1 to 20 mm, preferably, 2 to 5 mm thick, is used, and the resilient layer 171*d* is formed of the ray-transmitting rubber layer (base layer) which transmits the ray (mainly, infrared ray or far infrared radiation) As the resilient layer 171*d,* for the high speed operation, a method by which the thermal conductivity is increased by mixing powders of metallic oxide such as silica, alumina, magnesium oxide, etc., in the base rubber (silicon rubber) as the filler, is adopted, and a rubber layer whose thermal conductivity is $(1–3)\times10^{-3}$ J/cm·s·K, specific heat is (1–2)×J/g·K, and specific gravity is 0.9 to 1.0, is used. For example, as the resilient layer 171*d* of the heat-applying roller 17*a,* when silicon rubber whose outer diameter is 50 mm, and layer thickness (thickness) is 5 mm, (specific heat is 1.1 J/g·K, the specific gravity is 0.91), is used, a thermal capacity Q21 per width of size A-3 (297 mm) of the resilient layer 171*d,* is about 50 cal/deg.

Further, as the ray-absorbing layer 171*b,* in order to attain that the ray of 90 to 100%, preferably 95 to 100%, which is corresponding to almost 100% of the ray which is radiated from the halogen lamp 171*g* and transmits through the ray-transmitting base member 171*a* and the resilient layer 171*d,* is absorbed by the ray-absorbing layer 171*b,* and the instantaneous heating practicable rotary member for applying heat is formed, for example, the ray absorbing member with the thickness of 10 to 500 μm, preferably, 20 to 100 μm thick, in which powders of carbon black, graphite, iron black ($Fe_3O_4$), or each kind of ferrite and its compounds, copper oxide, cobalt oxide, red oxide ($Fe_2O_3$), etc., are mixed in the resin binder, (whose thermal conductivity is $(3–10)\times10^{-3}$ J/cm·s·K, which is slightly higher than that of the rubber layer of the resilient layer 171*d,* specific heat is (up to 2.0)×J/g·K, and specific gravity is (up to 0.9)), is used. As the ray-absorbing layer 171*b,* the material in which powders of carbon black, graphite, iron black ($Fe_3O_4$), or each kind of ferrite and its compounds, copper oxide, cobalt oxide, red oxide ($Fe_2O_3$), etc., are mixed in the resilient silicon rubber or fluorine rubber, may be used.

Further, for example, PFA (fluorine resin) tube with the thickness of 30 to 100 μm is covered on the outside (outer peripheral surface) of the ray absorbing layer 171*b,* separating from the ray absorbing layer 171*b,* in order to make the parting property from the toner good, or the parting layer 171*c* (thermal conductivity is $(1–10)\times10^{-3}$ J/cm·s·K, specific heat is (up to 2.0)×J/g·K, and specific gravity is (up to 0.9)) on which fluorine resin (PFA or PTFE) paint is coated to 20 to 30 μm, is provided. The ray absorbing layer 171*b* and the parting layer 171*c* are integrated, and the combined use layer 171B whose thermal conductivity is almost the same as that of the ray absorbing layer 171*b,* can also be used. For example, as the ray absorbing layer 171*b* (or the combined use layer 171B) of the heat-applying roller 17*a,* when PFA (fluorine resin, specific heat is 2.0 J/g·K, the specific gravity is 0.9), whose layer thickness (thickness) is 50 μm, is used on the surface (outer peripheral surface) of the resilient layer 171*d* whose outer diameter is 50 mm, a thermal capacity Q31 per width of size A-3 (297 mm) of the ray absorbing layer 171*b* (or the combined use layer 171B), is about 1.0 cal/deg.

Accordingly, as described above, when Q3<Q1+Q2, by the ray absorbing layer having the small thermal capacity, the temperature rising of the surface temperature of the ray absorbing layer can be quickened, thereby, the fixing device for quick start fixing in which instantaneous heating can be carried out, can be obtained. Further, by the ray-transmitting base member or the resilient layer which have large thermal capacity, the prevention of the temperature variation and uniformity of the heat of the rotary member for applying heat are attained. When Q3≧Q1+Q2, the quick temperature rising of the surface of the ray absorbing layer can not be conducted, or the heat becomes uneven by the temperature variation of the rotary member for applying heat.

Further, it is preferable that the ratio of the thermal capacity Q3 of the ray absorbing layer 171*b* and the thermal capacity (Q1+Q2) of the ray-transmitting base member 171*a* and resilient layer 171*d,* (Q3/(Q1+Q2)), is 0.005 to 0.20. When the thermal capacity Q3 of the ray absorbing layer 171*b* is 0.5 to 20% of the sum (Q1+Q2) of the thermal capacity of the ray-transmitting base member 171*a* and resilient layer 171*d,* and is small, by the ray absorbing layer whose thermal capacity is smaller, the quick temperature rise of the surface temperature of the ray absorbing layer can be attained. When the thermal capacity Q3 of the ray absorbing layer 171*b* is not more than 0.5% of the sum (Q1+Q2) of the thermal capacity of the ray-transmitting base member 171*a* and resilient layer 171*d,* the thermal capacity Q3 of the ray absorbing layer 171*b* is too small, the uniform temperature distribution in the lateral direction (the direction perpendicular to the feeding direction of the transfer material) is not obtained, and when the thermal capacity Q3 of the ray absorbing layer 171*b* exceeds 20% of the sum (Q1+Q2) of the thermal capacity of the ray-transmitting base member 171*a* and resilient layer 171*d,* the thermal capacity Q3 of the ray absorbing layer 171*b* is too large, and the temperature rising speed of the ray absorbing layer 171*b* becomes extremely slowed.

Further, when the thermal capacity of the ray-transmitting base member 171*a* per width of size A-3 (297 mm) is Q11, and the thermal capacity of the resilient layer 171*d* per width of size A-3 (297 mm) is Q21, and when the sum (Q11+Q21) of each thermal capacity is Q11+Q21≧30–300 cal/deg., and the thermal capacity of the ray absorbing layer 171*b* per width of size A-3 (297 mm) is Q31, it is preferable that the thermal capacity Q31 is Q31<0.1–30 cal/deg. When Q11+Q21≧30–300 cal/deg., by the large thermal capacity per width of size A-3 (297 mm) of the ray-transmitting base member 171*a* and the resilient layer 171*d,* the prevention of the temperature variation or the uniformity of the heat of the rotary member for applying heat is further attained, and when Q31<0.1–30 cal/deg., by the smaller thermal capacity per width of size A-3 (297 mm) of the ray absorbing layer 171*b,* the more quick temperature rise of the surface temperature of the ray absorbing layer 171*b* can be attained.

According to the present invention, the temperature lowering is prevented by the ray-transmitting base member having the large thermal conductivity, and the uniformity of the heat in the lateral direction including the sheet passing section and the sheet non-passing section of the roll-like rotary member for applying heat is attained when the transfer material is continuously passing through at the time of fixing, and the resilient layer having the small thermal conductivity acts as the heat insulating layer, and the diffusion of the heat in the axial direction of the ray absorbing layer of the rotary member for applying heat is prevented, thereby, the fixing device for quick start fixing in which instantaneous heating can be carried out, can be obtained.

According to the present invention, by the ray-transmitting base member having the large thermal conductivity, the uniformity of the heat in the lateral direction including the sheet passing section and the sheet non-passing section of the roll-like rotary member for applying heat is attained when the transfer material is continuously passing through at the time of fixing, and the resilient layer having the small thermal conductivity acts as the heat insulating layer, and the diffusion of the heat in the axial direction of the ray absorbing layer of the rotary member for applying heat is prevented, thereby, the fixing device for quick start fixing in which instantaneous heating can be carried out, can be obtained.

According to the present invention, the resilient layer having the small thermal conductivity acts as the heat insulating layer, and the flow-out of the heat from the ray absorbing layer to the resilient layer is prevented, and therefore, the temperature rising speed of the surface temperature of the ray absorbing layer can be quickened, thereby, the fixing device for quick start fixing in which instantaneous heating can be carried out, can be obtained. Further, by the ray absorbing layer or ray-transmitting base member having the large thermal conductivity, the uniformity of the heat in the lateral direction of the rotary member for applying heat is obtained.

According to the present invention, the ray-transmitting base member which has large thermal capacity, acts as a heat reservoir (heat pool), and by the accumulation of the heat, the uniformization of the heat is obtained, and the thermal capacity of the resilient layer is made small and more easily warmed-up than the ray-transmitting base member, and the temperature rising speed of the ray absorbing layer is quickened, thereby, the fixing device for quick start fixing which can be instantly heated, can be obtained.

According to the present invention, when the thermal capacity of the resilient lay er is made larger than that of the ray absorbing layer, the resilient layer acts as a heat reservoir (heat pool), and by the accumulation of the heat, the temperature change is prevented and the uniformization of the heat is attained, and by the absorbing layer having the small thermal capacity, the temperature rising speed of the ray absorbing layer is quickened, thereby, the fixing device for quick start fixing which can be instantly heated, can be obtained.

According to the present invention, when the thermal capacity of the ray absorbing layer is made smaller than that of the resilient layer, the temperature rising speed of the surface temperature of the ray absorbing layer can be quickened, thereby, the fixing device for quick start fixing which can be instantly heated, can be obtained. Further, by the ray-transmitting base member and resilient layer having the large thermal capacity, the temperature change of the rotary member for applying heat is prevented and the uniformization of the heat thereof is attained.

Figure 11:
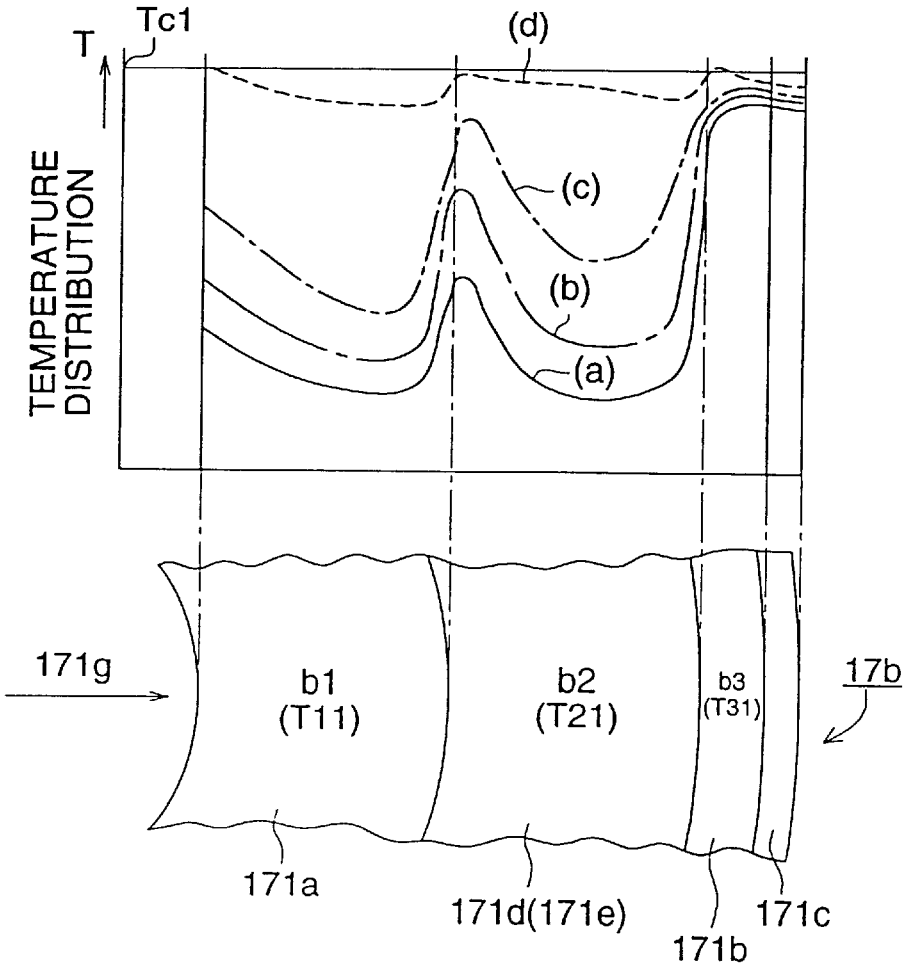
FIG. 11 is a view showing the ray energy absorption rate and the temperature distribution of each layer of the first example of the roll-shaped rotary member for applying heat.
Figure 12:
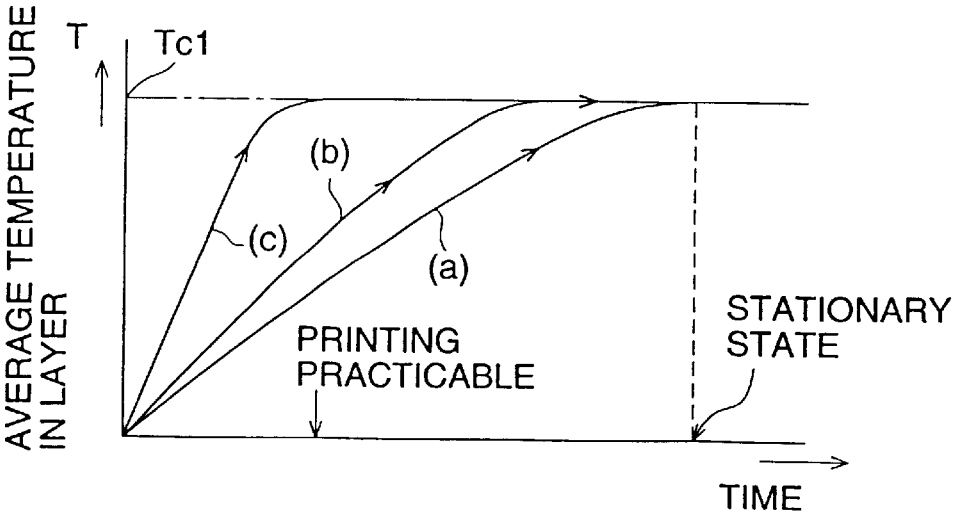
FIG. 12 is a view showing the temperature-rise curve of each layer of the first example of the roll-shaped rotary member for applying heat.

FIG. 11 is a view showing the ray energy absorption rate and the temperature distribution of each layer of the first example of the roll-shaped rotary member for applying heat. FIG. 12 is a view showing the temperature rise curve of each layer of the first example of the roll-shaped rotary member for applying heat.

In FIG. 11, the ray energy absorption rate and the temperature distribution of each layer of the heat-applying roller 17*a* which is the roll-shaped rotary member for applying heat of the fixing device are shown, and in FIG. 12, the temperature rise curve of each layer is shown. As described in FIG. 4, the thermal capacity of the ray-transmitting base member 171*a* and the ray-transmitting resilient layer 171*d* (or the ray-transmitting heat insulating layer 171*e*) is made large, and the heat reserving property (heat reservoir) is provided to the ray-transmitting base member 171*a* and the ray-transmitting resilient layer 171*d* (or the ray-transmitting heat insulating layer 171*e*), and the supply of the heat to the ray absorbing layer 171*b* of the surface and the diffusion of the heat from the ray absorbing layer 171*b* to the inside are suppressed, thereby, the stabilization of the temperature of the ray absorbing layer 171*b* is intended. Further, the thermal conductivity of the ray-transmitting resilient layer 171*d* (or the ray-transmitting heat insulating layer 171*e*) is made smaller than that of the ray-transmitting base member 171*a,* and is made to a layer having the heat insulation property, and each of the thermal conductivity of the ray-transmitting base member 171*a* or the ray absorbing layer is made large, and the thermal conductive property is increased, and it is desirable that the uniformization of the heat in the lateral direction (the direction perpendicular to the feeding direction of the transfer material) is intended. The heat insulation property is provided to the ray-transmitting resilient layer 171*d* (or the ray-transmitting heat insulating layer 171*e*), and heating of the ray absorbing layer 171*b* is quickened. The temperature rising speed of the ray absorbing layer 171*b* is quickened by decreasing the thermal capacity. At the time of temperature rise, the heat generation is much inside the ray absorbing layer 171*b,* the ray-transmitting resilient layer 171*d* (or the ray-transmitting heat insulating layer 171*e*) and the ray-transmitting base member 171*a,* however, in order to quicken the temperature rise of the ray absorbing layer 171*b,* the ray-transmitting resilient layer 171*d* (or the ray-transmitting heat insulating layer 171*e*) is heat-insulated. Like this, as the heat-applying roller 17*a* which is the rotary member for applying heat of the present invention, as described above, instead of the ray-transmitting resilient layer 171*d* having the heat insulating property, the ray-transmitting heat insulating layer 171*e* having the effect of only heat insulating property can be used as the non-resilient layer such as ray-transmitting resins. Because the thermal capacity of the ray-transmitting base member 171*a* and the ray-transmitting resilient layer 171*d* (or the ray-transmitting heat insulating layer 171*e*) of the inner side is made large, the distribution of the absorption rate of the ray energy is made large in the ray-transmitting base member 171*a* and the ray-transmitting resilient layer 171*d* (or the ray-transmitting heat insulating layer 171*e*) of the inner side, and the heat generation is made also in the inner side (inside). That is, when the absorption rate of the ray energy of the ray-transmitting base member 171*a* is b1 (%), the absorption rate of the ray energy of the ray-transmitting resilient layer 171*d* (or the ray-transmitting heat insulating layer 171*e*) is b2 (%), and the absorption rate of the ray energy of the ray absorbing layer 171*b* is b3 (%), it is preferable that (b1+b2)>b3, thereby, the inside temperature rises up, and the heat does not flow out from the ray absorbing layer 171*b* of the surface to the inside, therefore, it is prevented that the temperature of the ray absorbing layer 171*b* is lowered soon. Further, the ratio of the absorption rate b3 (%) of the ray energy of the ray absorbing layer 171*b,* and the sum (b1+b2+b3) of the absorption rate b1 (%) of the ray energy of the ray-transmitting base member 171*a,* the absorption rate b2 (%) of the ray energy of the ray-transmitting resilient layer 171*d* (or the ray-transmitting heat insulating layer 171*e*), and the absorption rate b3 (%) of the ray energy of the ray absorbing layer 171*b,* b3/(b1+b2+b3), is more preferably b3/(b1+b2+b3)=10–40%. When the ratio b3/(b1+b2+b3) is not larger than 10%, the heat generation in the ray absorbing layer 171*b* of the surface hardly occurs, and when the ratio b3/(b1+b2+b3) exceeds 40%, the absorption of the ray energy in the inside is too small, the inside temperature does not rise up, and the heat flows out from the ray absorbing layer 171*b* of the surface to the inside, therefore, the temperature of the ray absorbing layer 171*b* is lowered soon.

The distribution of the absorption rate of the ray energy is much in the ray-transmitting base member 171*a* of the inside, however, because the thermal capacity of the ray-transmitting base member 171*a* is large, the temperature rise is set such that the ray absorbing layer 171*b* of the outside is higher in the average value. Accordingly, in the temperature distribution of the heat-applying roller 17*a,* in the initial stage of heating, because the heat generation on the side of the ray absorbing layer 171*b* is larger than that of the ray-transmitting base member 171*a* of the inside or the ray-transmitting resilient layer 171*d* (or the ray-transmitting heat insulating layer 171*e*), the temperature distribution in the initial stage of heating is as shown by the curve (a) in FIG. 11, and the temperature of the ray absorbing layer 171*b* of the surface can rise sooner, however, the inside of the rotary member for applying heat is cool and the temperature is low. Further, the temperature distribution in the middle stage and the rear stage is as shown by the curves (b) and (c) in FIG. 11, and the temperature of the ray absorbing layer 171*b* of the surface is raised to the proper temperature for fixing Tc1, however, the temperature of the inside of the rotary member for applying heat is low yet. In the steady state, as shown by the curve (d) in FIG. 11, the temperature of each layer is almost constant and is the proper temperature for fixing Tc1. In the middle stage and the rear stage, the temperature of the ray absorbing layer 171*b* reaches the proper temperature for fixing Tc1 and the print can be carried out. The heat insulating effect is provided to the ray-transmitting base member 171*a,* and the heating of the ray absorbing layer 171*b* is quickened. As described above, the temperature rising speed of the ray absorbing layer 171*b* is quickened by decreasing the thermal capacity. At the time of the temperature rise, the heat generation is larger in the inside of the layers of the ray absorbing layer 171*b* or the ray-transmitting base member 171*a,* however, in order to quicken the temperature rise of the ray absorbing layer 171*b,* the ray-transmitting base member 171*a* is heat-insulated.

According to the above description, by the heat accumulation of the ray-transmitting base member in which the rate of the absorption of the ray energy is large, and the ray-transmitting resilient layer or the ray-transmitting heat insulating layer, the temperature change of the rotary member for applying heat is prevented, and the uniformity of the heat is obtained, and the fixing device in which the stability of the temperature of the ray absorbing layer is intended, and which can conduct quick start (quick heating), can be obtained.

Further, the ray absorbing layer 171*b* of the surface is quickly heated by the ray transmission property of the ray-transmitting base member 171*a* and the ray-transmitting resilient layer 171*d* (or the ray-transmitting heat insulating layer 171*e*), and the ray-transmitting base member 171*a* and the ray-transmitting resilient layer 171*d* (or the ray-transmitting heat insulating layer 171*e*) of the inside, are given the absorptivity to the ray energy, and accumulate the heat.

In order to quickly heat the ray absorbing layer 171*b,* when the minimum temperature in the layer of the ray-transmitting base member 171*a* at the time of temperature rise is T11, the minimum temperature in the layer of the ray-transmitting resilient layer 171*d* (or the ray-transmitting heat insulating layer 171*e*) is T21, and the minimum temperature in the layer of the ray absorbing layer 171*b* is T31, it is preferable to set such that T3>T1, T21. Further, it is more preferable that T21≧T11, thereby, the temperature of the ray-transmitting resilient layer 171*d* (or the ray-transmitting heat insulating layer 171*e*) is raised more than that of the ray-transmitting base member 171*a,* and the heat does not flow out from the ray absorbing layer 171*b* to the ray-transmitting resilient layer 171*d* (or the ray-transmitting heat insulating layer 171*e*), and it is prevented that the temperature of the ray absorbing layer 171*b* is lowered soon. In this case, the temperature rising curve of each layer is such that the temperature (the minimum temperature in the layer) rise of the ray-transmitting base member 171*a* is as shown by the curve (a) in FIG. 12, the temperature (the minimum temperature in the layer) rise of the ray-transmitting resilient layer 171*d* (or the ray-transmitting heat insulating layer 171*e*) is as shown by the curve (b) in FIG. 12, and the temperature (the minimum temperature in the layer) rise of the ray absorbing layer 171*b* is as shown by the curve (c) in FIG. 12, and the temperature is respectively raised as shown by the curves. When the temperature of the ray absorbing layer 171*b* of the surface reaches the proper temperature for fixing Tc1, (in the middle and the rear stages shown by the curves (b) and (c) in FIG. 11), the print can be conducted. In the steady state, the minimum temperature in the layer T11 of the ray-transmitting base member 171*a* and the minimum temperature in the layer T21 of the ray-transmitting resilient layer 171*d* (or the ray-transmitting heat insulating layer 171*e*) also reach the proper temperature for fixing Tc1, and become equal level to the minimum temperature in the layer T31 of the ray absorbing layer 171*b,* and sometimes, in the before and after of the steady state, the minimum temperature in the layer T11 of the ray-transmitting base member 171*a* crosses the minimum temperature in the layer T31 of the ray absorbing layer 171*b*. Further, the temperature control is carried out by using the surface temperature of the ray absorbing layer 171*b* as the reference, and after the steady state, with respect to the minimum temperature in the layer T31 of the ray absorbing layer 171*b,* sometimes, the minimum temperature in the layer T21 of the ray-transmitting resilient layer 171*d* (or the ray-transmitting heat insulating layer 171*e*) or the minimum temperature in the layer T1 of the ray-transmitting base member 171*a* is lower or higher. Further, the temperature of the inner wall of the ray-transmitting base member 171*a* in the steady state is sometimes higher than the minimum temperature in the layer T31 of the ray absorbing layer 171*b.* The temperature rising characteristic can be adjusted by the absorption rate of the ray energy, the layer thickness, the specific heat, etc., of each layer.

As described above, by the heat accumulation of the ray-transmitting base member and the ray-transmitting resilient layer or the ray-transmitting heat insulating layer, the temperature change of the rotary member for applying heat is prevented, and the uniformity of the heat is attained, and the fixing device in which the quick start (quick heating) can be conducted, and the temperature of the ray absorbing layer can be stabled, can be obtained.

Figure 13:
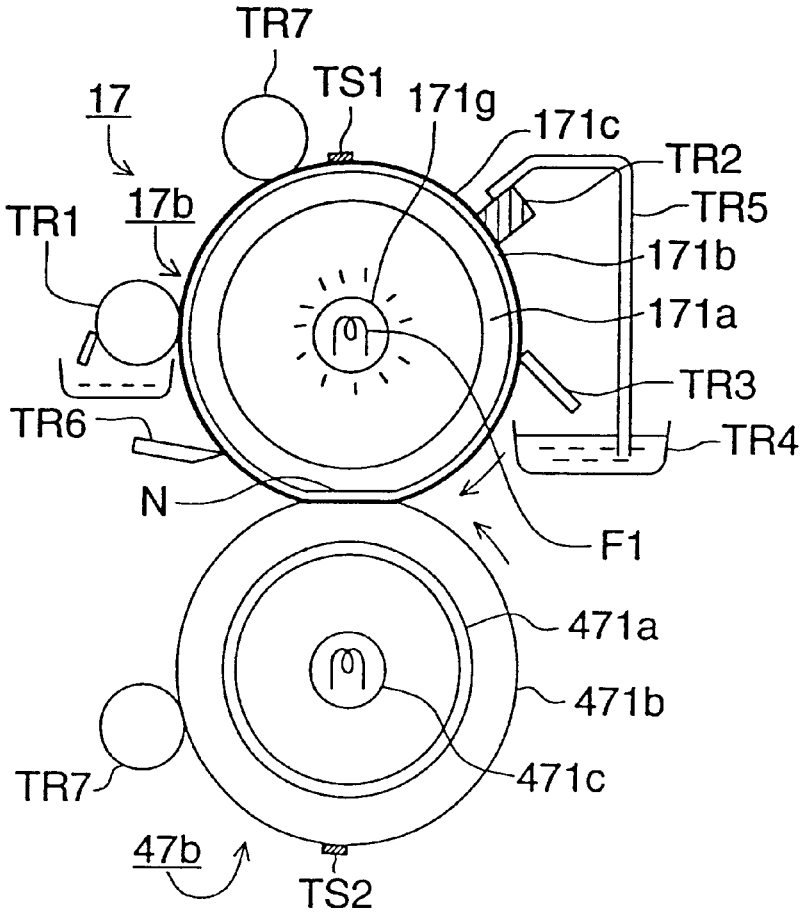
FIG. 13 is an illustrative view showing the structure of the second example of the fixing device.
Figure 14:
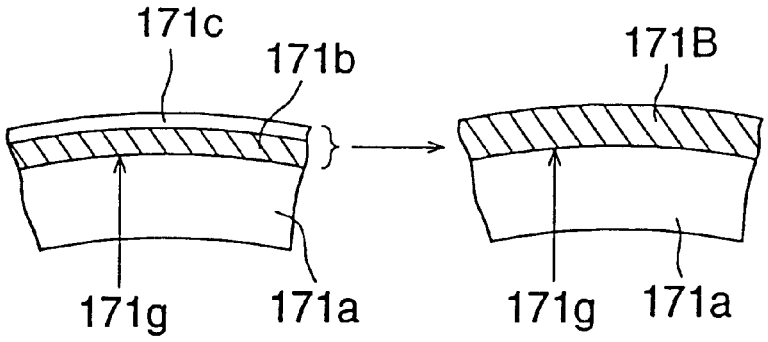
FIGS. 14(*a*) and 14(*b*) are enlarged sectional structural views of the second example of the roll-shaped rotary member for applying heat.
Figure 15:
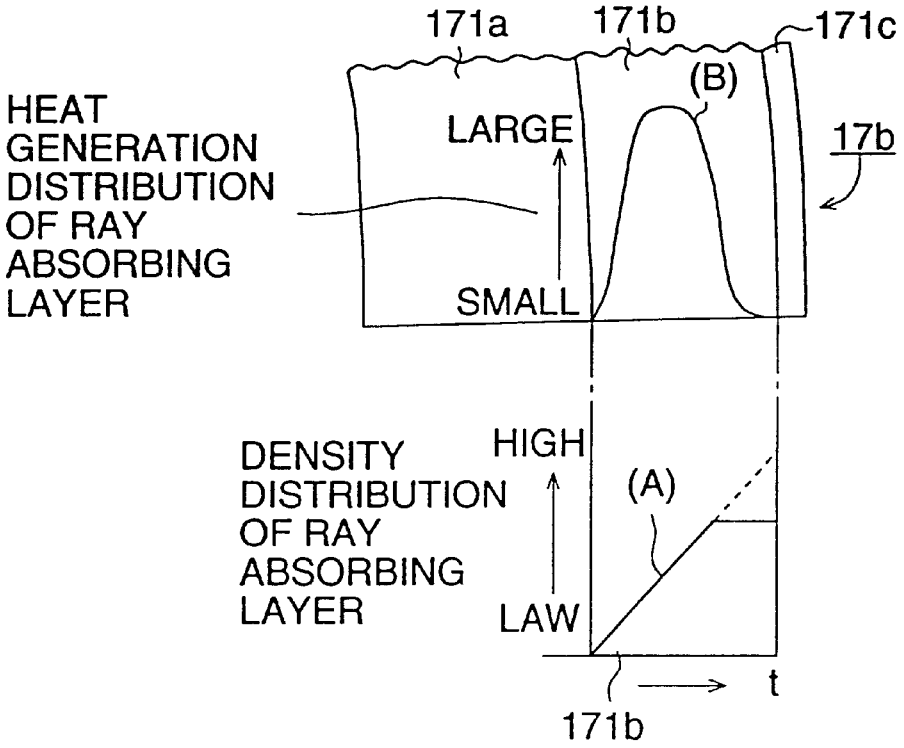
FIG. 15 is a view showing the density distribution of the ray absorbing layer of the second example of the roll-shaped rotary member for applying heat.
Figure 16:
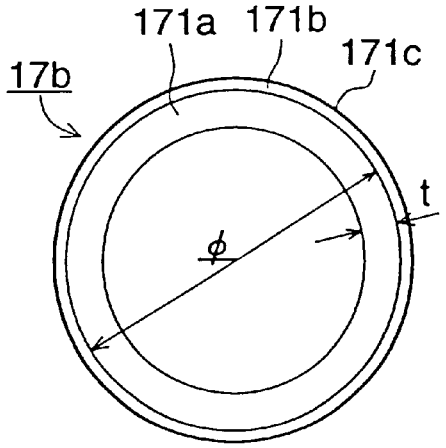
FIG. 16 is a view showing the outer diameter and thickness of the ray-transmitting base member of the second example of the roll-shaped rotary member for applying heat.
Figure 17:
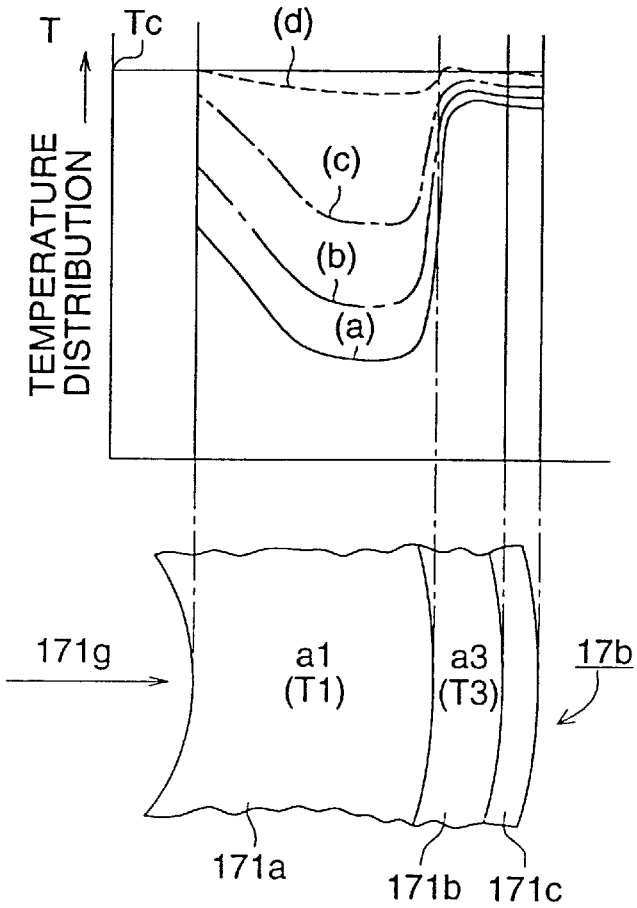
FIG. 17 is a view showing the ray energy absorption rate and the temperature distribution of each layer of the second example of the roll-shaped rotary member for applying heat.
Figure 18:
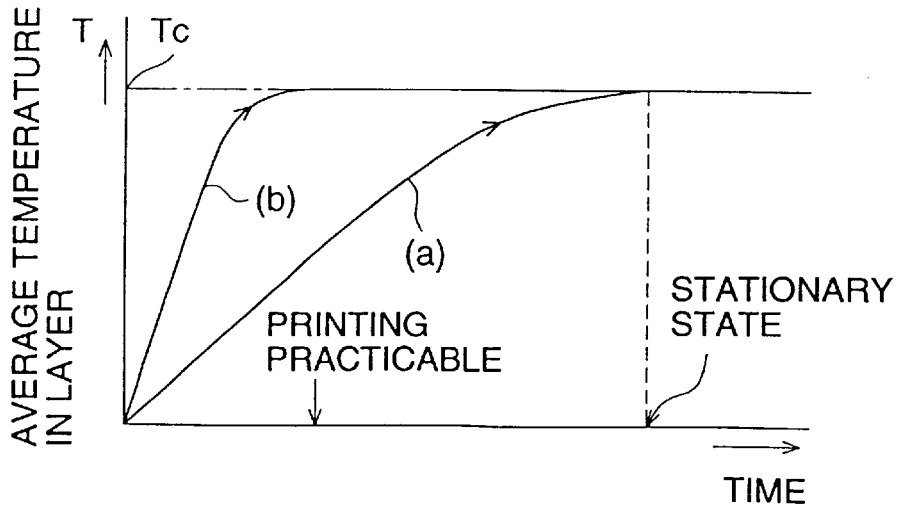
FIG. 18 is a view showing the temperature-rise curve of each layer of the second example of the roll-shaped rotary member for applying heat.

FIG. 13 is an illustrative view showing the structure of the second example of the fixing device, and FIGS. 14(*a*) and 14(*b*) are enlarged sectional structural views of the second example of the roll-shaped rotary member for applying heat. FIG. 15 is a view showing the density distribution of the ray absorbing layer of the second example of the roll-shaped rotary member for applying heat, and FIG. 16 is a view showing the outer diameter and the thickness of the ray-transmitting base member of the second example of the roll-shaped rotary member for applying heat. FIG. 17 is a view showing the absorption rate of the ray energy and the temperature distribution of each layer of the second example of the roll-shaped rotary member for applying heat, and FIG. 18 is a view showing the temperature rising curve of each layer of the second example of the roll-shaped rotary member for applying heat.

As shown in FIG. 13, the fixing device 17 of the second example is structured by a heat-applying roller 17*b* as the upper side roll-shaped rotary member for applying heat to fix the toner image on the transfer material, and a resilient fixing roller 47*a* as the lower side roll-shaped rotary member for fixing, and the recording sheet P is held in the nip portion N with the width of about 5–20 mm, formed between the heat-applying roller 17*b* and the resilient fixing roller 47*b,* and the toner image on the recording sheet P is fixed by applying the heat and pressure.

On the heat-applying roller 17*b* as the roll-shaped rotary member for applying heat provided upper side, in the rotational direction of the heat-applying roller 17*b* from the position of the nip portion N, a fixing separation claw TR6, a fixing oil cleaning roller TR1, a heat uniformizing roller TR7, an oil coating felt TR2, and an oil amount regulating blade TR3 are provided, and the oil supplied from the oil tank TR4 to the oil coating felt TR2 through a capillary pipe TR5, is coated onto the heat-applying roller 17*b* by the oil coating felt TR2. The oil on the peripheral surface on the heat-applying roller 17*b* is cleaned by the fixing oil cleaning blade TR1. Accordingly, the heat uniformizing roller TR7, and a temperature sensor TS1 which is a temperature detecting means to measure the temperature of the heat-applying roller 17*b,* and which will be described later, are provided on the cleaned peripheral surface of the heat-applying roller 17*b* between the fixing oil cleaning roller TR1 and the oil coating felt TR2. The transfer material after fixing is separated by the fixing separation claw TR6. By the heat uniformizing roller TR7 using the metallic roller member having good thermal conductivity such as aluminum material, stainless material, etc. or the heat pipe, the heat generation temperature distribution of the peripheral surface of the heat-applying roller 17*b* heated by the ray absorbing layer 171*b* is uniformized. By the heat uniformizing roller TR7, the longitudinal direction and lateral direction temperature unevenness of the heat-applying roller 17*b* accompanied by the papering of the transfer material is uniformized.

The heat-applying roller 17*b* as the rotary member for applying heat to fix the toner images on the transfer material is structured as a hard roller in which a cylindrical ray-transmitting base member 171*a* is provided, and on the outside (outer peripheral surface) of the ray-transmitting base member 171*a,* ray absorbing layer 171*b* and parting layer 171*c* are provided in this order. Inside the heat-applying roller 17*b,* a halogen lamp 171*g* as the ray radiating device for radiating ray having a ray filament F1 as the ray generating source mainly radiating the ray such as the infra-red ray or far infra-red radiation, is provided. The ray radiated from the halogen lamp 171*g* is absorbed by the ray absorbing layer 171*b,* and the quick heating practicable roll-shaped rotary member for applying heat is formed (the second example of the roll-shaped rotary member for applying heat for the quick heating).

Further, the fixing roller 47*b* as the lower side roll-shaped rotary member for fixing is structured as a soft roller which is formed of, for example, a cylindrical metallic pipe 471*a* using the aluminum material, and a rubber roller 471*b* formed of a 2 to 20 mm thick rubber layer using, for example, a silicon material on the outer peripheral surface of the metallic pipe 471*a.* As the lower side roll-shaped rotary member for fixing, a high heat insulating resilient rubber roller is used, and the diffusion of the heat from the upper side rotary member for applying heat to the lower side rotary member for fixing is prevented, and a wide nip width are assured. Further, a heat uniformizing roller TR7 using the metallic roller member having good thermal conductivity such as the aluminum material or stainless material, which comes into contact with the surface of the rubber roller 471*b* and is rotated, is provided, and by the heat uniformizing roller TR7, the heat generation temperature distribution of the peripheral surface of the fixing roller 47*b* is uniformized. As the heat uniformizing roller TR7, it is preferable that a heat pipe which has a heat accumulation and dissipation function, is used. Further, the halogen lamp 472*c* as the heat generating source may be provided inside the metallic pipe 472*a.*

A nip portion N whose lower side is convex, is formed between the upper side hard roller and the lower side soft roller and toner image is fixed.

TS1 is a temperature sensor which is a temperature detecting means using, for example, a contact type thermistor to conduct the temperature control, attached to the heat-applying roller 17*b,* and TS2 is a temperature sensor using, for example, a contact type thermistor to conduct the temperature control, attached to the fixing roller 47*b.* As the temperature sensors TS1 and TS2, the non-contact type sensor may also be used other than the contact type sensor.

According to FIGS. 14(*a*) and 14(*b*), the structure of the heat-applying roller 17*a* is as follows, as shown in the sectional view in FIG. 4(*a*), as the cylindrical ray-transmitting base member 171*a,* the thickness is 1 to 40 mm, preferably, 2 to 5 mm thick, and ceramic materials which absorb the ray of the infrared ray or far infrared radiation from the halogen lamp 171*g* at the ray energy absorption rate, which will be described later, and transmit the remained ray, such as Pyrex glass, sapphire ($AL_2O_3$), CaF2, etc., (the thermal conductivity is $(5–20)\times10^{-3}$ J/cm·s·K, the specific heat is (0.5–2.0)×J/g·K, and the specific gravity is 1.5–3.0), or ray-transmitting resins using polyimide, polyamide, etc., (whose thermal conductivity is $(2–4)\times10^{-3}$ J/cm·s·K, the specific heat is (1–2)×J/g·K, and the specific gravity is 0.8–1.2), etc., are used. For example, as the ray-transmitting base member 171*a* of the heat-applying roller 17*b,* a thermal capacity Q1 per width of size A-3 (297 mm) of the ray-transmitting base member 171*a* when Pyrex glass whose inner diameter is 32 mm, outer diameter is 40 mm and the layer thickness (thickness) is 4 mm, (specific heat is 0.78 J/g·K, the specific gravity is 2.32), is used, is about 60 cal/deg. Further, because the wavelength of the ray which transmits the ray-transmitting base member 171*a* is 0.1 to 20 μm, preferably, 0.3 to 3 μm, conditioners for hardness or thermal conductivity are added as fillers, however, the ray-transmitting base member 171*a* may also be formed of the material in which fine particles of the following metallic oxide are dissipated in the resin binder, wherein fine particles of metallic oxide are those of the ray transmitting (mainly infrared ray or far infrared radiation transmittable) ITO, titanium oxide, aluminum oxide, zinc oxide, silicon oxide, magnesium oxide, calcium carbonate, etc., whose particle size is not more than ½ of the wavelength of the ray, preferably, not more than ⅕, and whose average particle diameter including the primary and the secondary particles is not more than 1 μm, preferably, not more than 0.1 μm. In the layer, the fact that the average particle diameter including the primary and the secondary particles is not more than 1 μm, preferably, not more than 0.1 μm, is preferable to prevent the light from scattering so that the light reaches the ray absorbing layer 171*b.* As described above, the thermal conductivity of the ray-transmitting base member 171*a* is not so good.

As ray-absorbing layer 171*b,* in the remained portion of the ray, which is radiated by the ray filament F1 of the halogen lamp 171*g* and absorbed in the ray-transmitting base member 171*a* as will be described later, in order to attain that the ray of 90 to 100%, preferably 95 to 100%, which is corresponding to almost 100% of the ray which transmits through the ray-transmitting base member 171*a,* is absorbed by the ray-absorbing layer 171*b,* and the instantaneous heating practicable rotary member for applying heat is formed, the ray absorbing member in which powders of carbon black, graphite, iron black ($Fe_3O_4$), or each kind of ferrite and its compounds, copper oxide, cobalt oxide, red oxide ($Fe_2O_3$), etc., are mixed in the resin binder, is used, and 10 to 200 μm thick, preferably 20 to 100 μm thick ray absorbing member is formed on the outside (on the outer peripheral surface) of the ray-transmitting base member 171*a* by spraying or coating. The thermal conductivity of the ray absorbing layer 171*b* can be set to $(3–10)\times10^{-3}$ J/cm·s·K (specific heat is (up to 2.0)×J/g·K, specific gravity is (up to 0.9)) by the addition of absorbent such as carbon black, or the like. As the ray absorbing layer 171*b,* the metallic roller member such as nickel electroforming roller, or the like, may be provided with the same thickness. In this case, in order to absorb the ray, it is preferable that the inside (inner peripheral surface) is black oxide-processed. In the remained portion of the ray, which is absorbed in the ray-transmitting base member 171*a,* when the ray absorption rate in the ray absorbing layer 171*b* of and the ray which transmits through the ray-transmitting base member 171*a,* is lower than about 90%, and for example, when about 20 to 80%, the ray breaks through the layer, and by the ray which breaks through the layer, in the case where the heat-applying roller 17*b* as the rotary member for applying heat is used for the monochromatic image formation, when the black toner is adhered on the surface of the specific position of the heat-applying roller 17*b* by filming, or the like, the heat generation occurs from the adhered portion by the ray which breaks through the layer, and the heat generation by the ray absorption further occurs at that portion, and thereby, the ray absorbing layer 171*b* is broken. Further, when it is used for the color image formation, generally, the absorption rate of the color toner is low, and because there is a difference of absorption rate between color toners, the fixing failure or fixing unevenness occurs. Accordingly, in the remained portion of the ray, which is radiated by the ray filament F1 of the halogen lamp 171*g* and absorbed in the ray-transmitting base member 171*a,* the ray absorption rate of the ray absorbing layer 171*b* is made 90 to 100%, preferably 95 to 100%, which is corresponding to almost 100% of the ray, so that the ray which transmits through the ray-transmitting base member 171*a,* is perfectly absorbed in the ray absorbing layer 171*b.* Further, when the thickness of the ray absorbing layer 171*b* is not more than 10 μm and thin, the heating speed by the absorption of the ray in the ray absorbing layer 171*b* is high, however, it becomes a cause of breakage or a short of strength of the ray absorbing layer 171*b* by the local heating due to thin film, and when the thickness of the ray absorbing layer 171*b* exceeds 500 μm and too thick, the thermal conductivity becomes poor, or the thermal capacity becomes large and quick heating can hardly be conducted. When the ray absorption rate of the ray absorbing layer 171*b* is made 90 to 100% , preferably 95 to 100%, which is corresponding to almost 100% of the ray, or when the thickness of the ray absorbing layer 171*b* is made 10 to 500 μm, preferably 20 to 100 μm, the local heat generation in the ray absorbing layer 171*b* is prevented, and heat generation can be uniformly conducted. Further, because the wavelength of the ray radiated onto the ray absorbing layer 171*b* is 0.1 to 20 μm, preferably 0.3 to 3 μm, the conditioner for the hardness or thermal conductivity is added as filler, however, the ray absorbing layer 171*b* may be formed of the material in which fine particles of the following metallic oxide are dissipated in the resin binder by 5 to 50 wt %, wherein fine particles of metallic oxide are those of the ray transmitting (mainly infrared ray or far infrared radiation transmittable) titanium oxide, aluminum oxide, zinc oxide, silicon oxide, magnesium oxide, calcium carbonate, etc., whose particle size is not more than ½ of the wavelength of the ray, preferably, not more than ⅕, and whose average particle diameter including the primary and the secondary particles is not more than 1 μm, preferably, not more than 0.1 μm. As described above, because the thermal capacity of the ray absorbing layer 171*b* is made small so that the temperature rises soon, the problem that the temperature lowering occurs in the heat-applying roller 17*b* as the rotary member for applying heat, and uneven fixing is generated, is prevented. As the ray absorbing layer 171*b,* the material in which powders of carbon black, graphite, iron black ($Fe_3O_4$), or each kind of ferrite and its compounds, copper oxide, cobalt oxide, red oxide ($Fe_2O_3$), etc., are mixed in the resilient silicon rubber or fluorine rubber, may also be used. For example, as the ray absorbing layer 171*b* (or a combined use layer 171B, which will be described later) of the heat-applying roller 17*b,* a thermal capacity Q3 per width of size A-3 (297 mm) of the ray absorbing layer 171*b* (or the combined use layer 171B) when fluorine resin whose layer thickness (thickness) is 50 μm, (specific heat is 2.0 J/g·K, the specific gravity is 0.9), is used on the surface (outer peripheral surface) of the ray-transmitting base member 171*a* having the outer diameter of 50 mm, is about 1.0 cal/deg. As the ray absorbing layer 171*b,* the metallic film member such as nickel electroforming belt, may also be used. In this case, in order to absorb the ray, it is preferable that the inside (inner peripheral surface) is black oxide-processed.

Further, PFA (fluorine resin) tube with the thickness of 30 to 100 μm is covered on the outside (outer peripheral surface) of the ray absorbing layer 171*b,* separating from the ray absorbing layer 171*b,* in order to make the parting property from the toner good, or the parting layer 171*c* on which fluorine resin (PFA or PTFE) paint is coated to 20 to 30 μm, is provided (separation type).

Further, as shown in the sectional view in FIG. 14(*b*), the ray absorbing member, in which powders of carbon black, graphite, iron black ($Fe_3O_4$), or each kind of ferrite and its compound, copper oxide, cobalt oxide, red oxide ($Fe_2O_3$), etc., are mixed, and the roll-shaped rotary member for applying heat is formed in such a manner that fluorine resin (PFA or PTFE) paint which is combinedly used as the binder and parting agent, is mixed and blended, and in FIG. 14(*a*), the ray absorbing layer 171*b* and the parting layer 171*c* are integrated, and a combined use layer 171B having the parting property is formed outside (outer peripheral surface) of the ray-transmitting base member 171*a*. The thermal conductivity of the combined use layer 171B is almost the same as the thermal conductivity of the ray absorbing layer 171*b* and $(3–10)\times10^{-3}$ J/cm·s·K (specific heat is (up to 2.0)×J/g·K, specific gravity is (up to 0.9)). In the same manner as described above, in the remained portion of the ray, which is radiated by the ray filament F1 of the halogen lamp 171*g* and absorbed in the ray-transmitting base member 171*a,* the ray absorption rate of the combined use layer 171B is made 90 to 100%, preferably 95 to 100%, which is corresponding to almost 100% of the ray, so that the ray which transmits through the ray-transmitting base member 171*a* is perfectly absorbed. When the ray absorption rate in the combined use layer 171B is lower than about 90%, and for example, when about 20 to 80%, the ray breaks through the layer, and by the ray which breaks through the layer, in the case where the rotary member for applying heat is used for the monochromatic image formation, when the black toner is adhered on the surface of the specific position of the rotary member for applying heat by filming, or the like, the heat generation occurs from the adhered portion by the ray which breaks through the layer, and furthermore, the heat generation by the ray absorption further occurs at that portion, and thereby, the combined use layer 171B is broken. Further, when it is used for the color image formation, generally, the absorption efficiency of the color toner is low, and because there is a difference of absorption efficiency between color toners, the fixing failure or fixing unevenness occurs. Accordingly, in the remained portion of the ray, which is radiated by the ray filament F1 of the halogen lamp 171*g* and absorbed in the ray-transmitting base member 171*a,* the ray absorption rate of the combined use layer 171B is made 90 to 100%, preferably 95 to 100%, which is corresponding to almost 100% of the ray, so that the ray which transmits through the ray-transmitting base member 171*a* is perfectly absorbed in the rotary member for applying heat. Further, the local heat generation in the combined use layer 171B is also prevented, and heat generation can be uniformly conducted. Further, because the wavelength of the ray radiated onto the combined use layer 171B is 0.1 to 20 μm, preferably 0.3 to 3 μm, the conditioner for the hardness or thermal conductivity is added as filler, however, the combined use layer 171B may be formed of the material in which fine particles of the following metallic oxide are dissipated in the resin binder by 5 to 50 wt %, wherein fine particles of metallic oxide are those of the ray transmitting (mainly infrared ray or far infrared radiation transmittable) titanium oxide, aluminum oxide, zinc oxide, silicon oxide, magnesium oxide, calcium carbonate, etc., whose particle size is not more than ½ of the wavelength of the ray, preferably, not more than ⅕, and whose average particle diameter including the primary and the secondary particles is not more than 1 μm, preferably, not more than 0.1 μm.

According to FIG. 15, when the density distribution of the ray absorbing member is uniformly provided on the ray absorbing layer 171*b* of the heat-applying roller 17*b* as the roll-shaped rotary member for applying heat, heat generation concentrates on the ray absorbing layer 171*b* which is in the boundary, and the heat easily flows out to the ray-transmitting base member 171*a* side, therefore, it is preferable from the viewpoint of the dispersion of the distribution of the heat generation that the low thermal conductive member is used rather than ray-transmitting base member 171*a,* or that the density distribution is provided and the heat is generated inside the ray absorbing layer 171*b*. The density distribution of the ray absorbing layer 171*b* is as shown in the graph (A), the interface of the inscribing ray-transmitting resilient layer 171*d* side is in the low density, and the distribution is sloped so that it is successively heightened toward the outer peripheral surface, and the density is made such that the ray of 100% is absorbed just before the outer peripheral surface side (at the position of about ⅔–⅘ from the ray-transmitting base member 171*a* side to the thickness t of the ray absorbing layer 171*b*), and is saturated. According to this, the distribution of the heat generation by the ray absorption in the ray absorbing layer 171*b* is, as shown in the graph (B), formed into the parabolic-shape, which has the maximum value in the vicinity of the central portion of the ray absorbing layer 171*b* and the minimum values on the interface of the ray absorbing layer 171*b* or in the vicinity of the outer peripheral surface. Or it is preferable that the ray-transmitting heat resistive resin (polyimide, fluorine containing resin, or silicon resin) with 10 to 500 μm thickness, preferably 20 to 100 μm is provided on the interface of the ray absorbing layer 171*b* or outer peripheral surface. Further, it is preferable that the low thermal conductive member is used rather than the ray-transmitting base member 171*a* and the flow out of the heat is suppressed. According to this, the heat generation due to the ray absorption on the interface is made small, and the breakage of the adhered resilient layer on the interface or the breakage of the ray absorbing layer 171*b* is prevented. The density distribution from just before the outer peripheral surface side (at the position of about ⅔–⅘ from the ray-transmitting base member 171*a* side to the thickness t of the ray absorbing layer 171*b*), to the outer peripheral surface is made saturated,land for example, when the combined use layer 171B is used, it is made to give no influence even if the outer peripheral surface layer is rubbed out. Incidentally, as shown by a dotted line, the saturation layer may also be formed. In summary, when the absorption is fully conducted inside, there is no influence of the density outside. The influence of rubbing out is not generated also. Further, the slope is provided in the density distribution, and by changing the angle of the slope, the distribution of the heat generation can be adjusted.

Further, as shown in FIG. 16, as the outer diameter ϕ of the cylindrical ray-transmitting base member 171*a* of the heat-applying roller 17*b* as the roll-shaped rotary member for applying heat, a 15 to 60 mm member is used, and as the thickness t, the thick member is better for its strength, and the thin member is better for its thermal capacity, but, from the relationship between the strength and thermal capacity, the relationship of the outer diameter ϕ and the thickness t of the cylindrical ray-transmitting base member is $$0.05 \leqq t/\phi \leqq 0.20,$$

and preferably, $$0.07 \leqq t/\phi \leqq 0.14.$$

When the outer diameter ϕ of the ray-transmitting base member 171*a* is 40 mm, the thickness t of the ray-transmitting base member 171*a* is 2 mm≦t≦8 mm, and preferably, 2.8 mm≦t≦5.6 mm is used. When t/ϕ of the ray-transmitting base member 171*a* is not larger than 0.05, the strength is insufficient, and when t/ϕ exceeds 0.20, the thermal capacity is too large, the heating of the heat-applying roller 17*b* takes a long period of time. Further, in the ray-transmitting base member, there is a case in which the ray of about 1 to 20% is absorbed depending on the material, and the thinner one is preferable within the range in which the strength can be maintained.

According to the above description, when the fixing device 17 described in FIG. 13 is used, the fixing device which is strong for the deformation in the fixing portion (nip portion) and can conduct quick start (quick heating), can be obtained and further, an energy saving effect can be obtained.

In FIG. 17, the absorption rate of the ray energy of each layer of the heat-applying roller 17*b* which is the rotary member for applying heat of the fixing device 17, and temperature distribution are shown, and in FIG. 18, the temperature rise curve of each layer is shown. As described in FIGS. 14(*a*) and 14(*b*), the thermal capacity of the ray-transmitting base member 171*a* is made large, and the heat accumulation property .(heat reservoir) is provided to the ray-transmitting base member 171*a,* and the supply of the heat to the ray absorbing layer 171*b* of the surface and diffusion of the heat from the ray absorbing layer 171*b* to the inside are suppressed, and the stabilization of the temperature of the ray absorbing layer 171*b* is attained. Because the thermal capacity of the ray-transmitting base member 171*a* of the inside is made large, distribution of the absorption rate of the ray energy is large in the ray-transmitting base member 171*a* of the inside, and the heat is generated even in the inner side (inside).

That is, when the absorption rate of the ray energy of the ray-transmitting base member 171*a* is a1 (%), and the absorption rate of the ray energy of the ray absorbing layer 171*b* is a3 (%), it is preferable that a1>a3, thereby, the inside temperature rises up, and the heat does not flow out from the ray absorbing layer 171*b* of the surface to the inside, therefore, it is prevented that the temperature of the ray absorbing layer 171*b* is lowered soon. Further, the ratio of the absorption rate a3 (%) of the ray energy of the ray absorbing layer 171*b,* and the sum (a1+a3) of the absorption rate a1 (%) of the ray energy of the ray-transmitting base member 171*a* and the absorption rate a3 (%) of the ray energy of the ray absorbing layer 171*b,* a3/(a1+a3), is more preferably a3/(a1+a3) 10 to 40%. When the ratio a3/(a1+a3) is not larger than 10%, the heat generation in the ray absorbing layer 171*b* of the surface hardly occurs, and when the ratio a3/(a1+a3) exceeds 40%, the absorption of the ray energy in the inside is too small, the inside temperature does not rise up, and the heat flows out from the ray absorbing layer 171*b* of the surface to the inside, therefore, the temperature of the ray absorbing layer 171*b* is lowered soon.

The distribution of the absorption rate of the ray energy is much in the ray-transmitting base member 171*a* of the inside, however, because the thermal capacity of the ray-transmitting base member 171*a* is large, the temperature rise is set such that the ray absorbing layer 171*b* of the outside is higher in the average value. Accordingly, in the temperature distribution of the heat-applying roller 17*b,* in the initial stage of heating, because the heat generation is larger on the side of the ray generation side, the temperature distribution in the initial stage of heating is as shown by the curve (a) in FIG. 17, and the temperature of the ray absorbing layer 171*b* of the surface can rise sooner, however, the inside of the rotary member for applying heat is cool and the temperature is low. Further, the temperature distribution in the middle stage and the rear stage is as shown by the curves (b) and (c) in FIG. 17, and the temperature of the ray absorbing layer 171*b* of the surface is raised to almost the proper temperature for fixing Tc, however, the temperature of the inside of the rotary member for applying heat is low yet. In the steady state, as shown by the curve (d) in FIG. 17, the temperature of each layer is almost constant and is the proper temperature for fixing Tc. In the middle stage and the rear stage, the temperature of the ray absorbing layer 171*b* reaches the proper temperature for fixing Tc and the print can be carried out. The heat insulating effect is provided to the ray-transmitting base member 171*a,* and the heating of the ray absorbing layer 171*b* is quickened. The temperature rising speed of the ray absorbing layer 171*b* is quickened by decreasing the thermal capacity. At the time of the temperature rise, the heat generation is larger in the inside of the layers of the ray absorbing layer 171*b* or the ray-transmitting base member 171*a,* however, in order to quicken the temperature rise of the ray absorbing layer 171*b,* the ray-transmitting base member 171*a* is heat-insulated.

According to the above description, by the heat accumulation of the ray-transmitting base member in which the rate of the absorption of the ray energy is large, the temperature change of the rotary member for applying heat is prevented, and the uniformity of the heat is obtained, and the fixing device in which the stability of the temperature of the ray absorbing layer is intended, and which can conduct quick start (quick heating), can be obtained.

Further, the ray absorbing layer 171*b* of the surface is quickly heated by the ray transmission property of the ray-transmitting base member 171*a,* and the ray-transmitting base member 171*a* of the inside is given the absorptivity to the ray energy, and accumulate the heat.

In order to quickly heat the ray absorbing layer 171*b,* when the minimum temperature in the layer of the ray-transmitting base member 171*a* at the time of temperature rise is T1, and the minimum temperature in the layer of the ray absorbing layer 171*b* is T3, it is preferable to set such that T3>T1. In this case, the temperature rising curve of each layer is. such that the temperature (the minimum temperature in the layer) rise of the ray-transmitting base member 171*a* is as shown by the curve (a) in FIG. 18, and the temperature (the minimum temperature in the layer) rise of the ray absorbing layer 171*b* is as shown by the curve (b) in FIG. 18, and the temperature is respectively raised as shown by the curves. When the temperature of the ray absorbing layer 171*b* of the surface reaches the proper temperature for fixing Tc, (in the middle and the rear stages shown by the curves (b) and (c) in FIG. 17), the print can be conducted. In the steady state, the minimum temperature in the layer T1 of the ray-transmitting base member 171*a* also reaches the proper temperature for fixing Tc, and becomes equal level to the minimum temperature in the layer T3 of the ray absorbing layer 171*b,* and sometimes, in the before and after the steady state, the minimum temperature in the layer T1 of the ray-transmitting base member 171*a* crosses the minimum temperature in the layer T3 of the ray absorbing layer 171*b*. Further, the temperature control is carried out by using the surface temperature of the ray absorbing layer 171*b* as the reference, and after the steady state, with respect to the minimum temperature in the layer T3 of the ray absorbing layer 171*b*, sometimes, the minimum temperature in the layer T1 of the ray-transmitting base member 171*a* is lower or higher. Further, the temperature of the inner wall of the ray-transmitting base member 171*a* in the steady state is sometimes higher than the minimum temperature in the layer T3 of the ray absorbing layer 171*b*. The temperature rising characteristic can be adjusted by the absorption rate of the ray energy, the layer thickness, the specific heat, etc., of each layer.

As described above, by the heat accumulation of the ray-transmitting base member, the temperature change of the rotary member for applying heat is prevented, and the uniformity of the heat is attained, and the fixing device in which the quick start (quick heating) can be conducted, and the temperature of the ray absorbing layer can be stabled, can be obtained.

According to the present invention, by the heat accumulation of the ray-transmitting base member in which the rate of the absorption of the ray energy is large, the temperature change of the rotary member for applying heat is prevented, and the uniformity of the heat is obtained, and the fixing device in which the stability of the temperature of the ray absorbing layer is intended, and which can conduct quick start (quick heating), can be obtained.

According to the present invention, by the heat accumulation of the ray-transmitting base member, the ray-transmitting resilient layer or the ray-transmitting insulation layer, in which the rate of the absorption of the ray energy is large, the temperature change of the rotary member for applying heat is pre vented, and the uniformity of the heat is obtained, and the fixing device in which the stability of the temperature of the ray absorbing layer is intended, and which can conduct quick start (quick heating), can be obtained.

According to the present invention, by the heat accumulation of the ray-transmitting base member, the temperature change of the rotary member for applying heat is prevented, and the uniformity of the heat is obtained, and the fixing device in which the stability of the temperature of the ray absorbing layer is intended, and which can conduct quick start (quick heating), can be obtained.

According to the present invention, by the heat accumulation of the ray-transmitting base member, the ray-transmitting resilient layer or the ray-transmitting insulation layer, the temperature change of the rotary member for applying heat is prevented, and the uniformity of the heat is obtained, and the fixing device in which the stability of the temperature of the ray absorbing layer is intended, and which can conduct quick start (quick heating), can be obtained.

Figure 19:
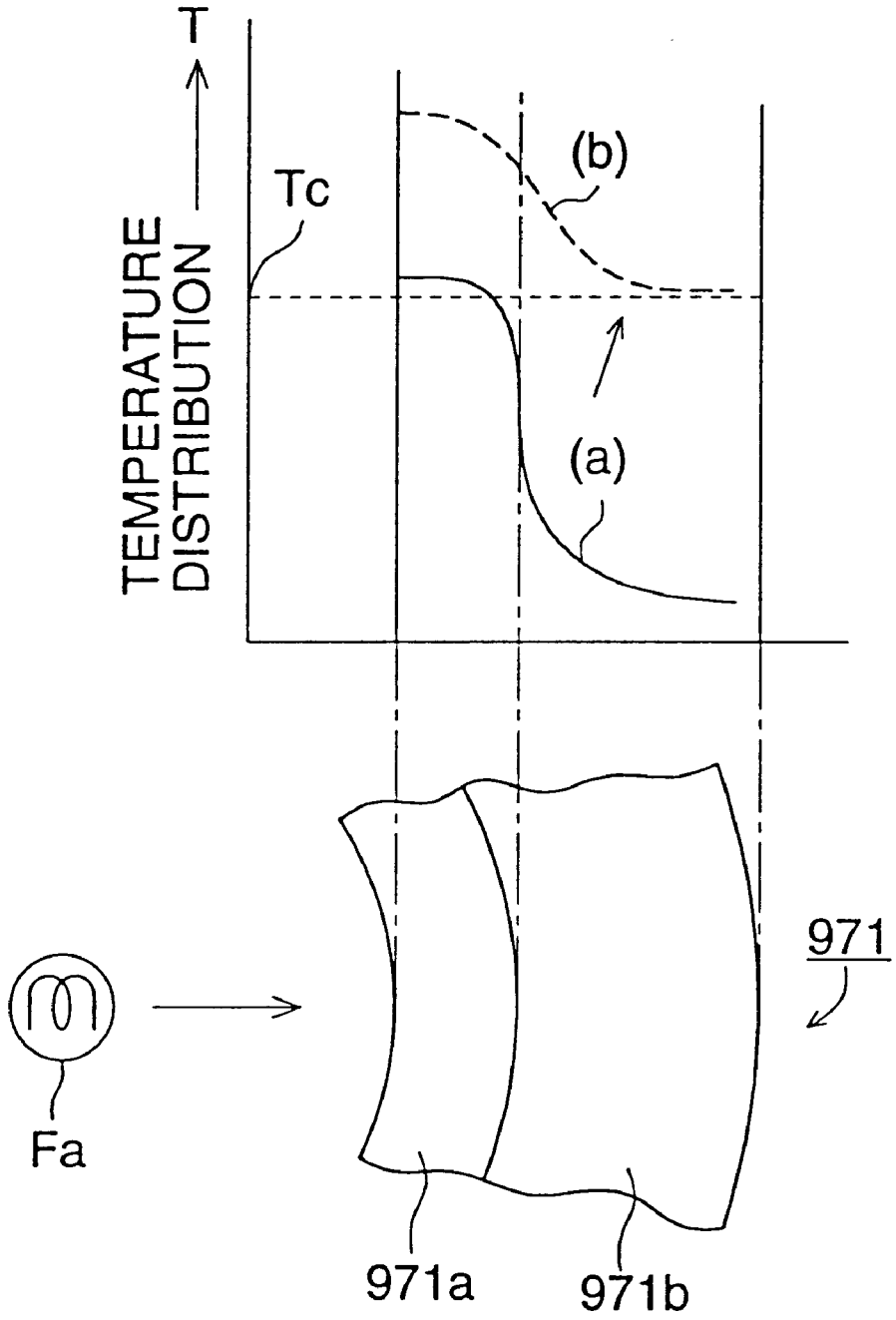
FIG. 19 PRIOR ART
FIG. 19 is a view showing the temperature distribution of the conventional heat roller.
Figure 20:
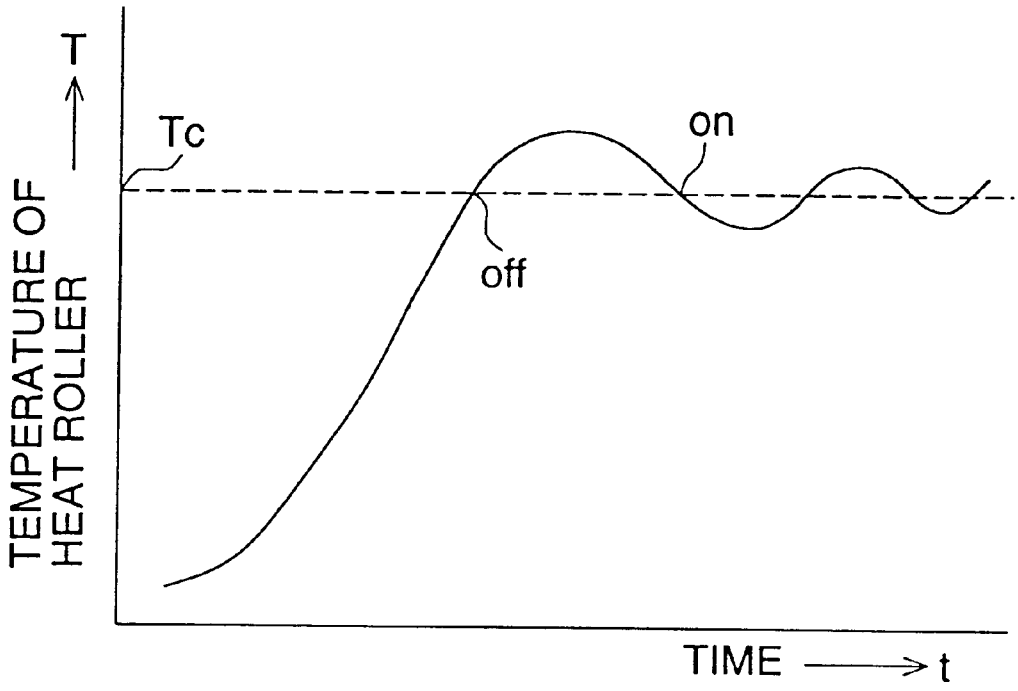
FIG. 20 PRIOR ART
FIG. 20 is a view showing the temperature-rise curve of the heat roller in FIG. 19.
Figure 21:
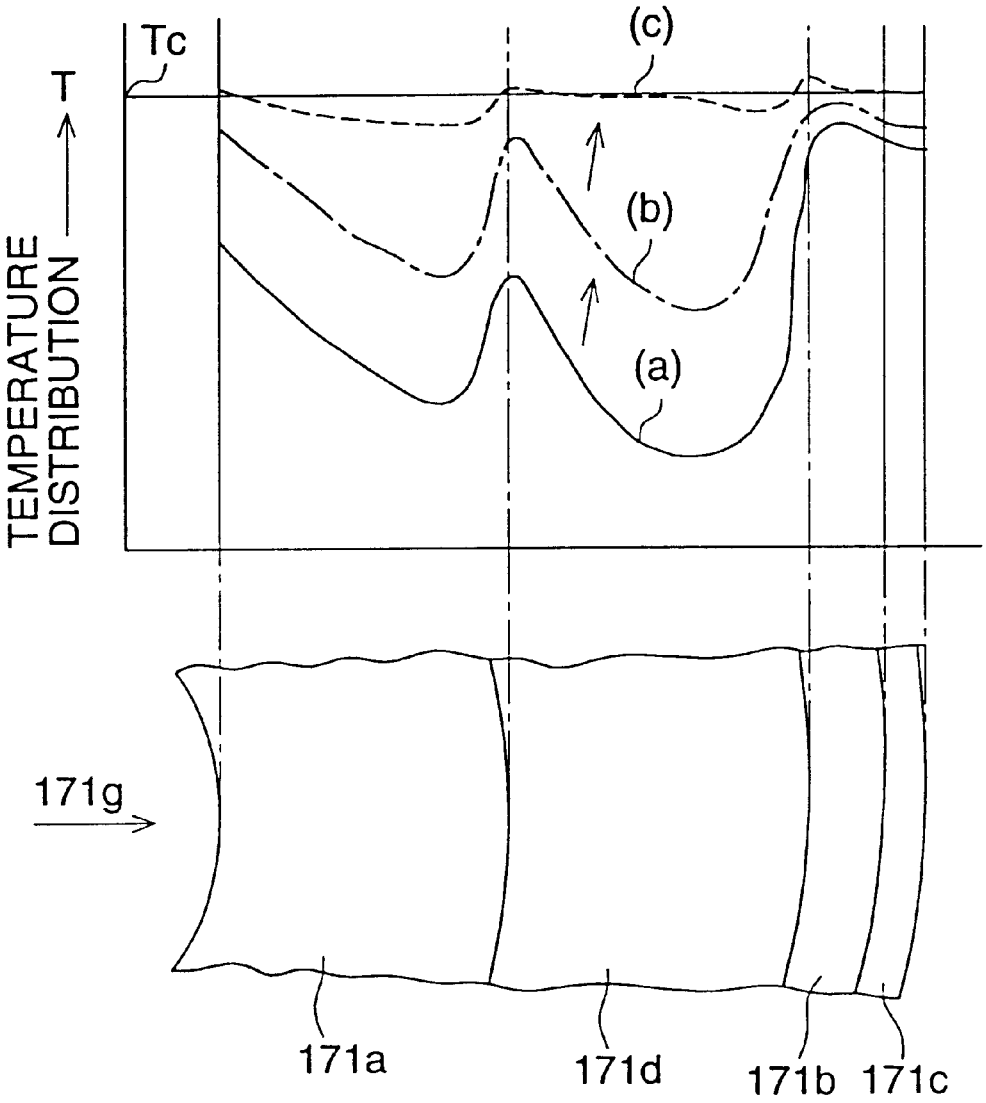
FIG. 21 is a view showing the temperature distribution of each layer of the rotary member for applying heat in FIG. 3.

FIG. 19 is a view showing the temperature distribution of the conventional heat roller, FIG. 20 is a view showing the temperature rise curve of the heat roller in FIG. 19, and FIG. 21 is a view showing the temperature distribution of each layer of the rotary member for applying heat in FIG. 3.

The structure of a conventional heat roller and the temperature distribution in it are shown in FIG. 19; the heat roller 971 is made up of the halogen lamp Fa provided inside the metallic pipe 971*a* and the rubber roller layer 971*b* provided on the outside (outer peripheral surface) of the metallic pipe 971*a*. As shown by the curve (a) in FIG. 19, in the initial stage of heating, the metallic pipe 971*a* having a good thermal conductivity get heated in a short time by the halogen lamp Fa, but thermal response of the heat roller 971 is low owing to the rubber roller layer 971*b* having a poor thermal conductivity, and in the steady state in which the surface reaches the suitable fixing temperature Tc, the inner portion is at a higher temperature than the outside as shown by the curve (b) in FIG. 19. Accordingly, by the simple on-off control by a temperature detecting means, which is not shown in the drawing, provided on the surface of the heat roller 971, the temperature rise curve for the surface of the heat roller 971 overshoots even if the halogen lamp Fa is turned off when the surface reaches the suitable fixing temperature Tc, because a considerably long time is needed for the heat conduction to the surface; thus, temperature control with a large ripple is brought about. Further, deterioration of the rubber roller layer 971*b* at the surface bordering on the metallic pipe 971*a* caused by heat is remarkable.

On the other hand, as described in the foregoing, in the heat applying roller 17*a* denoting a rotary member for applying heat in the fixing device 17 of this invention, the resilient layer 171*d* is made to be a layer having a heat insulating property by making its thermal conductivity smaller than that of the ray transmitting base member 171*a*, while the thermal conductivity of either of the ray transmitting base member 171*a* and the ray absorbing layer 171*b* is made large to make heat be conducted well in the lateral direction for obtaining a uniform temperature distribution in that direction (direction perpendicular to the transporting direction of transfer materials). Further, for the temperature distribution in the heat applying roller 17*a*, because, at the initial stage of heating up, the ray absorbing ratios of the ray transmitting base member 171*a* and the resilient layer 171*d*, which are radiated by the rays from the halogen lamp 171*g*, are not ideally 100%, but only 5% to 50% of heat is absorbed in each of them to generate more heat in the heat ray emitting side, the temperature distribution at the initial stage of heating up becomes such one as shown by the curve (a) in FIG. 21, and the temperature distribution at the intermediate stage becomes such one as shown by the curve (b) in FIG. 21, that is, the ray absorbing layer 171*b* at the surface side is made to have its temperature raised quickly, but the inner portion of the rotary member for applying heat remains cool at a low temperature. In the steady state, each of the layers keeps approximately the suitable fixing temperature Tc constantly as shown by the curve (c) in FIG. 21. The heating up of the ray absorbing layer 171*b* is quickened by making the resilient layer 171*d* have a heat insulating effect. The temperature rise speed of the ray absorbing layer 171*b* is made faster by reducing its heat capacity. When the temperature rises, more heat is generated at the inner portions of the ray absorbing layer 171b, resilient layer 171*d*, and the ray transmitting base member 171*a*, and heat is insulated by the resilient layer 171*d* in order to make the temperature rise faster. Accordingly, for the heat applying roller 17*a* denoting a rotary member for applying heat of this invention, a ray transmitting, also a heat insulating layer such as a ray transmitting resin as a non-resilient layer having simply an effect of heat insulation can be used.

As described in the above, by using the fixing device explained in FIG. 3, through the application of pressure at the fixing portion (nip portion) by the elasticity of the rotary member for applying heat and the application of heat by the ray absorbing layer of the rotary member for applying heat, it is easily done to fuse the color toner particles which have been difficult to fix by heat rays owing to their difference in spectral characteristics, and it becomes possible a quick start fixing (quick heating up) for color toners having a function of a soft roller and a shorter heating-up time. In particular, by employing it in the image forming apparatus explained in FIG. 1, through the application of pressure at the fixing portion (nip portion) by the elasticity of the rotary member for applying heat and the application of heat by the ray absorbing layer of the rotary member for applying heat, it is satisfactorily carried out also to fuse superposed color toner images having a thick toner layer on a transfer material which are difficult to fix by heat rays owing to their difference in spectral characteristics, and it becomes possible a quick start fixing (quick heating up) for color toner images having a function of a soft roller and a shorter heating-up time.

(Embodiment 1)

As described in the above, in the above-mentioned fixing device, the temperature rise speed of the ray absorbing layer at the surface is fast and the layer is quickly heated up, but the temperature at the inner portion of the heat applying roller is low, and also the lower fixing roller is not enough warmed up; hence, if print starting is immediately done, an off-set owing to low-temperature fixing is easy to occur.

Figure 22:
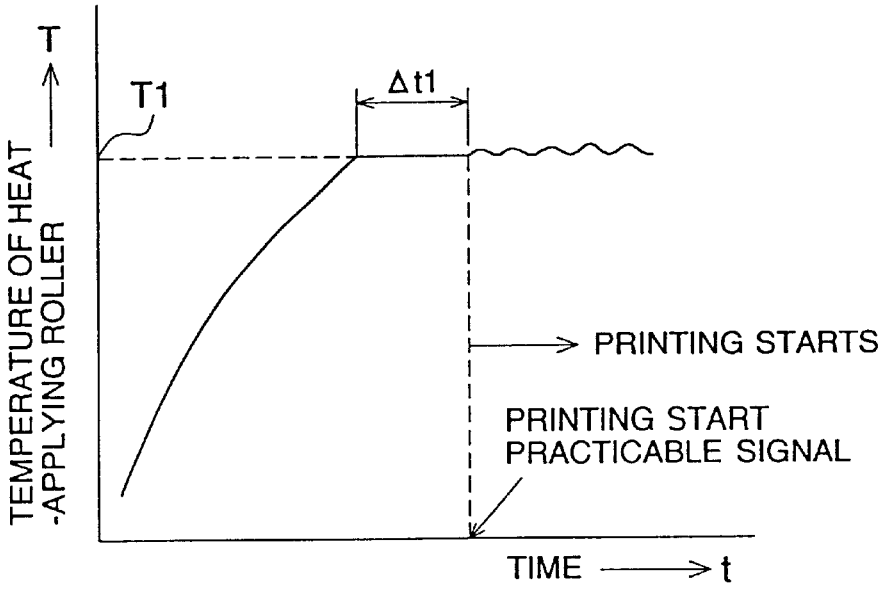
FIG. 22 is a view showing the temperature control of the rotary member for applying heat according to the present invention.

A method of temperature control of the rotary member for applying heat of this invention in order to solve this problem will be explained with reference to FIG. 22 and FIG. 23. FIG. 22 is a drawing showing the temperature control of the rotary member for applying heat of this invention, and FIG. 23 is a block diagram of the temperature control shown in FIG. 22.

Figure 23:
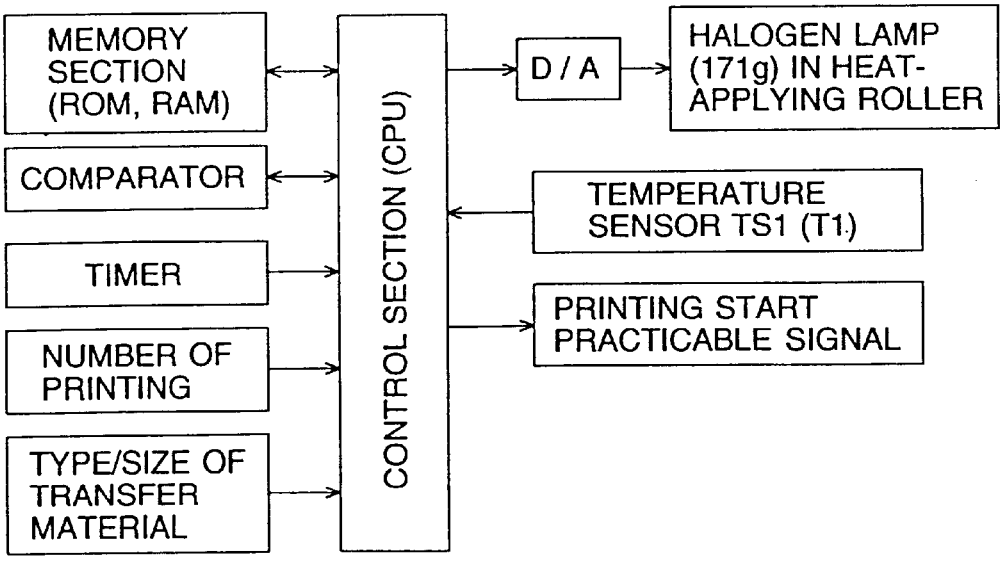
FIG. 23 is a temperature control block diagram in FIG. 22.

According to FIG. 22 and FIG. 23, in order to solve the above-described problem, print start is carried out in the state in which the temperature rise or heat storing at the inner portion of the rotary member for applying heat has progressed. To state it concretely, as shown in FIG. 22, the surface temperature of the heat applying roller 17*a* denoting a rotary member for applying heat is rapidly heated up to the suitable fixing temperature T1, and next, when the temperature has reached the suitable fixing temperature T1, it is kept at T1 for a predetermined time (maintaining time) Δt1, for example, 5 to 30 sec. by temperature control, to store heat inside; thus, print start is enabled. That is, in order to supply a sufficient power for quickly getting the suitable fixing temperature T1, processing operations are not carried out at the initial stage (prior to the printing operation), and power is distributed to the fixing device 17 in a concentrated manner to raise the temperature of the heat applying roller 17*a* up to the suitable fixing temperature T1. Next, after the temperature has reached the suitable fixing temperature T1, the temperature control for a predetermined time is carried out, but the temperature does not overshoot even if the heating up by the halogen lamp is stopped, because the heat applying roller 17*a* generates heat at the surface layer. This is because the heat in the surface portion of the heat applying roller 17*a* diffuses to the inner portion to lower the surface temperature immediately. For this reason, the temperature ripple is small even if the turning on-off control or a phase control is carried out immediately after the temperature has reached the suitable fixing temperature T1.

At the timing when the temperature has been kept at T1 for a predetermined time (maintaining time) Δt1 after it is detected by the temperature sensor TS1 that the surface temperature of the heat applying roller 17*a* has reached the suitable fixing temperature T1, the signal indicating print start being enabled (hereinafter referred to as "print start signal" for simplicity's sake) is outputted from the control portion (in the case where the image forming apparatus is a copying machine equipped with an original image reading portion at the upper part of the printer which has been explained in FIG. 1, the print start signal is outputted from the control portion to the operation portion not shown in the drawing etc.), and print start is carried out.

The value to be set for the suitable fixing temperature T1 and the value to be set for the predetermined time (maintaining time) Δt1 for maintaining the temperature at T1 are determined beforehand by measurements as tables (reference tables) of respectively different values based on the number of prints (the number of prints in continuous printing), the kinds of the transfer material such as a thick paper, a thin paper, an OHT (transparency for overhead projectors), etc., the size of the transfer material, and so forth, and memorized in a ROM in the memory portion. According to the designation or the instruction from the control portion based on the designation of the number of prints (the number of prints in continuous printing), the kinds of the transfer material such as a thick paper, a thin paper, an OHT, etc., the size of the transfer material, and so forth, a table corresponding to the designation is selected out of the respectively different tables memorized in the ROM, and then the value to be set for the suitable fixing temperature T1 and the value to be set for the predetermined time (maintaining time) Δt1 for maintaining the temperature at T1 having the value corresponding to the designation are referred to and set; thus, the temperature control of the heat applying roller 17*a* is carried out. In the case where printing operation has already been carried out and the heat applying roller 17*a* has been warmed up, the value for the predetermined time (maintaining time) Δt1 for maintaining the suitable fixing temperature T1 is reset in accordance with the temperature of the heat applying roller 17*a* at that timing, sometimes with the temperature of the lower fixing roller 47*a* taken into consideration.

According to the above-described processes, the ray absorbing layer at the surface is heated up, and after the inner portion of the rotary member for applying heat is further heated up for the predetermined time, print start is enabled; hence, it is made possible to provide a fixing device capable of quick start (rapid heating up) controlled so as to prevent the off-set owing to low-temperature fixing.

Figure 24:
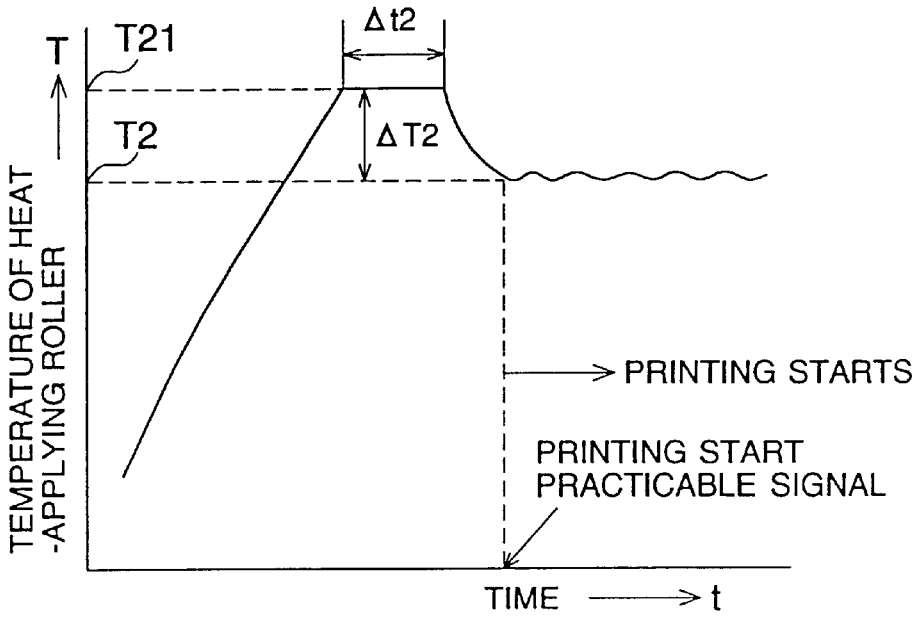
FIG. 24 is a view showing the temperature control of the rotary member for applying heat according to the present invention.

Further, a method of temperature control for a rotary member for applying heat of this invention will be explained with reference to FIG. 24 and FIG. 25. FIG. 24 is a drawing showing the temperature control for a rotary member for applying heat of this invention, and FIG. 25 is a block diagram of the temperature control shown in FIG. 24.

Figure 25:
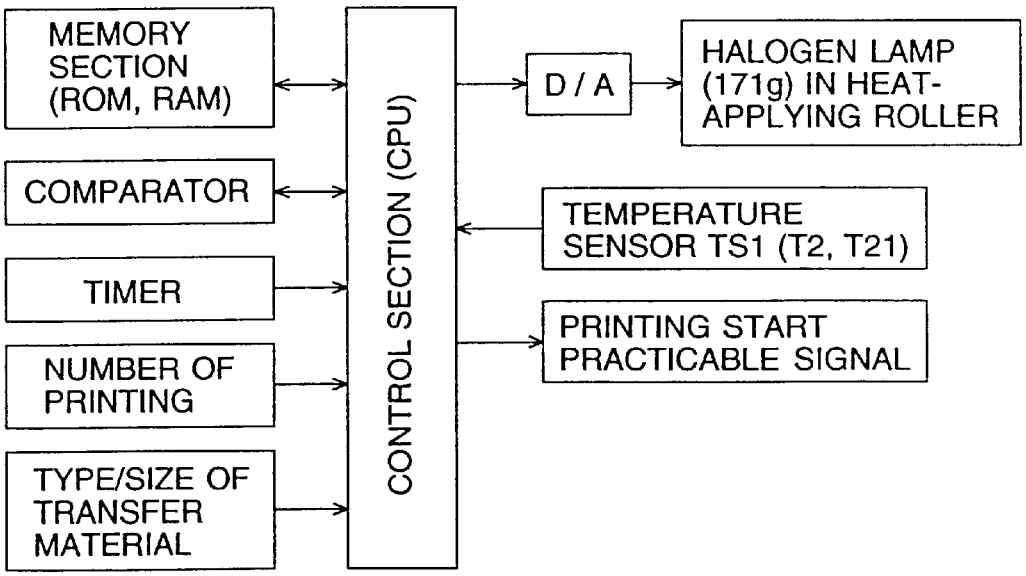
FIG. 25 is a temperature control block diagram in FIG. 24.

According to FIG. 24 and FIG. 25, in order to shorten the time to print start, sufficient temperature rise is given to the surface and print start is carried out in the state in which heat storing at the inner portion has progressed. To state it concretely, as shown in FIG. 24, the surface temperature of the heat applying roller 17*a* denoting a rotary member for applying heat is raised up to the excessively-heated temperature T21 which is higher than the suitable fixing temperature T2 by ΔT2, and after the temperature has been maintained at the excessively-heated temperature T21 for a time (time for maintaining the excessively-heated temperature) Δt2 by heating to store heat at the inner portion, the temperature is lowered to the suitable fixing temperature T2 again. In order to supply electric power for raising the temperature to the excessively-heated temperature T21, process operations are not carried out at the initial stage (prior to the printing operation), and power is distributed to the fixing device 17 in a concentrated manner to raise the temperature of the heat applying roller 17*a* up to the excessively-heated temperature T21. Next, after the temperature has reached the excessively-heated temperature T21, the temperature control for a predetermined time is carried out, but the temperature does not overshoot even if the heating up by the halogen lamp 171*g* is stopped, because the heat applying roller 17*a* generates heat at the surface layer. This is because the heat in the surface portion of the heat applying roller 17*a* diffuses to the inner portion to lower the surface temperature immediately. For this reason, the temperature ripple is small even if the turning on-off control or a phase control is carried out immediately after the temperature has reached the suitable fixing temperature T1.

At the timing when it is detected by the temperature sensor TS1 that the surface temperature of the heat applying roller 17*a* has been lowered to the suitable fixing temperature T2, the print start signal is outputted from the control portion (in the case where the image forming apparatus is a copying machine equipped with an original image reading portion at the upper part of the printer which has been explained in FIG. 1, the print start signal is outputted from the control portion to the operation portion not shown in the drawing etc.), and print start is carried out.

The value to be set for the excessively-heated temperature T21 (also the value to be set for the temperature difference ΔT2 between the suitable fixing temperature T2 and the excessively-heated temperature T21) and the value to be set for the predetermined time (time for maintaining the excessively-heated temperature) Δt2 for maintaining the temperature at T21 are determined beforehand by measurements as tables (reference tables) of respectively different values based on the number of prints (the number of prints in continuous printing), the kinds of the transfer material such as a thick paper, a thin paper, an OHT, etc., the size of the transfer material, and so forth, and memorized in a ROM in the memory portion. According to the designation or the instruction from the control portion based on the designation of the number of prints (the number of prints in continuous printing), the kinds of the transfer material such as a thick paper, a thin paper, an OHT, etc., the size of the transfer material, and so forth, a table corresponding to the designation is selected out of the respectively different tables memorized in the ROM, and then the value to be set for the excessively-heated temperature T21 (also the value to be set for the temperature difference ΔT2 between the suitable fixing temperature T2 and the excessively-heated temperature T21) and the value to be set for the predetermined time (time for maintaining the excessively-heated temperature) Δt2 for maintaining the temperature at T21 having the value corresponding to the designation are referred to and set; thus, the temperature control for the heat applying roller 17*a* is carried out. In the case where printing operation has already been carried out and the heat applying roller 17*a* has been warmed up, the value for the excessively-heated temperature T21 (also the value for the temperature difference ΔT2 between the suitable fixing temperature T2 and the excessively-heated temperature T21) and the value for the time (time for maintaining the excessively-heated temperature) Δt2 for maintaining the excessively-heated temperature T21 are reset in accordance with the temperature of the heat applying roller 17*a* at that timing, sometimes with the temperature of the lower heat applying roller 47*a* taken into consideration.

According to the above-described processes, the ray absorbing layer at the surface is heated up, and after the inner portion of the rotary member for applying heat is further heated up for the predetermined time, print start is enabled; hence, it is made possible to provide a fixing device capable of quick start (rapid heating up) controlled so as to prevent the off-set owing to low-temperature fixing.

(Embodiment 2)

In the above-described fixing device, the temperature of the ray absorbing layer at the surface rises quickly but the temperature of the inner portion of the rotary member for applying heat does not rise quickly, and also the lower rotary member for fixing has not been warmed up sufficiently likewise; hence, proper temperature control can not be carried out by only detecting the surface temperature of the rotary member for applying heat or the lower rotary member for fixing, and the off-set owing to low-temperature fixing is easy to occur. Therefore, while keeping the ray radiating means in the rotary member for applying heat in the on or off state compulsorily for a short definite time (for several seconds), to observe the situation of heat transfer in the surrounding, the temperature of the inner portion of the rotary member for applying heat, with the temperature of the lower rotary member for fixing taken into consideration, is estimated to carry out the temperature control.

The method of temperature control for the rotary member for applying heat of this invention will be explained as concrete methods with reference to FIG. 26(*a*) to FIG. 26(*c*), FIG. 27, FIG. 22, and FIG. 24. FIG. 26(*a*) to FIG. 26(*c*) are drawings showing the estimated temperature control for the rotary member for applying heat of this invention, and FIG. 27 is a block diagram of the temperature control shown in FIG. 26.

Figure 27:
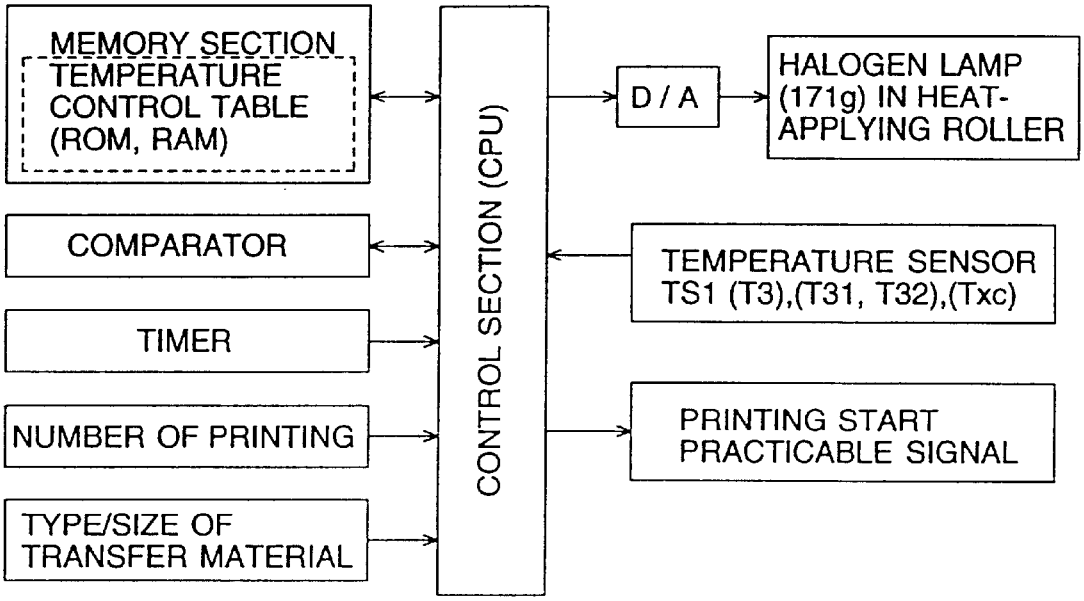
FIG. 27 is a temperature control block diagram in FIGS. 26(*a*)–26(*c*).

According to FIG. 26(*a*) to FIG. 26(*c*) and FIG. 27, in order to solve the above-described problem, the temperature control of the heat applying roller 17*a* denoting a rotary member for applying heat is carried out, by estimating the temperature of the inner portion from the decreasing speed of the surface temperature (the temperature gradient, first order differential coefficient, second order differential coefficient, or the like) owing to the compulsory turning-off of the ray radiating means for a definite time or from its increasing speed owing to the compulsory turning-on of the same for a definite time. For the temperature control by estimating the temperature of the inner portion of the rotary member for applying heat in the case of the temperature control explained in FIG. 22 of the above-described embodiment 1, as shown in FIG. 26(*a*) concretely, the temperature of the heat applying roller 17*a* is raised up to the suitable fixing temperature T3, making the halogen lamp 171*g* denoting a ray radiating means turned off compulsorily for a definite time, then the first order differential coefficient (temperature variation) ΔT31/Δt31 showing the speed of the temperature decrease is measured, and the time (maintaining time) Δtx1 for maintaining the suitable fixing temperature T3 is determined from a table (table for determining maintaining time) in the ROM. Further, after making the halogen lamp 171*g* denoting a ray radiating means turned on compulsorily for a definite time, the first order deferential coefficient (temperature variation) ΔT32/Δt32 indicating the speed of the temperature increase is measured, and the time (maintaining time) Δtx2 for maintaining the suitable fixing temperature T3 is determined from a table in the ROM. In the case where the temperature has not decreased so much during the compulsory turning off for a definite time, the maintaining time is set to a shorter value because the inner portion is in the state of being warmed up, and in the case where the temperature has decreased greatly, the maintaining time is set to a longer value because the inner portion is in the state of not being warmed up but still being cool, and the print start signal is outputted after the passage of the maintaining time. Further, In the case where the temperature exhibits a large trend of increasing during the compulsory turning on for a definite time, the maintaining time is set to a shorter value because the inner portion is in the state of being warmed up, and in the case where the temperature increase is small, the maintaining time is set to a longer value because the inner portion is in the state of not being warmed up but still being cool, and the print start signal is outputted after the passage of the maintaining time. Further, for the temperature control by estimating the temperature of the inner portion of the rotary member for applying heat in the case of the temperature control explained in FIG. 23 of the above-described embodiment 1, the same control as described in the above is carried out at the positions indicated by the circle (a) and the circle (b) both written with a single dot and dash line, and the time (time for maintaining the excessively-heated temperature) Δtx3 for maintaining the excessively-heated temperature is determined from a table (table for determining maintaining time) to carry out the temperature control. That is, the values of Δtx1 to Δtx3 obtained by the control explained in FIG. 26(*a*) and FIG. 26(*b*) can be used for the value of the predetermined time (maintaining time) Δt1 for maintaining the suitable fixing temperature T1 explained in FIG. 22, and the value of the time (time for maintaining the excessively-heated temperature) Δt2 for maintaining the excessively-heated temperature T21 explained in FIG. 24. The value of the predetermined time (maintaining time) Δt1 for maintaining the suitable fixing temperature T1 and the value of the time (time for maintaining the excessively-heated temperature) Δt2 for maintaining the excessively-heated temperature T21 obtained from the table (reference table) are memorized in a table, and on the basis of said table, it is carried out the control of heating during the predetermined time (maintaining time) Δt1 for maintaining the suitable fixing temperature T1 and during the time (time for maintaining the excessively-heated temperature) Δt2 for maintaining the excessively-heated temperature T21.

To state it generally, as shown in FIG. 26(*c*), by making the halogen lamp 171*g* denoting a ray radiating means turned on or off compulsorily for a definite time, the surface temperature of the ray absorbing layer Tx at the surface of the heat applying roller 17*a,* which is subjected to the influence of the temperature of the lower rotary member for applying heat 47*a,* and the temperature gradient (temperature variation) against time of the heat applying roller 17*a* ΔTx/Δtx[, which is measured from the temperature of the inner portion of the heat applying roller 17*a,*] being let to be parameters, the maintaining time (maintaining time up to the timing when the print start is enabled) Δtxc for obtaining the suitable fixing temperature Txc at that timing is determined (Δtxc=f(Tx, (ΔTx/Δtx)).

With the surface temperature Tx and the temperature gradient (temperature variation) against time ΔTx/Δtx let to be parameters, the maintaining time (maintaining time up to the timing when the print start is enabled) Δtxc for obtaining the suitable fixing temperature Txc at that timing is determined beforehand by measurements as respectively different tables (tables for determining the maintaining temperature) based on the number of prints (the number of prints in continuous printing), the kinds of the transfer material such as a thick paper, a thin paper, an OHT, etc., the size of the transfer material, and so forth and memorized in a ROM in the memory portion. According to the designation or the instruction from the control portion based on the designation of the number of prints (the number of prints in continuous printing), the kinds of the transfer material such as a thick paper, a thin paper, an OHT, etc., the size of the transfer material, and so forth, a table (table for determining the maintaining temperature) corresponding to the designation is selected out of the respectively different tables (tables for determining the maintaining temperature) memorized in the ROM; further, the value of the maintaining time (maintaining time up to the timing when the print start is enabled) Δtxc for obtaining the suitable fixing temperature Txc corresponding to the surface temperature Tx and the temperature gradient (temperature variation) against time ΔTx/Δtx at that timing is referred to in the selected table and set; thus, it is carried out the temperature control which is based on the estimation of the temperature of the inner portion of the heat applying roller 17*a*.

As described in the above, by making the temperature control which is based on the estimation of the temperature of the inner portion of the rotary member for applying heat from the surface temperature of the rotary member for applying heat and the temperature variation, the inner portion is heated up properly, and the ray absorbing layer at the surface is always kept at the suitable fixing temperature; hence, it is made possible to provide a fixing device capable of a quick start (rapid heating up) being controlled so as to prevent the off-set owing to low-temperature fixing.

(Embodiment 3)

Further, in respect of a conventional heat roller, it is made up of a metallic pipe having a good thermal conductivity heated from the inside by a halogen lamp and a rubber roller layer having a poor thermal conductivity provided on the outside (on the outer peripheral surface) of the metallic pipe; hence, it has a poor response and has a limit to a quick start (rapid heating up). On top of that, the temperature of the inner portion is higher than that of the outer portion, to bring about a problem that the rubber roller layer gets deteriorated. On the contrary, in the above-described fixing device, the temperature of the ray absorbing layer at the surface is quickly raised, but the inner portion of the rotary member for applying heat is cool and its temperature is low, and also the lower fixing roller is not warmed up sufficiently likewise; hence, some temperature raising technology for the rotary member for applying heat of this type is required.

Figure 28:
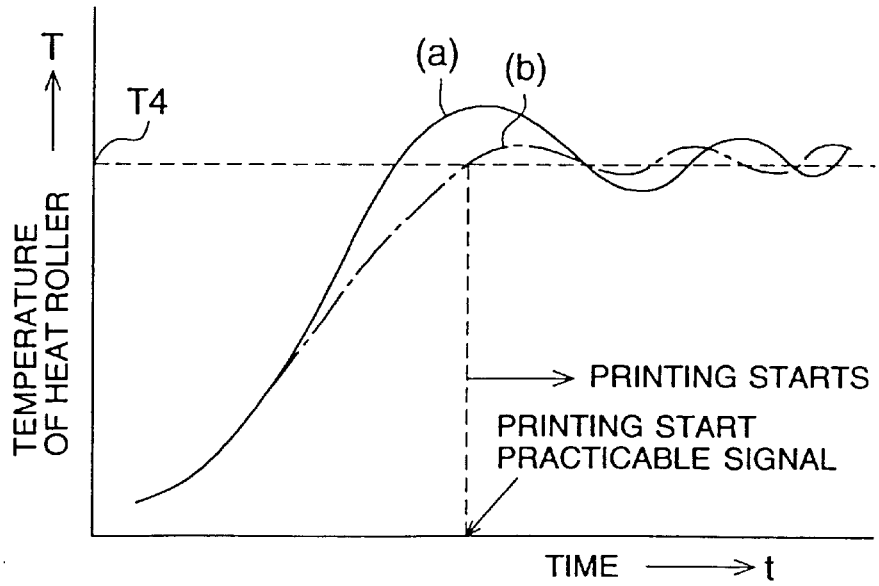
FIG. 28 PRIOR ART
FIG. 28 is a view showing the temperature control of the conventional heat roller.
Figure 30:
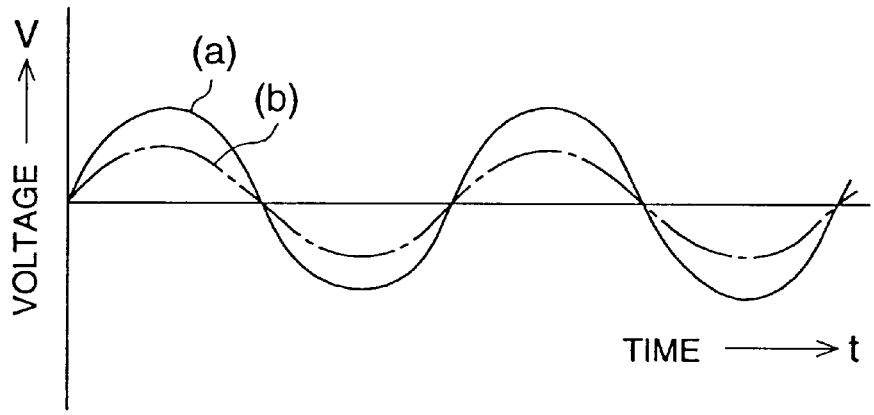
FIG. 30 is a view showing the setting of an electric power level of a ray radiating means used for the rotary member for applying heat in FIG. 29.
Figure 31:
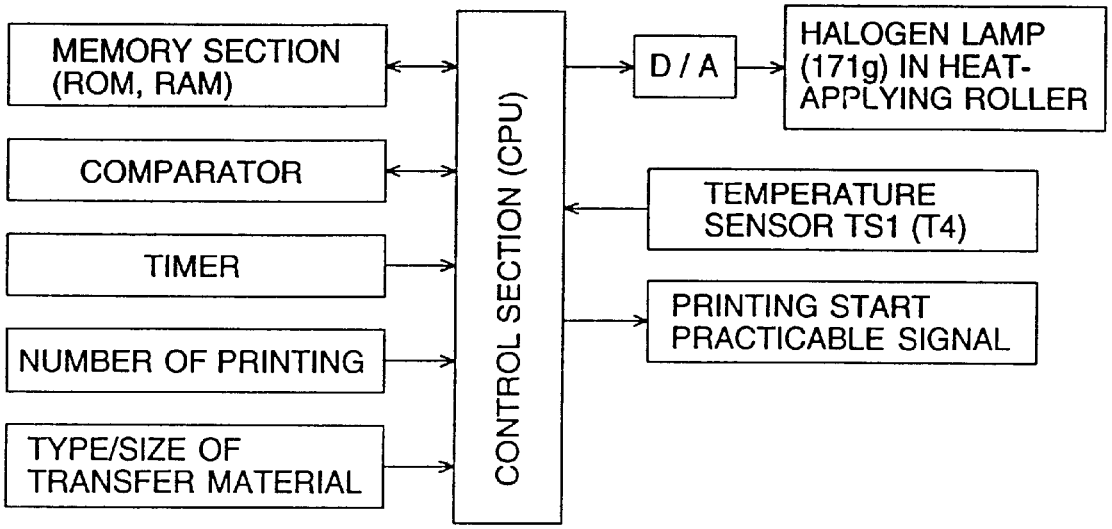
FIG. 31 is a temperature control block diagram in FIG. 29.

The method of temperature control of the rotary member for applying heat of this invention for solving this problem will be explained with reference to FIG. 28 to FIG. 31, FIG. 19, and FIG. 20. FIG. 28 is a drawing showing the temperature control of a conventional heat roller, FIG. 29 is a drawing showing the temperature control of a rotary member for applying heat of this invention, FIG. 30 is a drawing showing the setting of the power level for the ray radiating means used in the rotary member for applying heat shown in FIG. 29, and FIG. 31 is a block diagram of the temperature control shown in FIG. 29.

According to FIG. 28 to FIG. 31, as explained in FIG. 19 and FIG. 20, the conventional heat roller 971 has a poor thermal conductivity, and it requires a considerable time to heat up the surface. As shown by the curve (a) in FIG. 28, the temperature overshoots to a level higher than the suitable fixing temperature T4 owing to simple on-off control of the halogen lamp Fa based on the method of conventional temperature control. For this reason, as shown by the curve (b) in FIG. 28, by using the method of predictive control, using a PID control method for example, the temperature control of the heat roller 971 is carried out since a time before the temperature reaches the suitable fixing temperature T4. Therefore, it takes a considerably long time for the temperature to reach the suitable fixing temperature at which print start is enabled.

Figure 29:
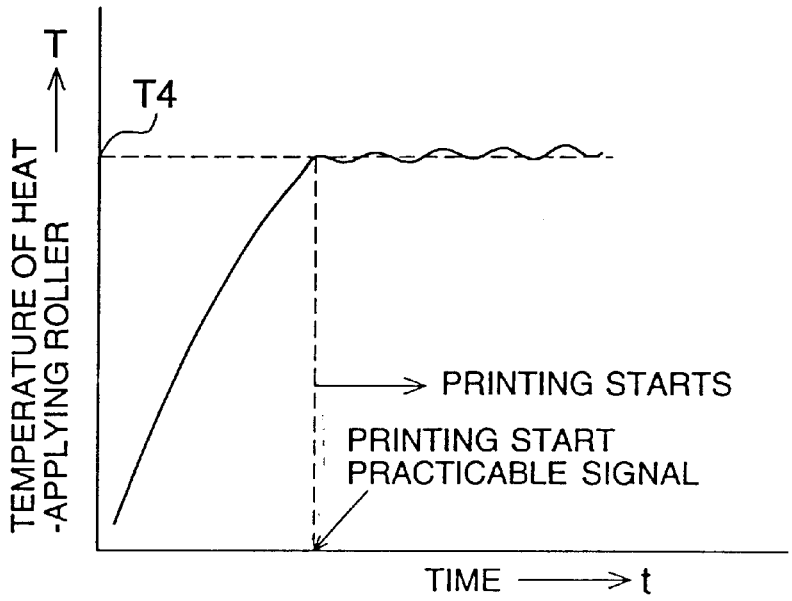
FIG. 29 is a view showing the temperature control of the rotary member for applying heat according to the present invention.

In the temperature control of this invention for solving this problem, as shown in FIG. 29, the heat applying roller 17*a* is heated up on the condition of maximum power consumption where the halogen lamp is lit up to 100% of its full power until the surface temperature of the heat applying roller 17*a* reaches the suitable fixing temperature T4, and after the surface temperature reaches the suitable fixing temperature T4 at which print start is enabled, the temperature control of the heat applying roller 17*a* is carried out by on-off control or by phase control for example. Owing to the heat generation in the ray absorbing layer 171*b* at the surface of the heat applying roller 17*a,* the temperature of the inner portion is lower than that of the surface; hence, even if the temperature is raised up to the suitable fixing temperature T4 by the continuous lighting of the halogen lamp up to 100% of its full power, there is no possibility for the surface temperature to overshoot at the time of being raised up to the suitable fixing temperature T4, because the temperature decreases below the suitable fixing temperature T4 immediately after the power source is turned off. This is because, when the heating by the halogen lamp is stopped, the heat at the surface of the heat applying roller 17*a* diffuses into the inner portion to decrease the temperature of the surface. Moreover, only a small ripple appears during the temperature control after the temperature is raised up to the suitable fixing temperature T4.

As described in the above, the heat applying roller 17*a* is heated up on the condition of maximum power consumption where the halogen lamp is lit up to 100% of its full power until the surface temperature of the heat applying roller 17*a* reaches the suitable fixing temperature T4, and after the surface temperature reaches the suitable fixing temperature T4 at which print start is enabled, the temperature control is carried out. For the mode of temperature control after the temperature is raised up to the suitable fixing temperature T4, phase control is usually carried out. For a more accurate temperature control method, it is used a method in which multi-stage temperature control can be performed by combining the setting of multi-stage power levels which makes it possible to apply a high voltage of a sine wave shape as shown by the curve (a) in FIG. 30 or a low voltage of a sine wave shape as shown by the curve (b) in FIG. 30 to the halogen lamp 171*g* denoting a ray radiating means, and phase control.

At the timing when it is detected by the temperature sensor TS1 that the surface temperature of the heat applying roller 17*a* is raised to the suitable fixing temperature T4, the print start signal is outputted from the control portion (in the case where the image forming apparatus is a copying machine equipped with an original image reading portion in the upper part of the printer which has been explained in FIG. 1, the print start signal is outputted from the control portion to the operation portion not shown in the drawing etc.), and print start is done.

The value to be set for the suitable fixing temperature T4 are determined beforehand by measurements as tables (reference tables) of respectively different values based on the number of prints (the number of prints in continuous printing), the kinds of the transfer material such as a thick paper, a thin paper, an OHT, etc., the size of the transfer material, and so forth, and memorized in a ROM in the memory portion. According to the designation, or the instruction from the control portion based on the designation, of the number of prints (the number of prints in continuous printing), the kinds of the transfer material such as a thick paper, a thin paper, an OHT, etc., the size of the transfer material, and so forth, a table corresponding to the designation is selected out of the respectively different tables memorized in the ROM, and then the value for the suitable fixing temperature T4 is referred to in the selected table and set; thus, the temperature control for the heat applying roller 17*a* is carried out.

According to the above-described embodiment, it becomes possible to provide a temperature raising technology for a fixing device capable of a quick start (rapid heating up) equipped with a rotary member for applying heat of a heat ray radiated type having a ray absorbing layer at the surface quickly heated up to the suitable fixing temperature and its inner portion kept at a lower temperature.

(Embodiment 4)

Further, in the above-described fixing device, owing to the influence of not only the kind of the transfer material, but also the temperature of the inner portion of the rotary member for applying heat, the temperature of the rotary member for fixing placed opposite to and beneath the rotary member for applying heat etc., the temperature of the ray absorbing layer is raised quickly but the temperature of the inner portion is not easy to raise, and also the beneath-placed fixing roller is not still warmed up sufficiently; hence, it is necessary a temperature control method of a quick-response characteristic for a rotary member for applying heat whose temperature is able to be quickly lowered.

Figure 32:
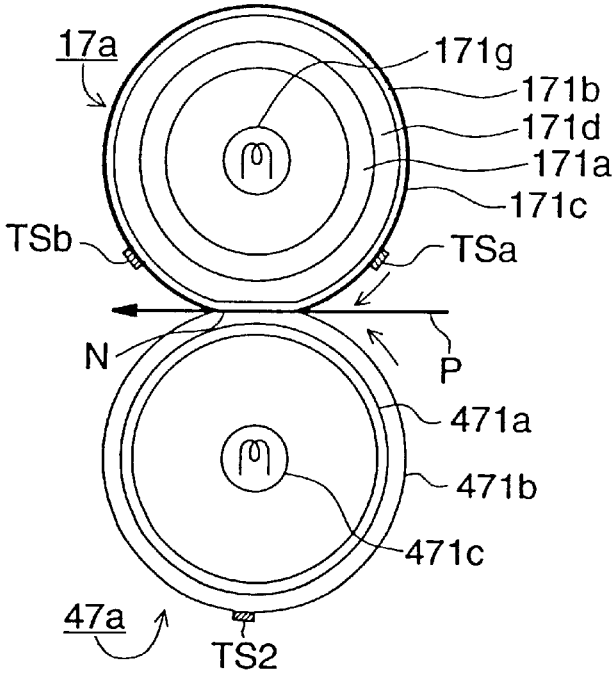
FIG. 32 is a view showing the arrangement of temperature detecting means of the rotary member for applying heat according to the present invention.

The disposition of the temperature detecting means of a rotary member for applying heat of this invention for solving the above-described problem will be explained with reference to FIG. 32 to FIG. 35. FIG. 32 is a drawing showing the disposition of the temperature detecting means of a rotary member for applying heat of this invention, FIG. 33 is a block diagram of the temperature control shown in FIG. 32, FIG. 34 is a drawing showing the temperature difference between the temperature detecting positions of the temperature detecting means according to FIG. 32, and FIG. 35 is a drawing showing the variation of the temperatures detected by the temperature detecting means and the power supply to the rotary member for applying heat.

According to FIG. 32 to FIG. 35, owing to the influence of not only the kind of the transfer material, but also the temperature of the inner portion of the heat applying roller 17*a* denoting a rotary member for applying heat, the temperature of the fixing roller 47*a* denoting a rotary member for fixing placed opposite to and beneath the rotary member for applying heat 17*a,* etc., the temperature of the ray absorbing layer 171*b* at the surface of the rotary member for applying heat 17*a* is raised quickly but the temperature of the inner portion is not easy to raise; hence, for the heat applying roller 17*a* whose temperature is easy to decrease quickly, it is intended to respond quickly to the temperature variation by carrying out the temperature control through detecting the temperatures at the front and rear positions (at the upstream side and the downstream side with respect to the rotating direction of the heat applying roller 17*a*) of the nip portion N on the surface of the heat applying roller 17*a*. To state it concretely, as shown in FIG. 32, the temperature sensor TSa and the temperature sensor TSb are provided respectively at the upstream side and the down stream side of the nip portion N with respect to the rotating direction of the heat applying roller 17*a,* to measure the temperatures of the front and rear positions (the upstream side and downstream side), and the temperature control of the heat applying roller 17*a* is carried out in accordance with the temperature difference given by the temperature sensor TSa and the temperature sensor TSb. The temperature sensor TSa detects the temperature of the heat applying roller 17*a* which is raised by the heat given through heat conduction from the lower part and the radiation by the heat rays from the halogen lamp 171*g* (the temperature immediately before the fixing of toner image on the recording paper P). Further, the temperature sensor TSb detects the temperature of the heat applying roller 17*a* which is lowered by the heat transfer to the recording paper P and the fixing roller 47*a* owing to the fixing (the temperature immediately after the fixing of toner image on the recording paper P).

Figure 33:
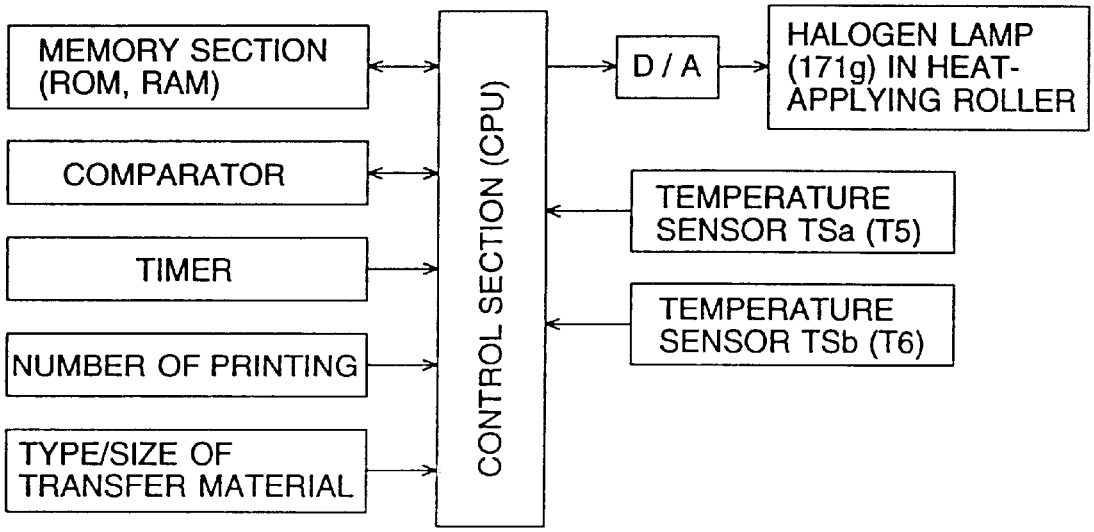
FIG. 33 is a temperature block diagram in FIG. 32.

As shown in FIG. 33, the temperature control of the heat applying roller 17*a* is carried out, in a manner such that the temperature difference (T5–T6) between the temperature T5 to be measured by the temperature sensor TSa and the temperature T6 to be measured by the temperature sensor TSb is measured, through the detection of the temperature T5 by the temperature sensor TSa provided at the upstream side of the nip portion N, and the detection of the temperature T6 by the temperature sensor TSb provided at the downstream side, and from the temperature T5 and the temperature difference (T5–T6), electric power to be supplied is determined by using a table in a ROM of the memory portion, then said electric power is supplied to the halogen lamp 171*g* through the control portion. That is, the electric power to be supplied on the basis of the temperature t5 and the temperature difference (T5–T6) is determined beforehand by measurements as tables (reference tables) of respectively different values based on the number of prints (the number of prints in continuous printing), the kinds of the transfer material such as a thick paper, a thin paper, an OHT, etc., the size of the transfer material, and so forth, and memorized in a ROM in the memory portion. According to the designation, or the instruction from the control portion based on the designation, of the number of prints (the number of prints in continuous printing), the kinds of the transfer material such as a thick paper, a thin paper, an OHT, etc., the size of the transfer material, and so forth, a table corresponding to the designation is selected out of the respectively different tables memorized in the ROM, and then the value to be set for the electric power to be supplied is referred to in the selected table and set; in this way, the temperature control for the heat applying roller 17*a* is carried out. It is also possible to carry out the temperature (surface temperature) control of the heat applying roller 17*a* through calculating the electric power to be supplied from the temperature T5 and the temperature difference (TS–T6), and supplying said electric power to the halogen lamp 171*g*.

Figure 34:
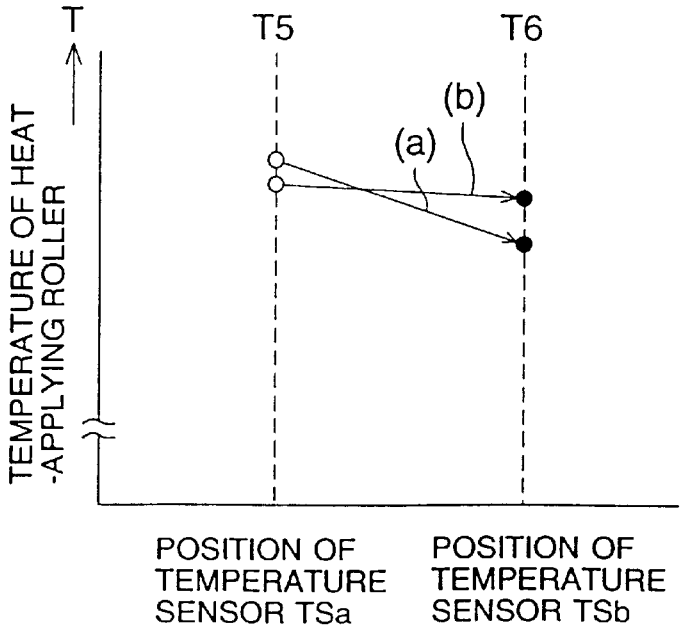
FIG. 34 is a view showing the temperature difference at the temperature detecting positions of the temperature detecting means in FIG. 32.
Figure 35:
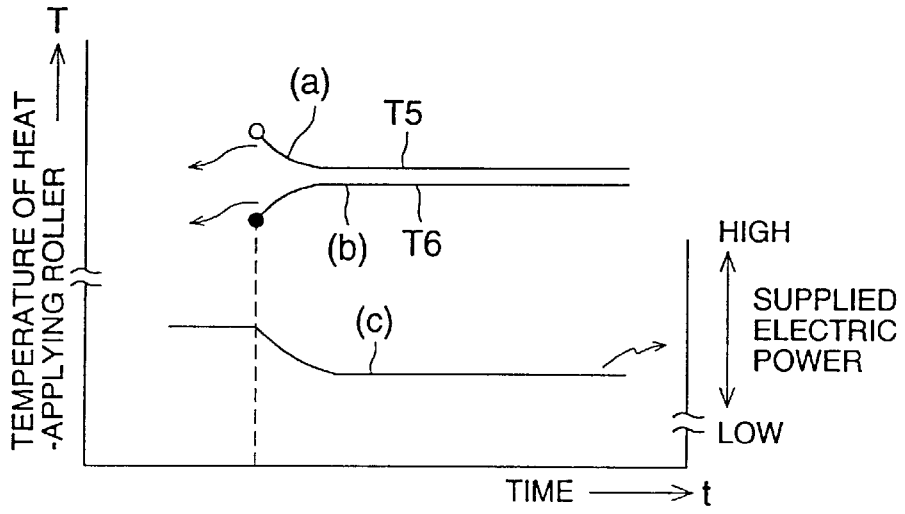
FIG. 35 is a view showing the change of detecting temperature of the temperature detecting means in FIG. 32 and the supplying electric power to the rotary member for applying heat.

The temperature difference (T5–T6) between the temperature T5 at the position of the temperature sensor TSa and the temperature T6 at the position of the temperature sensor TSb tends to be large at the initial stage immediately after warming up as shown by the arrow line (a) in FIG. 34, and to be small at the late stage as shown by the arrow line (b) in FIG. 34. That is, the temperature T5 measured by the temperature sensor TSa and the temperature T6 measured by the temperature sensor TSb after the turning on of the power source change in a manner as shown by the curves (a) and (b) in FIG. 35 respectively. Because the inner portion of the heat applying roller 17*a* and the fixing roller 47*a* have not been warmed up at the initial stage, the decrease of the temperature T5 indicated by the sensor TSa is large. Therefore, as shown by the curve (c) in FIG. 35, the power supply to the halogen lamp 171*g* is controlled on the basis of the temperature T5 and the temperature difference (T5–T6) so as to make the temperature T5 higher (generally speaking, in the case where the temperature difference (T5–T6) explained in FIG. 34 is large, the power supply to the halogen lamp 171*g* is made high, and in the case where the temperature difference (T5–T6) is small, the power supply to the halogen lamp 171*g* is made low; that is, the power supply to the halogen lamp 171*g* is controlled in proportion to the temperature difference).

According to the above-described embodiment, for a rotary member for applying heat whose temperature is easy to decrease quickly, it becomes possible to make temperature control with a highly quick response, which makes it possible to provide a fixing device capable of a quick start (rapid warming up).

(Embodiment 5)

Further, in an image forming apparatus using the above-described fixing method, the capability of continuous printing varies depending on the temperature of the inner portion of the rotary member for applying heat, the temperature of the rotary member for fixing which is disposed opposite to the rotary member for applying heat, the kind and size of the transfer material used, etc.

Figure 36:
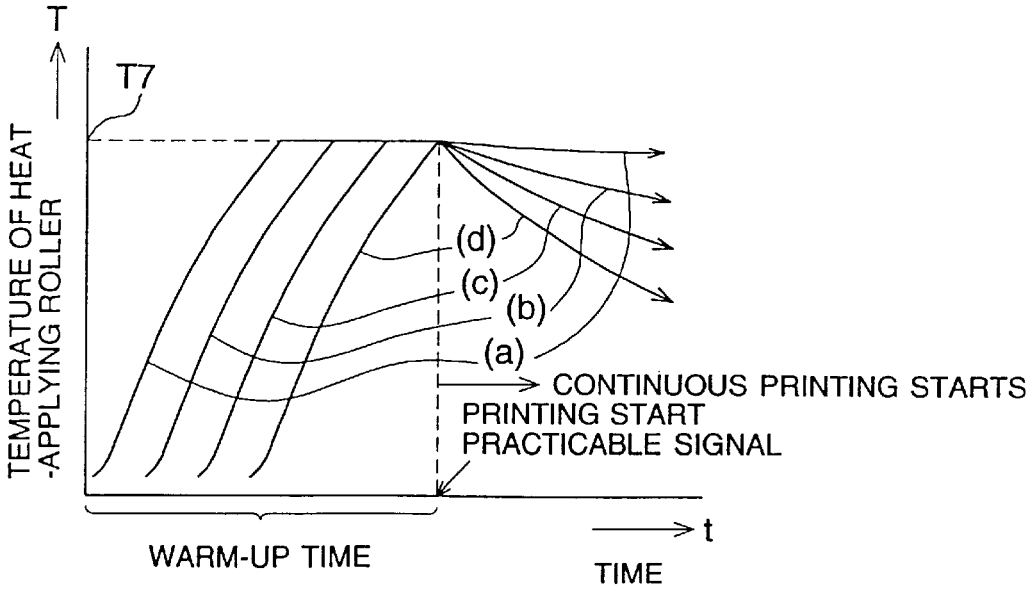
FIG. 36 is a view showing the warming-up time of the rotary member for applying heat according to the present invention.
Figure 37:
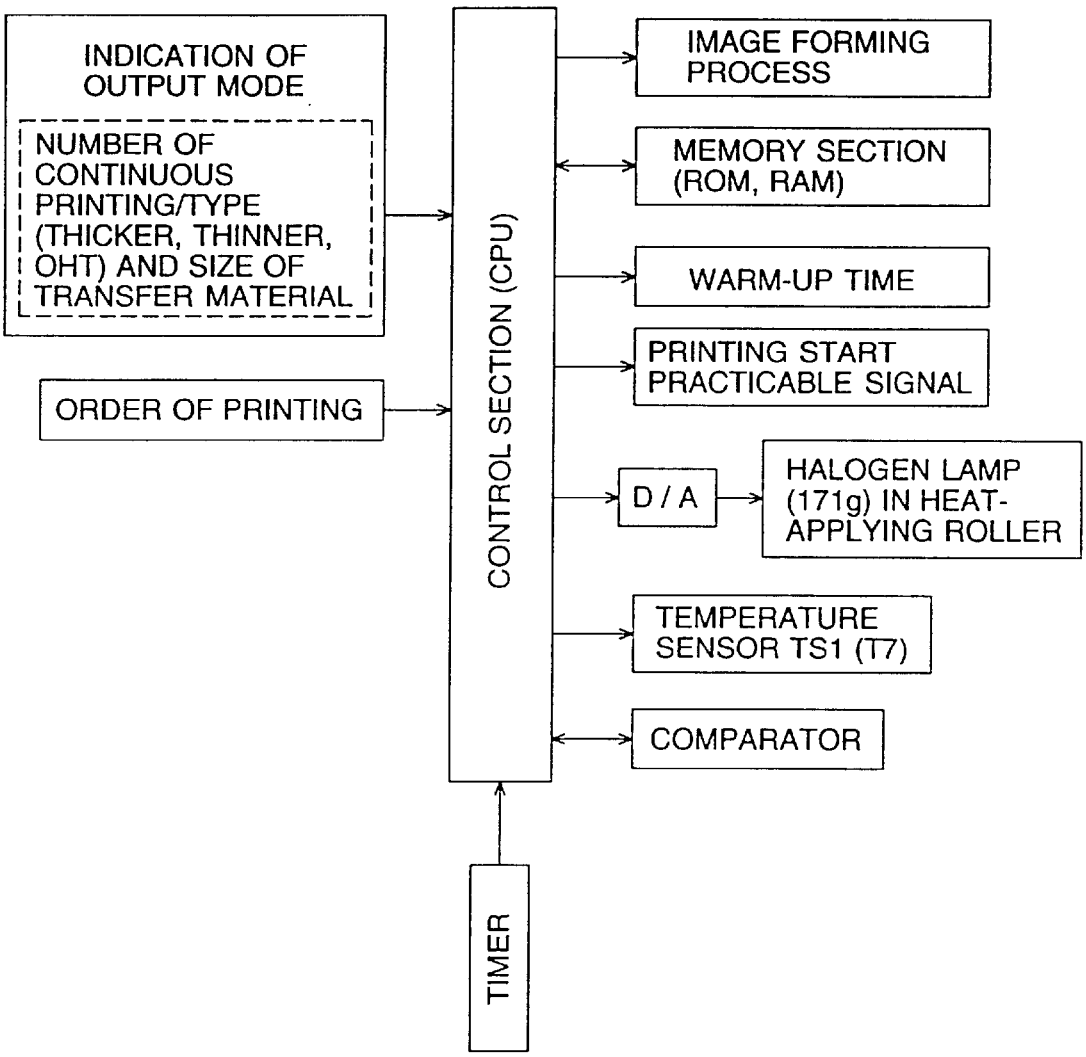
FIG. 37 is a temperature control block diagram in FIG. 36.

The method of control of the warming up time of the rotary member for applying heat of this invention for solving the above-described problem will be explained with reference to FIG. 36 and FIG. 37. FIG. 36 is a drawing showing the warming up time of a rotary member for applying heat of this invention, and FIG. 37 is a block diagram of the temperature control shown in FIG. 36. Further, FIGS. 38 and 39 are drawings for illustrating this invention.

FIG. 36 shows how the temperature rises during the warming up time before the print start signal, which is taken as a reference time, and how the temperature decreases with printing; regarding the heat applying roller 17*a* denoting a rotary member for applying heat, it takes a considerable time for it to warm up so as to make continuous printing possible, because its inner portion is cool although its surface is heated up. That is, as shown by the curve (a) in FIG. 36, in the case where warming up time is made long and the time until the print start after reaching the suitable fixing temperature T7 is also made long, the heat applying roller 17*a* is enough heated up to be capable of coping with the continuous printing to be done by a print instruction; however, as shown by the curves (c) and (d), in the case where warming up time is short and the time after reaching the suitable fixing temperature T7 is also short until the print start signal is outputted, the surface temperature of the heat applying roller 17*a* in the continuous printing done by a print instruction decreases in a short time, and it is difficult to cope with a continuous printing for a large number of prints.

For this reason, as shown in the block diagram in FIG. 37, the warming up time is varied in accordance with the instruction for the mode of output such as the number of prints in the continuous printing, the kinds of the transfer material such as a thick paper, a thin paper, an OHT, etc., the size of the transfer material, etc. For example, warming up is carried out respectively in the mode (d) in FIG. 36, in the mode (c) in FIG. 36, in the mode (b) in FIG. 36, and in the mode (a) in FIG. 36 according as the number of prints in the continuous printing is given as one to two, three to five, six to ten, and eleven or more, and print start signal is outputted to make the continuous printing by the print instruction. In the case where printing is done over again after it has once been done, the warming up time is reset on the basis of the temperature of the heat applying roller 17*a* or its history on temperature. For this setting of the warming up time, it is desirable to use any one of the methods in the embodiments 1 to 3 which have been already explained.

Figure 38:
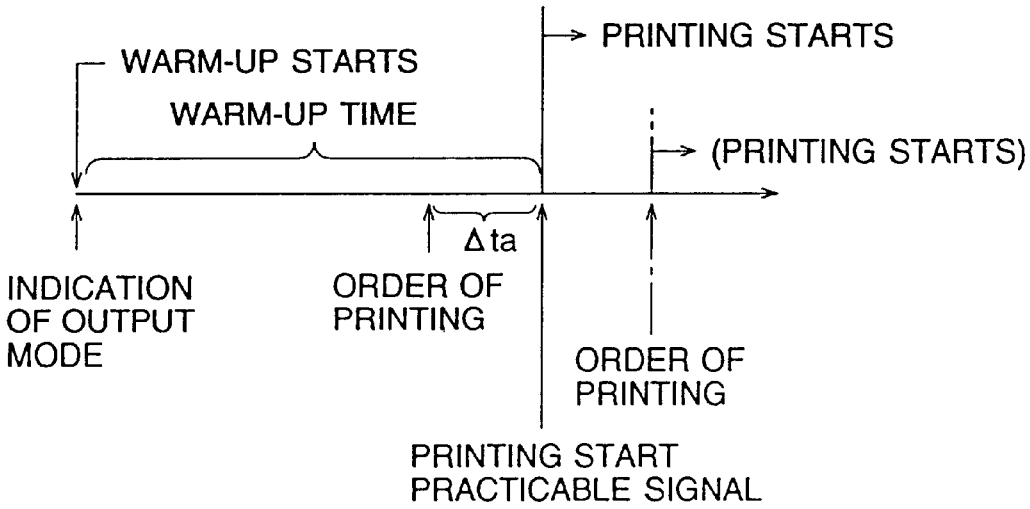
FIG. 38 is an illustrative view of the present invention.
Figure 39:
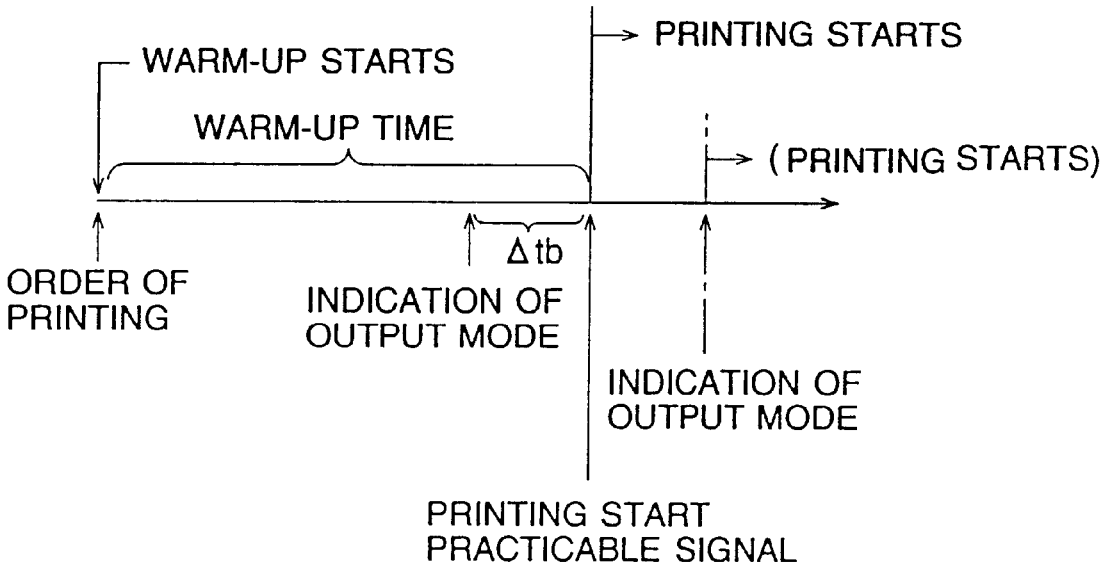
FIG. 39 is an illustrative view of the present invention.

Further, as shown in FIG. 38, in accordance with the output mode, the warming up time is determined through selecting, for example, any one of the modes of the above-described curves in FIG. 36, and heating (warming up) is started by the instruction of the output mode; if a print instruction is given before the determined warming up time has been completed, print start is done by the output of a print start signal after waiting for a period of Δta up to the completion of the warming up time. That is, in the case where a print instruction of the image forming apparatus is outputted after the instruction of the output mode, warming up is started by the instruction of the output mode and the waiting time for the print start is set by the print instruction outputted later. If a print instruction is given after the completion of the warming up time, print start is immediately carried out by the output of print instruction.

Further, as shown in FIG. 39, heating (warming up) is started by the print instruction, but because the instruction of the output mode has not been outputted yet and the output mode has not been determined, the mode of the longest warming up time shown by the above-described curve (a) in FIG. 36 is selected for example to make warming up, and if an instruction of the output mode is given before the completion of the determined warming up time, print start is carried out by the output of the print start signal after waiting for the waiting time Δtb up to the completion of the warming up time, after the instruction of the output mode. That is, in the case where a print instruction of the image forming apparatus is outputted earlier than the instruction of the output mode, warming up is started by the print instruction, and the waiting time up to the print start is set by the instruction of the output mode which is outputted later. On this occasion, there are some cases where it is necessary to set a longer warming up time and to set a longer waiting time by the instruction of the output mode. If an instruction of the output mode is given after the completion of the warming up time, print start is immediately started by the output of the instruction of the output mode.

Further, regarding the printer, the FAX machine, etc. explained in the image forming apparatus in FIG. 1, in order to shorten the warming up time, first, a print instruction is outputted beforehand, to start warming up. Next, an instruction of the output mode including image data is transmitted. In the copying machine equipped with an image reading portion in the upper part of the image forming apparatus explained in FIG. 1, when the instruction and the selection of the output mode such as the number of prints in continuous printing, the kind of the transfer material such as a thick paper, a thin paper, an OHP, etc., the size of the transfer material, etc. are started, warming up is started. If a print instruction is given without any instruction of the output mode given, the number of prints is made one. For a copying machine using an ADF, if a print instruction is given without any instruction of the output mode, warming up for a determined time is carried out.

As described in the above, it is also possible to start warming up with either one of the instruction of the output mode of the image forming apparatus and the print instruction made to have priority to the other.

Further, it is also possible to start warming up with the earlier one of the instruction of the output mode of the image forming apparatus and the print instruction made to have priority to the other, and in the case where the instruction of the output mode of the image forming apparatus is earlier and warming up is started by the instruction of the output mode, the control as explained in FIG. 38 is carried out. Further, in the case where the print instruction is earlier and warming up is started by the print instruction, the control as explained in FIG. 39 is carried out.

According to the above-described embodiment, it is possible to provide an image forming apparatus equipped with a fixing device capable of a quick start and coping with the variation of capability of continuous printing, depending on the temperature of the inner portion of the rotary member for applying heat, the temperature of the rotary member for fixing disposed opposite to the rotary member for applying heat, the kind and size of the transfer material, etc., by changing the warming up time of the rotary member for applying heat in accordance with the output mode.

Besides, the rotary member for applying heat described in the above has been explained as one made up of layers provided in the order of the ray transmitting base member, the resilient layer, and the ray absorbing layer; however, this invention includes a rotary member for applying heat formed of a ray transmitting base member and a ray absorbing layer provided on its outside (on the outer peripheral surface) without a resilient layer being provided.

According to this invention, print start is made practicable after the ray absorbing layer at the surface is heated up, and further the inner portion of the rotary member for applying heat is heated for a predetermined time; hence, it is possible to provide a fixing device capable of a quick start (rapid heating up) controlled so as to prevent the offset owing to low-temperature fixing.

According to this invention, by carrying out the temperature control through estimating the temperature of the inner portion of the rotary member for applying heat on the basis of the surface temperature of the rotary member for applying heat and the variation of the temperature, the inner portion is properly heated up, and the ray absorbing layer at the surface is always kept at the suitable fixing temperature; hence, it is possible to provide a fixing device capable of a quick start (rapid heating up) controlled so as to prevent the off-set owing to low-temperature fixing.

According to this invention, it becomes possible a temperature raising technology for a fixing device capable of a quick start (rapid heating up) having a rotary member for applying heat of a type using the radiation by heat rays, said rotary member for applying heat having a ray absorbing layer at the surface whose temperature can be raised in a short time and an inner portion whose temperature is low at that time.

According to this invention, it is possible to provide a fixing device capable of a quick start (rapid heating up), enabling the temperature control of highly quick response for a rotary member for applying heat whose temperature is easy to decrease quickly.

According to this invention, it is possible to provide an image forming apparatus having a fixing device capable of a quick start (rapid heating up), and coping with the variation of capability of continuous printing, depending on the temperature of the inner portion of the rotary member for applying heat, the temperature of the rotary member for fixing disposed opposite to the rotary member for applying heat, the kind and size of the transfer material, etc., by changing the warming up time of the rotary member for applying heat in accordance with the output mode.

What is claimed is:

1. A fixing apparatus for fixing a toner image on a transfer material by applying heat and pressure to the transfer material, the fixing apparatus comprising:

a roll-shaped rotary member for applying heat, including (a) a ray radiating device for radiating a ray;

(b) a cylindrical ray-transmitting base member through which the ray is transmitted, provided being arranged around the ray radiating device; and (c) a ray absorbing layer provided outside the cylindrical ray-transmitting base member for absorbing the ray, wherein the following conditions are satisfied, $$a1 > a3 \text{ and } 10\% \leqq a3/(a1+a3) \leqq 40\%$$

where a1 (%) represents a ray energy absorbing rate of the ray-transmitting base member, and a3 (%) represents a ray energy absorbing rate of the ray absorbing layer.

2. A fixing apparatus for fixing a toner image on a transfer material by applying heat and pressure to the transfer material, the fixing apparatus comprising:

a roll-shaped rotary member for applying heat, including (a) a ray radiating device for radiating a ray;

(b) a cylindrical ray-transmitting base member through which the ray is transmitted, provided being arranged around the ray radiating device;

(c) a cylindrical ray-transmitting resilient layer or a cylindrical ray-transmitting heat insulating layer; and (d) a ray absorbing layer provided outside the ray-transmitting resilient layer or the ray-transmitting heat insulating layer for absorbing the ray, wherein the following condition is satisfied, $$(b1+b2)>b3$$

where b1 (%) represents a ray energy absorbing rate of the ray-transmitting base member, b2 (%) represents a ray energy absorbing rate of the ray-transmitting resilient layer or the ray-transmitting heat insulating layer and b3 (%) represents a ray energy absorbing rate of the ray absorbing layer.

3. The fixing apparatus of claim 2, wherein the following condition is satisfied, $$b2>b1.$$

4. The fixing apparatus of claim 2, wherein the following condition is satisfied, $$10\% \leqq b3/(b1+b2+b3) \leqq 40\%.$$

* * * * *